United States Patent [19]

Ueda

[11] Patent Number: 5,004,677

[45] Date of Patent: Apr. 2, 1991

[54] METHOD FOR PROCESSING A SILVER HALIDE COLOR PHOTOGRAPHIC MATERIAL

[75] Inventor: Shinji Ueda, Kanagawa, Japan

[73] Assignee: Fuji Photo Film Co., Ltd., Kanagawa, Japan

[21] Appl. No.: 313,280

[22] Filed: Feb. 21, 1989

[30] Foreign Application Priority Data

Feb. 19, 1988 [JP] Japan ..... 63-36543

[51] Int. Cl.[5] ..... G03C 7/16

[52] U.S. Cl. ..... 430/382; 430/393; 430/544

[58] Field of Search ..... 430/544, 393, 382

[56] References Cited

U.S. PATENT DOCUMENTS

| | | | |
|---|---|---|---|
| 3,893,858 | 7/1975 | Wabnitz | 430/393 |
| 4,477,563 | 4/1981 | Ichijima et al. . | |
| 4,798,784 | 1/1989 | Kishimoto et al. | 430/382 |
| 4,812,389 | 3/1989 | Sakanoue et al. | 430/382 |

FOREIGN PATENT DOCUMENTS

| | | | |
|---|---|---|---|
| 1290812 | 3/1969 | Fed. Rep. of Germany | 430/393 |

*Primary Examiner*—Charles L. Bowers, Jr.
*Assistant Examiner*—Thomas R. Neville
*Attorney, Agent, or Firm*—Sughrue, Mion, Zinn, Macpeak & Seas

[57] ABSTRACT

A method for processing a silver halide color photographic light-sensitive material is disclosed, which comprises, after color development of an imagewise exposed silver halide color photographic material, processing the developed silver halide color photographic material with a processing solution having a bleaching ability, wherein the silver halide color photographic light-sensitive material contains at least one DIR coupler having at its coupling active position a group which forms a development inhibitor or precursor thereof when released from the coupling active position of the coupler upon a coupling reaction with an oxidation product of an aromatic primary amine color developing agent which is formed upon a color development reaction, and further decomposes into a compound having substantially no effect on photographic properties once discharged into a color developing solution wherein the half-life period of the development inhibitor or precursor thereof at pH 10.0 is not more than 4 hours, and wherein the processing solution having a bleaching ability contains, as bleaching agents, a ferric complex salt of 1,3-diaminopropanetetraacetic acid and has a pH of from 5.8 to 1.5.

23 Claims, No Drawings

METHOD FOR PROCESSING A SILVER HALIDE COLOR PHOTOGRAPHIC MATERIAL

FIELD OF THE INVENTION

The present invention relates to a method for processing an exposed silver halide color photographic material (hereinafter referred simply to as a color light-sensitive material) which comprises developing, bleaching, and fixing (hereinafter referred simply to as a processing method), and more particularly, to an improved processing method which accelerates the bleaching function, thus shortening the processing time while conducting sufficient bleaching, thus providing a color photographic image of good image quality.

BACKGROUND OF THE INVENTION

The fundamental steps of processing color light-sensitive materials generally include a color developing step and a silver removing step. Thus, an exposed silver halide color photographic material is introduced into a color developing step, where silver halide is reduced with a color developing agent to produce silver and the oxidized color developing agent in turn reacts with a color former (a color coupler) in situ to form a dye intermediate (a leuco dye). Subsequently, the color photographic material having the silver and the dye intermediate imagewise distributed therein is introduced into a silver removing step, where the silver produced in the preceding step is oxidized with an oxidizing agent (usually called a bleaching agent) and dissolved away with a silver ion complexing agent usually called a fixing agent, and at the same time, the dye intermediate in the color photographic material is oxidized with the oxidizing agent to provide a dye image. As a result, only the dye image is formed in the processed photographic material. In addition to the above described two fundamental steps of color development and silver removal, actual development processing involves auxiliary steps for maintaining the photographic and physical quality of the resulting image or for improving the preservability of the image. For example, these auxiliary steps may include a hardening bath for preventing a light-sensitive layer from being excessively softened during photographic processing, a stopping bath for effectively stopping the developing reaction, an image stabilizing bath for stabilizing the image, and a layer removing bath for removing the backing layer on the support.

The above described silver removal step may be conducted in two ways: the first uses two steps individually employing a bleaching bath and a fixing bath; and the second is more simple and is conducted in one step employing a bleach-fixing bath containing both a bleaching agent and a fixing agent to accelerate processing and reduce labor.

In recent years, bleach processing using a ferric ion complex salt (e.g., aminopolycarboxylic acid ferric ion complex salt, particularly iron (III) ethylenediaminetetraacetate complex salt) as a major bleaching component has mainly been employed in the processing of color photographic light-sensitive materials in view of the acceleration and simplification of the bleaching provided thereby and environmental factors.

However, ferric ion complex salts have a comparatively low oxidizing power and, therefore, have insufficient bleaching power. A bleaching or bleach-fixing solution containing such a complex salt as a bleaching agent can attain some desirable objects when bleaching or bleach-fixing a low speed silver halide color photographic light-sensitive material containing, e.g., a silver chlorobromide emulsion as a major component. However, such a solution provides insufficient silver removal due to insufficient bleaching power or requires an unacceptably long time to bleach when processing a high speed, spectrally sensitized silver halide color photographicmaterial containing a silver chlorobromoiodide emulsion or a silver iodobromide emulsion as a major component. This is particularly true for color reversal light-sensitive materials or color negative light-sensitive materials for photographing which comprise an emulsion containing larger amounts of silver.

In color light-sensitive materials, sensitizing dyes are generally employed for the purpose of spectral sensitization. In particular, when a silver halide emulsion containing a large amount of silver or tabular grains having a high aspect ratio is employed in order to achieve high sensitivity, a problem occurs in that sensitizing dyes adsorbed on the surfaces of silver halide grains interfere with the bleaching of silver formed by development of the silver halide.

Bleaching agents other than ferric ion complex salts include persulfates. Persulfates are usually used in a bleaching solution together with a chloride. However, this persulfate-containing bleaching solution has less bleaching ability than ferric ion complex salts, thus requiring a substantially longer period of time for bleaching.

Bleaching agents which do not cause environmental pollution or corrode vessels and apparatus typically have weak bleaching power. Hence, it is desirable to enhance the bleaching power of a bleaching solution or a bleach-fixing solution containing a bleaching agent having a weak bleaching power, particularly when the bleaching agent comprises a ferric ion complex salt or a persulfate.

In order to accelerate bleaching, processing methods wherein two or more kinds of aminopolycarboxylic acid ferric complex salts are employed in combination are described, e.g., in *Research Disclosure* No. 24033 (April 1984), and in JP-A-60-230653 (the term "JP-A" as used herein means an "unexamined published Japanese patent application"). However, these methods are also inadequate for obtaining a satisfactorily high bleach accelerating effect.

Recently, the importance of using DIR couplers increases, as higher image quality light-sensitive materials are desired. Also, the amount of DIR couplers being added to light-sensitive materials has increased.

On the other hand, it is known that development inhibitors released from DIR couplers adversely affect desilvering and cause insufficient silver removal when the processing time is shortened. In order to solve this problem, a method is described in JP-A-62-148951 wherein the desilvering property is improved by using a DIR coupler which releases a development inhibitor which further decomposes into a compound having substantially no effect on photographic properties once entered into a color developing solution. However, improvement in the desilvering property using the above described method is inadequate, and furthermore causes the cyan density, particularly the high density portion thereof to decrease due to inferior coloring resulted from insufficient oxidation of the dye intermediates in the processed photographic material during the bleaching step.

SUMMARY OF THE INVENTION

Therefore, an object of the present invention is to provide a processing method for desilveration which provides good quality photographic images without the occurrence of inferior coloring.

Another object of the present invention is to provide a processing method which is both rapid and has an excellent desilvering property.

Other objects of the present invention will become apparent from the following description and examples.

As a result of extensive investigations to solve the above described problems, it has been found that the inferior coloring described above is prevented by processing color light-sensitive materials containing a hydrolyzable type DIR coupler with a processing solution containing a specific bleaching agent thus accomplishing the present invention.

More specifically, the objects of the present invention are accomplished by a method for processing a silver halide color photographic material which comprises, after color development of an imagewise exposed silver halide color photographic material, processing the developed silver halide color photographic material with a processing solution and having a bleaching ability, wherein the silver halide color photographic light-sensitive material contains at least one DIR coupler having at its coupling active position a group which forms a development inhibitor or precursor thereof when released from the coupling active position of the coupler upon a coupling reaction with an oxidation product of an aromatic primary amine color developing agent which is formed upon a color development reaction, and further decomposes into a compound having substantially no effect on photographic properties once discharged into a color developing solution wherein the half-life period of the development inhibitor or precursor thereof at pH 10.0 is not more than 4 hours, and wherein the processing solution having a bleaching ability contains, as bleaching agents, a ferric complex salt of 1,3-diaminopropanetetraacetic acid and has a pH of from 5.8 to 1.5.

DETAILED DESCRIPTION OF THE INVENTION

The DIR coupler for use in the present invention is a coupler having at its coupling active position a group which forms a compound having a development inhibiting function (i.e., a development inhibitor) or precursor thereof when released from the coupling active position of the coupler upon a coupling reaction with the oxidized color developing agent and which decomposes into a compound having substantially no effect on photographic properties (i.e., no development-inhibiting effect) after being discharged into a color developing solution. The development inhibitor or precursor thereof is to have a certain decomposition rate coefficient. More specifically, a half-life period of the development inhibitor or precursor thereof at pH 10.0 is 4 hours or less, preferably 2 hours or less, and more preferably 1 hour or less.

The half-life period of the development inhibitor or precursor thereof in the present invention is readily measured in the following manner. A development inhibitor or precursor thereof to be measured is added to a developing solution having the composition shown below in an amount of $1\times10^{-4}$ mol/liter. The solution is maintained at 38° C. and the concentration of the remaining development inhibitor or precursor thereof is determined by liquid chromatography at periodic intervals to give the half-life period of the development inhibitor or precursor thereof. The half-life period is the time required for the initial inhibitor concentration to decrease by one-half.

Composition of Developing Solution

| | |
|---|---|
| Diethylenetriaminepentaacetic acid | 0.8 g |
| 1-Hydroxyethylidene-1,1-diphosphonic acid | 3.3 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N-Ethyl-N-β-hydroxyethylamino)-2-methylaniline sulfate | 4.5 g |
| Water to make | 1.0 l |
| pH | 10.0 |

The half-life period of the development inhibitor or precursor thereof varies depending on the pH of a developing solution used. More specifically, as the pH increases, the half-life period decreases. Therefore, the remaining amount of development inhibitor is controlled by means of adjusting the pH of the developing solution used at development processing.

The equilibrium concentration (x) of a development inhibitor in the developing solution during continuous processing in case of using the above-described DIR coupler having a hydrolyzable releasing group can be represented by the following differential equation:

$$dx=[a-(v+kV)x]dt$$

wherein k represents the decomposition rate coefficient; V represents the capacity of the developing tank; a represents the discharge amount of the development inhibitor from the photographic material into a developing solution; and v represents the amount of replenishment.

In the equation, when dx/dt is 0, x is a/(v+kV). Accordingly it can be seen that the equilibrium concentration (x) of development inhibitor depends on the discharge amount of the development inhibitor (a) and the decomposition rate coefficient (k).

Any hydrolyzable type DIR coupler which satisfies the half life period condition described above can be employed in the present invention. More specifically, hydrolyzable type DIR couplers represented by the following general formula (I) can be used.

$$A\text{-}(L_1)_a\text{—}Z\text{-}L_2\text{—}Y)_b]_m \qquad (I)$$

wherein A represents a coupler residue; Z represents a fundamental portion of a compound having a development-inhibiting function which is connected directly (when a is 0) or through linking group $L_1$ (when a is 1) with the coupling position of the coupler; Y represents a substituent connected with Z through linking group $L_2$ to allow the development-inhibiting function of Z to emerge; $L_1$ represents a linking group; L2 represents a linking group including a chemical bond which is cleaved in a developing solution; a represents the integer of 0 or 1; b represents the integer of 1 or 2, when b represents 2, the two —$L_2$—Y groups may be the same or different; and m represents the integer of 1 or 2.

The compound represented by the general formula (I) may release either $\ominus Z\text{-}(L_2\text{—}Y)_b$ or $L\ominus_1\text{—}Z\text{-}(L_2\text{—}Y)_b$ after the coupling reaction with an oxidation product of a color developing agent. The latter changes immediately into $\ominus Z\text{-}(L_2\text{—}Y)_b$ by releasing $L_1$. The moiety $\ominus Z\text{-}(L_2\text{—}Y)_b$ diffuses in the light-sensitive layer while exerting the development inhibiting function and a part thereof enters into the color developing solution. The $\ominus Z\text{-}(L_2\text{—}Y)_b$ having entered into the color developing solution rapidly decomposes at the chemical bonds of $L_2$; that is, the connection between Z and Y is cleaved, whereby a compound which has no development-inhibiting function and which has a water-soluble group in Z remains in the color developing solution, and the development-inhibiting function is thus terminated.

As a result, compounds having a development inhibiting function are not accumulated in a processing solution, and thus it becomes possible not only to repeatedly reuse the processing solution, but also to incorporate a sufficient amount of DIR couplers into the light-sensitive material.

Hydrolyzable type DIR couplers represented by the general formula (I) are described in more detail below.

Preferred examples of yellow color image forming coupler residues represented by A include those of pivaloyl acetanilide type, benzoyl acetanilide type, malonic diester type, malondiamide type, dibenzoylmethane type, benzothiazolyl acetamide type, malonic ester monoamide type, benzothiazolyl acetate type, benzoxazolyl acetamide type, benzoxazolyl acetate type, benzimidazolyl acetamide type and benzimidazolyl acetate type; the coupler residues derived from hetero ring-substituted acetamides or hetero ring-substituted acetates as described in U.S. Pat. No. 3,841,880; the coupler residues derived from the acyl acetamides as described in U.S. Pat. No. 3,770,446, British Patent 1,459,171, West German Patent Application (OLS) No. 2,503,099, JP-A-50-139738 and *Research Disclosure,* No. 15737; and the hetero ring type coupler residues as described in U.S. Pat. No. 4,046,574, etc.

Preferred examples of magenta color image forming coupler residues represented by A include those of 5-oxo-2-pyrazoline type, pyrazolo[1,5-a]benzimidazole type and cyanoacetophenone type; and coupler residues having a pyrazolotriazole nucleus, etc.

Preferred examples of cyan color image forming coupler residues represented by A include those having a phenol nucleus or an α-naphthol nucleus.

Further, DIR couplers are also employed which release a development inhibitor upon coupling with an oxidation product of a developing agent but do not form a dye. Suitable examples of such coupler residues represented by A include the coupler residues as described in U.S. Pat. Nos. 4,052,213, 4,088,491, 3,632,345, 3,958,993, and 3,961,959, etc.

The fundamental portion of a development inhibitor represented by Z includes a divalent nitrogen-containing heterocyclic group or nitrogen-containing thio group. Suitable examples of heterocyclic thio groups include a tetrazolylthio group, a benzothiazolylthio group, a benzimidazolylthio group, a triazolylthio group, and an imidazolylthio group, etc. Suitable examples of Z are set forth below, including showing the positions of substitution of the A—$L_{1-a}$ group and the $\text{-}(L_2\text{—}Y)_b$ group.

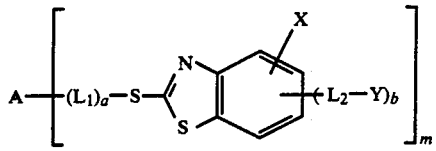

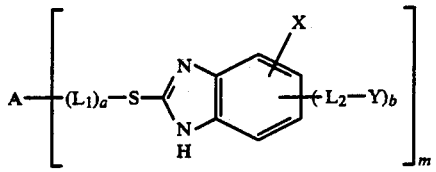

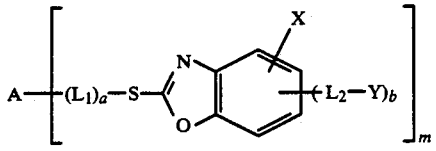

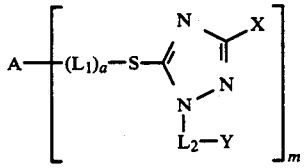

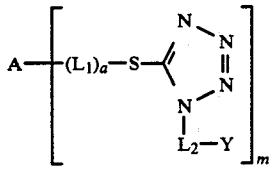

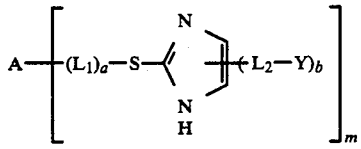

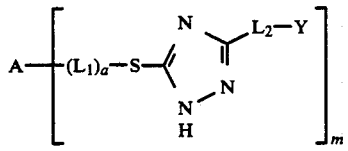

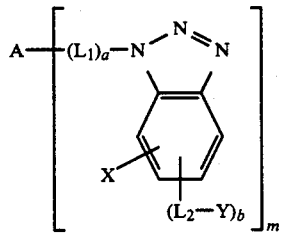

-continued

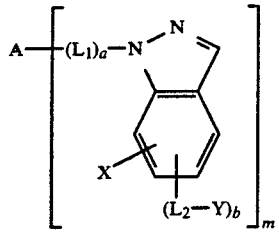

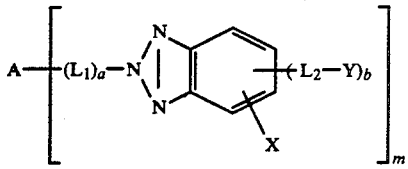

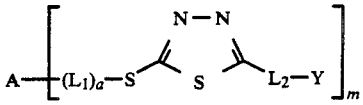

In the above formulae, the substituent represented by X is included in a portion represented by Z in the general formula (I), and represents a hydrogen atom, a halogen atom, an alkyl group having 1 to 10 carbon atoms (e.g., methyl, ethyl, propyl, isopropyl, pentyl), an alkenyl group having 2 to 10 carbon atoms (e.g., vinyl, allyl), an alkanamindo group having 1 to 10 carbon atoms (e.g., methanamido, ethanamido), an alkenamido group having 2 to 10 carbon atoms (e.g., ethanamido), an alkoxy group having 1 to 10 carbon atoms (e.g., methoxy, ethoxy, propoxy), a sulfonamido group having 1 to 10 carbon atoms (e.g., methanesulfonamido, ethanesulfonamido) or an aryl group having 6 to 10 carbon atoms (e.g., phenyl).

Examples of the group represented by Y in the general formula (I) include an alkyl group having 1 to 10 carbon atoms (e.g., methyl, ethyl, propyl, isopropyl, pentyl), a cycloalkyl group having 3 to 10 carbon atoms (e.g., cyclopentyl, cyclohexyl), an alkenyl group having 2 to 10 carbon atoms (e.g., vinyl, allyl), a cycloalkenyl group having 3 to 10 carbon atoms (e.g., cyclopentenyl, cyclohexenyl), an aryl group having 6 to 10 carbon atoms (e.g., phenyl), an aralkyl group having 7 to 10 carbon atoms (e.g., benzyl, phenethyl), or a 5-or 6-membered heterocyclic group containing an oxygen atom, a nitrogen atom or a sulfur atom as a hetero atom (e.g., phridyl).

Suitable examples of the linking group represented by $L_1$ in the general formula (I) are set forth below, together with the groups A— and —Z—$(L_2—Y)_b$.

$$A\text{+}OCH_2—Z—(L_2—Y)_b]_m$$

(a linking group as described in U.S. Pat. No. 4,146,396)

$$A\text{+}SCH_2—Z—(L_2—Y)_b]_m$$

$$A\text{+}O\overset{O}{\overset{\|}{C}}—Z—(L_2—Y)_b]_m$$

(a linking group as described in West German Patent Application (OLS) No. 2,626,315)

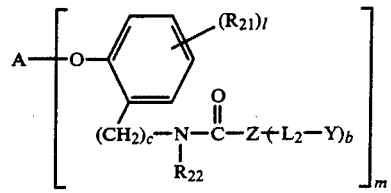

(a linking group as described in West German Patent Application (OLS) No. 2,855,697; c represents an integer from 0 to 2)

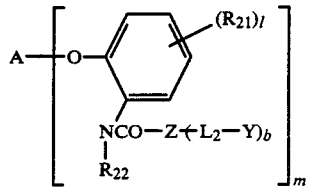

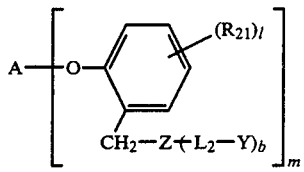

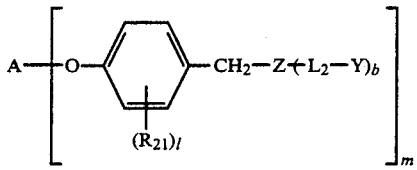

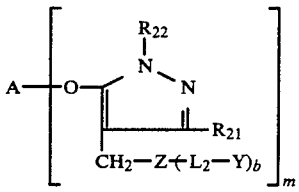

In the above formulae, $R_{21}$ represents a hydrogen atom, a halogen atom, an alkyl group having 1 to 6 carbon atoms (e.g., methyl, ethyl, propyl, isopropyl, pentyl), an alkenyl group having 2 to 6 carbon atoms (e.g., vinyl, allyl), an aralkyl group having 7 to 10 carbon atoms (e.g., benzyl, phenethyl), an alkoxy group having 1 to 6 carbon atoms (e.g., methoxy, ethoxy, pentyloxy), an alkoxycarbonyl group having 2 to 7 carbon atoms (e.g., methylcarbonyl, ethylcarbonyl), an anilino group, an acylamino group having 1 to 6 carbon atoms (e.g., acetylamino), a ureido group having up to 6 carbon atoms (e.g., ureido, methylureido), a cyano group, a nitro group, a sulfonamido group having up to 6 carbon atoms (e.g., sulfonamido, methanesulfonamido, ethansulfonamido), a sulfamoyl group up to 6 carbon atoms (e.g, sulfamoyl, methylsulfamoyl), a carbamoyl group having 1 to 6 carbon atoms (e.g., carbamoyl, methylcarbamoyl), an aryl group having 6 to 10 carbon atoms (e.g., phenyl), a carboxy group, a sulfo group, a cycloalkyl group having 3 to 6 carbon atoms (e.g., cyclopentyl, cyclohexyl), an alkanesulfonyl group having 1 to 6 carbon atoms (e.g., methanesulfonyl), an arylsulfonyl group having 6 to 10 carbon atoms (e.g., phenylsulfonyl) or an acyl group having 1 to 6 carbon atoms (e.g., acetyl), $R_{22}$ represents a hydrogen atom, an alkyl group having 1 to 6 carbon atoms (e.g., methyl, ethyl), an alkenyl group having 2 to 7 carbon atoms (e.g., vinyl, allyl), an aralkyl group having 7 to 10 carbon atoms (e.g., benzyl, phenetyl), a cycloalkyl group having 3 to 6 carbon atoms (e.g., cyclopentyl, cyclohexyl) or an aryl group having 6 to 10 carbon atoms (e.g., phenyl), and b and l each represents 1 or 2 and, when l represents 2, $R_{21}$'s may be bound to each other to form a fused ring.

With these DIR couplers (i.e., cases wherein a represents 1 in the general formula (I)), a releasing group released upon the reaction with an oxidation product of a developing agent decomposes immediately and leases a development inhibitor [H—Z—($L_2$—Y)$_b$]. These re couplers have the same effect in accordance with the present invention as DIR couplers which do not contain the group represented by $L_1$ (i.e., cases wherein "a" represents 0 in the general formula (I)).

The linking group represented by $L_2$ in the general formula (I) includes a chemical bond which is cleaved in a developing solution. Suitable examples of such chemical bonds include those described in the table below. These chemical bonds are cleaved with a nucleophilic reagent such as a hydroxy ion or a hydroxylamine, etc., which is a component of the color developing solution of the present invention. The desired effect of the present invention is thereby attained.

TABLE

| Chemical Bond Included in $L_2$ | Cleavage Reaction of Chemical Bond (Reaction with $^{\ominus}OH$) |
|---|---|
| —COO— | —COOH + HO— |
| H<br>—NCOO— | —$NH_2$ + HO— + $CO_2$ |
| —$SO_2O$—<br>—$OCH_2CH_2SO_2$— | —$SO_3H$ + HO—<br>—OH + $CH_2$=$CHSO_2$— |
| —OCO—<br>‖<br>O | —OH + HO— + $CO_2$ |
| —NHCCO—<br>‖‖<br>OO | —$NH_2$ + HO— + 2$CO_2$ |

The divalent linking group shown in the above table is linked to Z directly or through an alkylene group having 1 to 6 carbon atoms (e.g., ethylene) and/or a phenylene group, whereas it is linked directly to Y. In the case of the divalent linking group being linked to Z through an alkylene group or a phenylene group, the divalent alkylene or phenylene group may contain an ether bond, an amido bond, a carbonyl bond, a thioether bond, a sulfon group, a sulfonamido bond, and a urea bond.

Preferred examples of the linking group represented by $L_2$ and the bonding thereof to Z and Y are set forth below.

—Z—$(CH_2)_d$COO—Y

—Z—$(CH_2)_d$O—C(=O)—Y

-continued

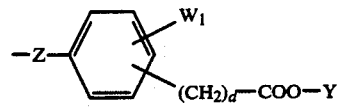

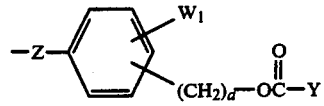

—Z—$(CH_2)_d$NHCOO—Y

—Z—$(CH_2)_d$O—C(=O)—NH—Y

—Z—NH—C(=O)—$(CH_2)_d$—C(=O)—Y

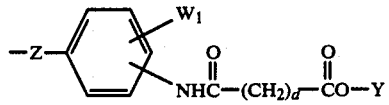

—Z—$(CH_2)_p$—$COOCH_2CH_2SO_2$—Y

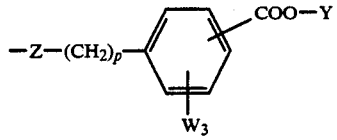

—Z—NCOO—Y
|
$W_2$

—Z—NCOCO—Y
|
$W_2$

In the above described formulae, d represents an integer from 0 to 10, preferably from 0 to 5; $W_1$ represents a hydrogen atom, a halogen atom, an alkyl group having from 1 to 10, preferably from 1 to 5 carbon atoms, an alkanamido group having from 1 to 10, preferably from 1 to 5 carbon atoms, an alkoxy group having from 1 to 10, preferably from 1 to 5 carbon atoms, an alkoxycarbonyl group having from 2 to 10, preferably from 2 to 5 carbon atoms, an aryloxycarbonyl group having from 6 to 22, preferably from 6 to 10 carbon atoms, an alkanesulfonamido group having from 1 to 10, preferably from 1 to 5 carbon atoms, an aryl group having from 6 to 22, preferably from 6 to 10 carbon atoms, a carbamoyl group, an N-alkylcarbamoyl group having from 1 to 10, preferably from 1 to 5 carbon atoms, a nitro group, a cyano group, an arylsulfonamido group having from 6 to 10 carbon atoms, a sulfamoyl group or an imido group; $W_2$ represents a hydrogen atom, an alkyl group having from 1 to 6 carbon atoms, an aryl group having from 6 to 22, preferably from 6 to 10 carbon atoms or an alkenyl group having from 2 to 10, preferably from 2 to 5 carbon atoms; $W_3$ represents a hydrogen atom, a halogen atom, a nitro group, an alkoxy group having from 1 to 6 carbon atoms or an alkyl group having from 1 to 6 carbon atoms; and p represents an integer from 0 to 6.

The alkyl group or the alkenyl group represented by X or Y specifically represents a straight chain, branched chain or cyclic alkyl group or alkenyl group having from 1 to 10, preferably from 1 to 5 carbon atoms (e.g., methyl, ethyl, propenyl, etc.), and preferably has a substituent. Examples of the substituents include a halogen atom, a nitro group, an alkoxy group having from 1 to 4 carbon atoms, an aryloxy group having from 6 to 10 carbon atoms, an alkanesulfonyl group having from 1 to 4 carbon atoms, an arylsulfonyl group having from 6 to 10 carbon atoms, an alkanamido group having from 1 to 5 carbon atoms, an anilino group, a benzamido group, a carbamoyl group, a carbamoyl group substituted with an alkyl group having from 1 to 6 carbon atoms, a carbamoyl group substituted with an aryl group having from 6 to 10 carbon atoms, an alkylsulfonamido group having from 1 to 4 carbon atoms, an arylsulfonamido group having from 6 to 10 carbon atoms, an alkylthio group having from 1 to 4 carbon atoms, an arylthio group having from 6 to 10 carbon atoms, a phthalimido group, a succinimido group, an imidazolyl group, a 1,2,4-triazolyl group, a pyrazolyl group, a benzotriazolyl group, a furyl group, a benzothiazolyl group, an alkylamino group having from 1 to 4 carbon atoms, an alkanoyl group having from 1 to 4 carbon atoms, a benzoyl group, an alkanoyloxy group having from 1 to 4 carbon atoms, a benzoyloxy group, a perfluoroalkyl group having from 1 to 4 carbon atoms, a cyano group, a tetrazolyl group, a hydroxy group, a carboxy group, a mercapto group, a sulfo group, an amino group, an alkylsulfamoyl group having from 1 to 4 carbon atoms, an arylsulfamoyl group having from 6 to 10 carbon atoms, a morpholino group, an aryl group having from 6 to 10 carbon atoms, a pyrrolidinyl group, a ureido group, a urethane group, a carbonyl group substituted with an alkoxy group having from 1 to 6 carbon atoms, a carbonyl group substituted with an aryloxy group having from 6 to 10 carbon atoms, an imidazolidinyl group or an alkylidenamino group having from 1 to 6 carbon atoms, etc. Specific examples of the substituent include chlorine atom, methoxy, methylsulfonyl, phenylsulfonyl, methanamido, isopropylcarbamoyl, etc.

The alkanamido group or the alkenamido group represented by X specifically represents a straight chain, branched chain or cyclic alkanamido or alkenamido group having from 1 to 10, and preferably from 1 to 5 carbon atoms which may be substituted. Examples of the substituents are selected from the substituents as defined for the above described alkyl group or alkenyl group, etc. Specific examples of the alkanamido or alkenamido group represented by X include methanamido, propenamido, etc.

The alkoxy group represented by X specifically represents a straight chain, branched chain or cyclic alkoxy group having from 1 to 10, and preferably from 1 to 5 carbon atoms which may be substituted. Examples of the substituents are selected from the substituents as defined for the above described alkyl group or alkenyl group, etc. Specific examples of the alkoxy group represented by X include ethoxy.

The aryl group represented by X or Y specifically represents a phenyl group or a naphthyl group which may be substituted. Examples of the substituents are selected from the substituents as defined for the above described alkyl group or alkenyl group and an alkyl group having from 1 to 4 carbon atoms (e.g., methyl, ethyl) and the like.

The heterocyclic group represented by Y include a diazolyl group (e.g., 2-imidazolyl, or 4-pyrazolyl), a triazolyl group (e.g., 1,2,4-triazol-3-yl), a thiazolyl group (e.g., 2-benzothiazolyl), an oxazolyl group (e.g., 1,3-oxazol-2-yl), a pyrrolyl group, a pyridyl group, a diazinyl group (e.g., 1,4-diazin-2-yl), a triazinyl group (e.g., 1,2,4-triazin-5-yl), a furyl group, a diazolinyl group (e.g., imidazolin-2-yl), a pyrrolinyl group, or a thienyl group, etc.

Of the couplers represented by the general formula (I), preferred couplers are those represented by the general formula (II), (III), (IV), (V), (VI), (VII) or (VIII) shown below. These couplers are preferred since the development inhibiting function of the development inhibitor released therefrom is particularly strong.

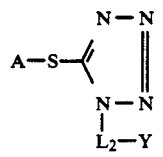
(II)

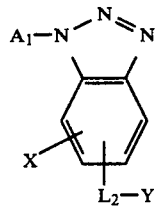
(III)

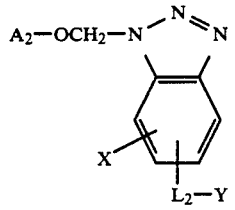
(IV)

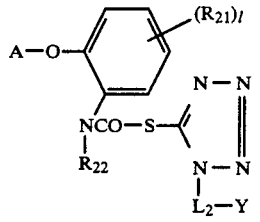
(V)

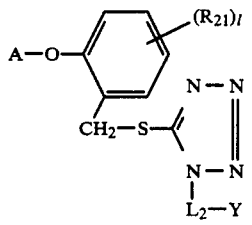
(VI)

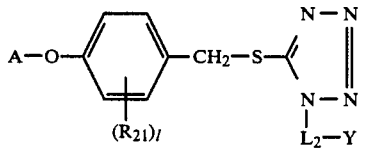
(VII)

-continued (VIII)

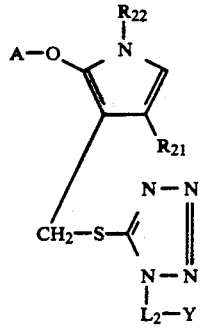

In the above described general formulae, A, X, $L_2$, Y, $R_{21}$, $R_{22}$ and l each has the same meaning as defined above. In the general formula (III), $A_1$ represents the coupler residue as defined for A in the general formula (I), excluding cyan color image forming coupler residues. In the general formula (IV), $A_2$ represents a cyan color image forming coupler residue of the coupler residues as defined for A in the general formula (I).

Further, the effects of the present invention are particularly exhibited when couplers represented by the general formula (IX), (X), (XI), (XII), (XIII), (XIV), (XV), (XVI), (XVII), (XVIII) or (XIX) described below are employed. These couplers are preferred because of their high coupling rates.

(IX)

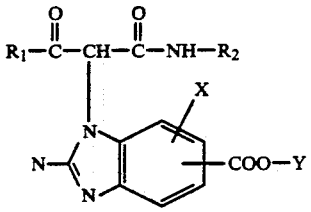

(X)

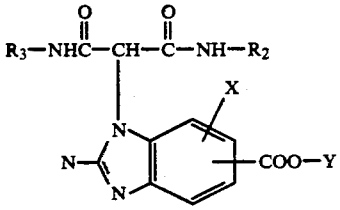

(XI)

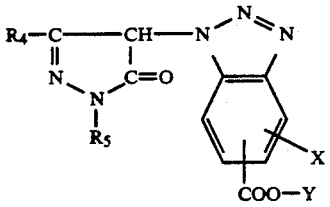

(XII)

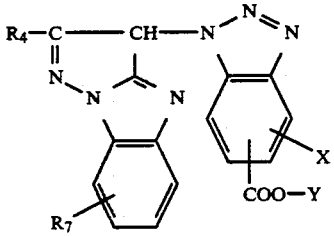

-continued (XIII)

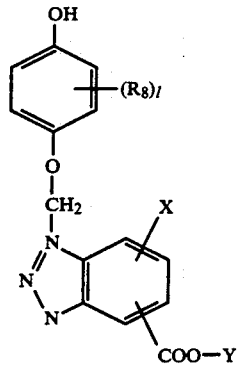

(XIV)

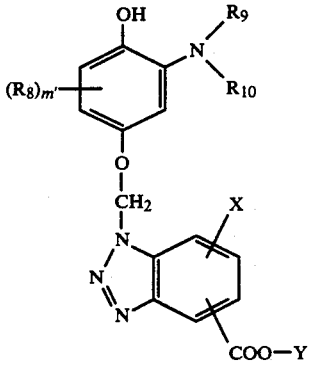

(XV)

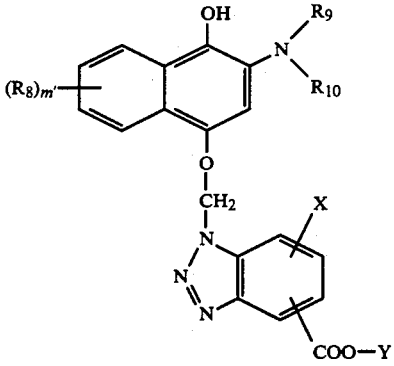

(XVI)

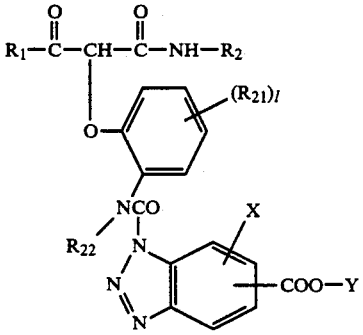

-continued (XVII)

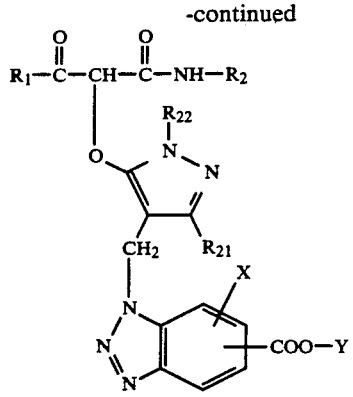

(XVIII)

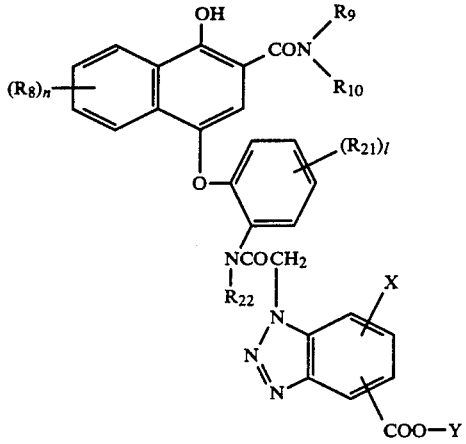

(XIX)

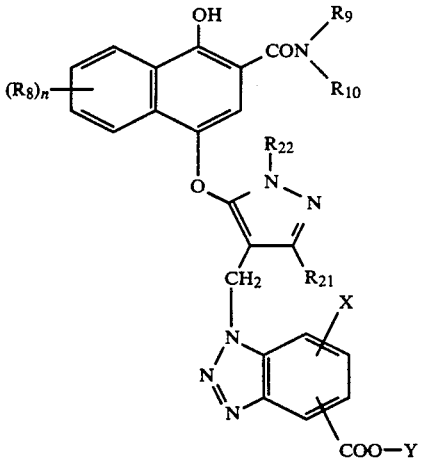

In the above described general formulae, X, Y, $R_{21}$, and $R_{22}$ each has the same meaning as defined above.

In the above described general formulae, $R_1$ represents an aliphatic group, an aromatic group, an alkoxy group or a heterocyclic group such as 5- or 6-membered heterocyclic group containing an oxygen atom, a nitrogen atom or a sulfur atom as a hetero atom; and $R_2$ and $R_3$ each represents an aromatic group or a heterocyclic group such as a 5- or 6-membered heterocyclic group containing an oxygen atom, a nitrogen atom or a sulfur atom as a hetero atom.

The aliphatic group represented by $R_1$ is preferably an alkyl group containing from 1 to 22 carbon atoms, and may have substituents or not, and further, may have a chain form or a cyclic form. Preferable substituents therefor include an alkoxy group (e.g., ethoxy), an aryloxy group (e.g., phenoxy), an amino group, an acylamino group (e.g., acetylamino), a halogen atom (e.g., chlorine), etc., each of which may further have a substituent(s). Specific examples of aliphatic groups useful for $R_1$ include an isopropyl group, an isobutyl group, a tert-butyl group, an isoamyl group, a tert-amyl group, a 1,1-dimethylbutyl group, a 1,1-dimethylhexyl group, a 1,1-diethylhexyl group, a dodecyl group, a hexadecyl group, an octadecyl group, a cyclohexyl group, a 2-methoxyisopropyl group, a 2-phenoxyisopropyl group, a 2-p-tert-butylphenoxy-isopropyl group, an α-aminoisopropyl group, an α-(diethylamino)isopropyl group, an α-(succinimido)isopropyl group, an α-(phthalimido)isopropyl group, an α-(benzenesulfonamido)isopropyl group, etc.

In the case that $R_1$, $R_2$ or $R_3$ represents an aromatic group (especially a phenyl group), it may have a substituent. The aromatic group such as a phenyl group, etc. may be substituted with an alkyl group, an alkenyl group, an alkoxy group, an alkoxycarbonyl group, an alkoxycarbonylamino group, an aliphatic amido group, an alkylsulfamoyl group, an alkylsulfonamido group, an alkylureido, alkyl-substituted succinimido group, etc. each containing up to 32 carbon atoms. The alkyl group therein may include an alkyl group which contains an aromatic group such as phenylene in its chain Further, a phenyl group represented by $R_1$, $R_2$ or $R_3$ may be substituted with an aryloxy group, an aryloxycarbonyl group, an arylcarbamoyl group, an arylamido group, an arylsulfamoyl group, an arylsulfonamido group, an arylureido group, etc., the aryl moiety of which groups each may be substituted with one or more alkyl groups wherein the number of carbon atoms is from 1 to 22 in total.

Furthermore, a phenyl group represented by $R_1$, $R_2$ or $R_3$ may be substituted with an amino group which may include an amino group substituted with a lower alkyl group having from 1 to 6 carbon atoms (e.g., a methyl group and an ethyl group), a hydroxy group, a carboxy group, a sulfo group, a nitro group, a cyano group, a thiocyano group or a halogen atom (e.g., a chlorine atom and a bromine atom).

In addition, $R_1$, $R_2$ or $R_3$ may represent a substituent formed by condensing a phenyl group and another ring, to form, e g., a naphthyl group, a guinolyl group, an isoquinolyl group, a chromanyl group, a coumaranyl group, a tetrahydronaphthyl group, etc. These substituents may further have substituents in themselves.

In the case that $R_1$ represents an alkoxy group, the alkyl moiety thereof represents a straight chain or branched chain alkyl group having from 1 to 40 carbon atoms, preferably from 1 to 22 carbon atoms, an alkenyl group, a cyclic alkyl group or a cyclic alkenyl group, each of which may be substituted with a halogen atom, an aryl group, an alkoxy group, etc.

In the case that $R_1$, $R_2$ or $R_3$ represents a heterocyclic group, the heterocyclic group is bonded to the carbon atom of the carbonyl group of the acyl moiety or the nitrogen atom of the amido moiety of an α-acylacetamido group through one of the carbon atoms forming the ring. Examples of such heterocyclic rings include thiophene, furan, pyran, pyrrole, pyrazole, pyridine, pyrazine, pyrimidine, pyridazine, indolizine, imidazole, thiazole, oxazole, triazine, thiadiazine, oxazine, etc. These rings may further have substituents on the individual rings.

In the above-described general formula (XI), $R_5$ represents a straight chain or branched chain alkyl group having from 1 to 40, preferably from 1 to 22 carbon atoms (e.g., methyl, isopropyl, tert-butyl, hexyl, dodecyl), an alkenyl group having from 2 to 40, preferably from 2 to 22 carbon atoms (e.g., allyl), a cyclic alkyl group having from 5 to 40, preferably from 5 to 22 carbon atoms (e.g., cyclopentyl, cyclohexyl, norbornyl), an aralkyl group having from 7 to 40, preferably from 7 to 22 carbon atoms (e.g., benzyl, β-phenylethyl), a cyclic alkenyl group having from 5 to 40, preferably from 5 to 20 carbon atoms (e.g., cyclopentenyl, cyclohexenyl), etc., which groups each may be substituted with a halogen atom, a nitro group, a cyano group, an aryl group, an alkoxy group, an aryloxy group, a carboxy group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a heterocyclic group such as a 5- or 6-membered heterocyclic group containing an oxygen atom, a nitrogen atom or a sulfur atom as a hetero atom, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group, a mercapto group, etc.

$R_5$ may further represent an aryl group having from 6 to 40 carbon atoms (e.g., phenyl, α- or β-naphthyl). The aryl group may have one or more substituents. Specific examples of the substituents include an alkyl group, an alkenyl group, a cyclic alkyl group, an aralkyl group, a cyclic alkenyl group, a halogen atom, a nitro group, a cyano group, an aryl group, an alkoxy group, an aryloxy group, a carboxy group, an alkoxycarbonyl group, an aryloxycarbonyl group, a sulfo group, a sulfamoyl group, a carbamoyl group, an acylamino group, a diacylamino group, a ureido group, a urethane group, a sulfonamido group, a heterocyclic group such as a 5- or 6-membered heterocyclic group containing an oxygen atom, a nitrogen atom or a sulfur atom as a hetero atom, an arylsulfonyl group, an alkylsulfonyl group, an arylthio group, an alkylthio group, an alkylamino group, a dialkylamino group, an anilino group, an N-alkylanilino group, an N-arylanilino group, an N-acylanilino group, a hydroxy group, a mercapto group, etc. A more preferable group for $R_5$ is a phenyl group which is substituted with an alkyl group, an alkoxy group, a halogen atom, etc., at least one of the o-positions, because it is effective to restrain discoloration of couplers remaining in film layers due to light or heat.

Furthermore, $R_5$ may represent a heterocyclic group (e.g., a 5-membered or 6-membered heterocyclic ring containing as a hetero atom a nitrogen atom, an oxygen atom or a sulfur atom, or a condensed ring thereof, each specific examples including a pyridyl group, a quinolyl group, a furyl group, a benzothiazolyl group, an oxazolyl group, an imidazolyl group, a naphthoxazolyl group, etc.), a heterocyclic group substituted with one or more substituents as defined for the above-described aryl group, an aliphatic acyl group, an aromatic acyl group, an alkylsulfonyl group, an arylsulfonyl group, an alkylcarbamoyl group, an arylcarbamoyl group, an alkylthiocarbamoyl group or an arylthiocarbamoyl group.

In the above-described formulae, $R_4$ represents a hydrogen atom, or a straight chain or branched chain alkyl, alkenyl, cyclic alkyl, aralkyl or a cyclic alkenyl group having up to 40, preferably up to 22 carbon atoms, (each of which may have one or more substituents as defined for the above-described substituent $R_5$), an aryl group or a heterocyclic group such as a 5- or 6-membered heterocyclic group containing an oxygen atom, a nitrogen atom or a sulfur atom as a hetero atom (which each also may have one or more substituents as defined for the above-described substituent $R_5$), an alkoxycarbonyl group (e.g., methoxycarbonyl, ethoxycarbonyl, stearyloxycarbonyl), an aryloxycarbonyl group (e.g., phenoxycarbonyl, naphthoxycarbonyl), an aralkyloxycarbonyl group (e.g., benzyloxycarbonyl), an alkoxy group (e.g., methoxy, ethoxy heptadecyloxy), an aryloxy group (e.g., phenoxy, tolyloxy), an alkylthio group (e.g., ethylthio, dodecylthio), an arylthio group (e.g., phenylthio, α-naphtylthio), a carboxy group, an acylamino group (e.g., acetylamino, 3-[(2,4-di-tert-amylphenoxy)acetamido]benzamido), a diacylamino group, an N-alkylacylamino group (e.g., N-methylpropionamido), an N-arylacylamino group (e.g., N-phenylacetamido), a ureido group (e.g., ureido, N-arylureido, N-alkylureido), a urethane group, a thiourethane group, an arylamino group (e.g., phenylamino, H-methylanilino, diphenylamino, N-acetylanilino, 2-chloro-5-tetradecanamidoanilino), an alkylamino group (e.g., n-butylamino, methylamino, cyclohexylamino), a cycloamino group (e.g., piperidino, pyrrolidino), a heterocyclic amino group (e.g., 4-pyridylamino, 2-benzoxazolylamino), an alkylcarbonyl group (e.g., methylcarbonyl), an arylcarbonyl group (e.g., phenylcarbonyl), a sulfonamido group (e.g., alkylsulfonamido, or arylsulfonamido), a carbamoyl group (e.g., ethylcarbamoyl, dimethylcarbamoyl, N-methylphenylcarbamoyl, N-phenylcarbamoyl), a sulfamoyl group (e.g., N-alkylsulfamoyl, N,N-dialkylsulfamoyl, N-arylsulfamoyl, N-alkyl-N-arylsulfamoyl, N,N-diarylsulfamoyl), a cyano group, a hydroxy group, a mercapto group, a halogen atom or a sulfo group.

In the above-described general formula, $R_7$ represents a hydrogen atom, or a straight chain or branched chain alkyl, alkenyl, cyclic alkyl, aralkyl or cyclic alkenyl group having up to 32 carbon atoms, preferably up to 22 carbon atoms, each of which may have one or more substituents as defined for the above-described substituent $R_5$.

Further, $R_7$ may represent an aryl group or a heterocyclic group such as a 5- or 6-membered heterocyclic group containing an oxygen atom, a nitrogen atom or a sulfur atom as a hetero atom, which each may have one or more substituents as defined for the above-described substituent $R_5$.

Furthermore, $R_7$ may represent a cyano group, an alkoxy group, an aryloxy group, a halogen atom, a carboxy group, an alkoxycarbonyl group, an aryloxy carbonyl group, an acyloxy group, a sulfo group, a sulfamoyl group, a carbamoyl group, an acylamino group, a diacylamino group, a ureido group, a urethane group, a sulfonamido group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group or a mercapto group.

In the above-described general formulae, $R_8$, $R_9$, $R_{10}$ each represents a group of a type which has been employed in conventional 4-equivalent type phenol or α-naphthol couplers. Specifically, $R_8$ represents a hydrogen atom, a halogen atom, an aliphatic hydrocarbon u group, an acylamino group, an —O—$R_{11}$ group or an —S—$R_{11}$ group (wherein $R_{11}$ is an aliphatic hydrocarbon group). When two or more of the $R_8$ groups are present in one molecule, they may be different from each other. The above-described aliphatic hydrocarbon groups include those having substituents.

$R_9$ and $R_{10}$ each represents an aliphatic hydrocarbon groups having from 1 to 22 carbon atoms, an aryl group having from 6 to 22 carbon atoms or a heterocyclic group such as a 5- or 6-membered heterocyclic group containing an oxygen atom, a nitrogen atom or a sulfur atom as a hetero atom. Either of them may be a hydrogen atom. The above-described groups for $R_9$ and $R_{10}$ may further have certain substituents. Furthermore, $R_9$ and $R_{10}$ may combine with each other and form a nitrogen-containing heterocyclic nucleus such as a 5- or 6-membered heterocyclic group containing an oxygen atom, a nitrogen atom or a sulfur atom as a hetero atom. More specifically, the above-described aliphatic hydrocarbon groups include both saturated and unsaturated groups, wherein each may have a straight chain form, a branched chain form or a cyclic form. Preferred examples thereof include an alkyl group (e.g., methyl, ethyl, propyl, isopropyl, butyl tert-butyl, isobutyl, dodecyl, octadecyl, cyclobutyl, cyclohexyl) and an alkenyl group (e.g., allyl, octenyl). The above-described aryl group includes a phenyl group, a naphthyl group, etc. Representatives of the above-described heterocyclic groups include a pyridinyl group, a quinolyl group, a thienyl group, a piperidyl group, an imidazolyl group, etc. These aliphatic hydrocarbon groups, aryl groups and heterocyclic groups each may be substituted with a halogen atom, a nitro group, a hydroxy group, a carboxy group, an amino group, a substituted amino group, a sulfo group, an alkyl group, an alkenyl group, an aryl group, a heterocyclic group such as a 5- or 6-membered heterocyclic group containing an oxygen atom, a nitrogen atom or a sulfur atom as a hetero atom, an alkoxy group, an aryloxy group, an arylthio group, an arylazo group, an acylamino group, a carbamoyl group, an ester group, an acyl group, an acyloxy group, a sulfonamido group, a sulfamoyl group, a sulfonyl group, a morpholino group, etc.

In the above-described general formulae, l represents an integer of 1 to 4, m′ represents an integer or 1 to 3, and n represents an integer of 1 to 5.

Substituents $R_1$, $R_2$, $R_3$, $R_4$, $R_5$, $R_7$, $R_8$, $R_9$ and $R_{10}$ in the couplers represented by the general formulae (IX) to (XIX) may bond with each other or any of them may make a divalent group to form symmetric or asymmetric complex couplers.

Specific examples of the hydrolyzable type DIR couplers which can be used in the present invention are set forth below, but the present invention should not be construed as being limited thereto.

(1)

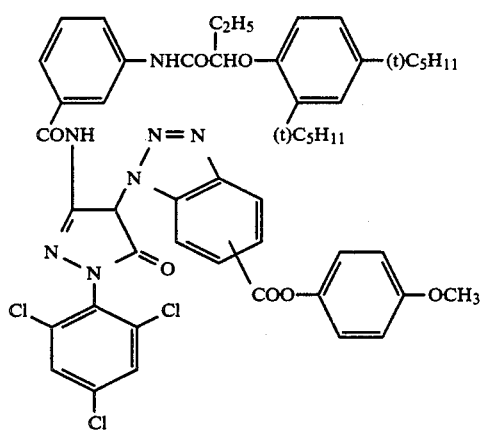

(2)

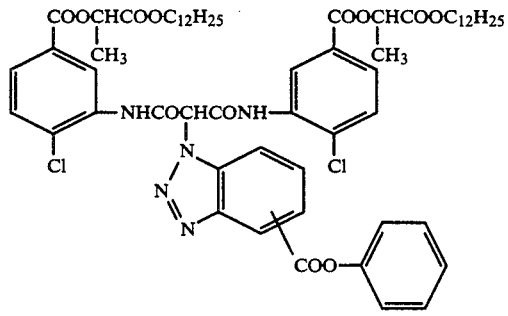

-continued
(3)
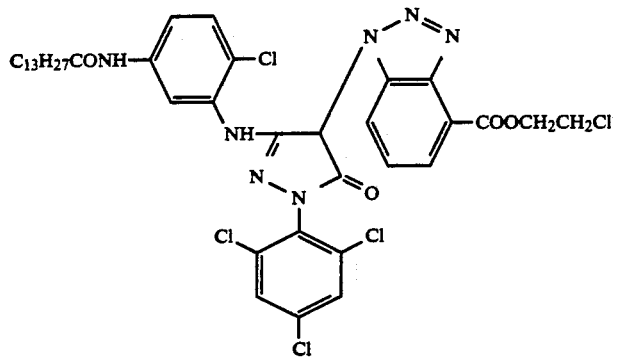
(4)
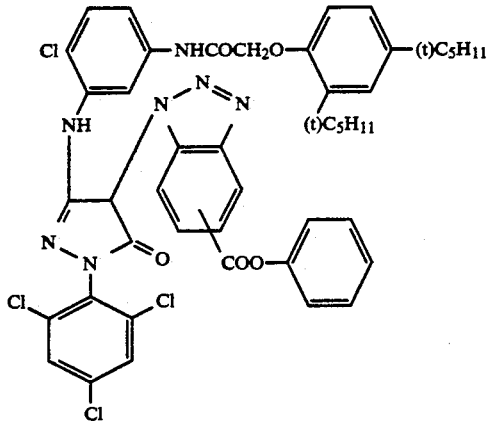
(5)
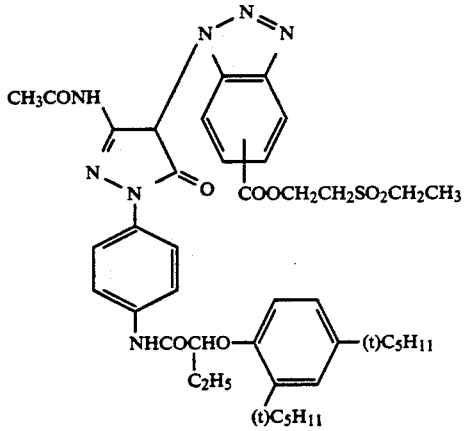
(6)
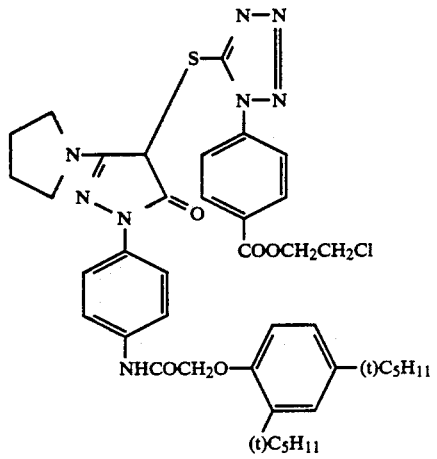

-continued
(7)
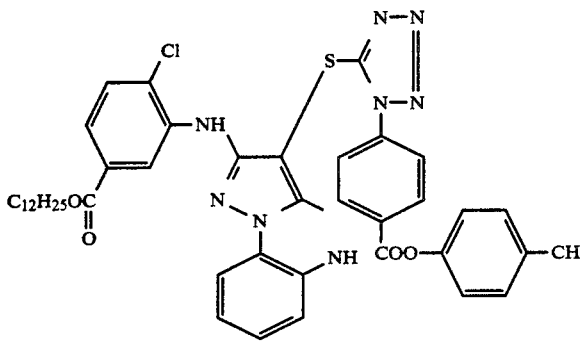
(8)
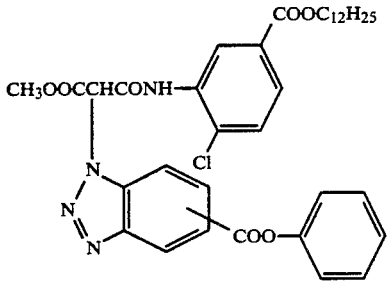
(9)
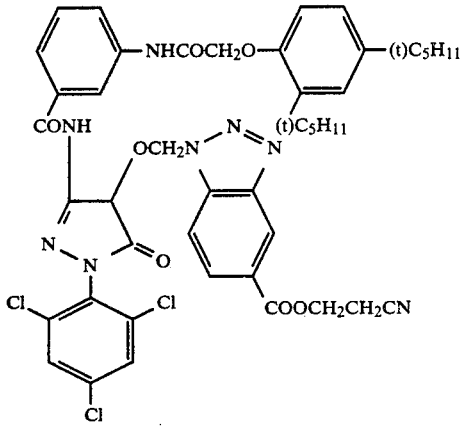
(10)
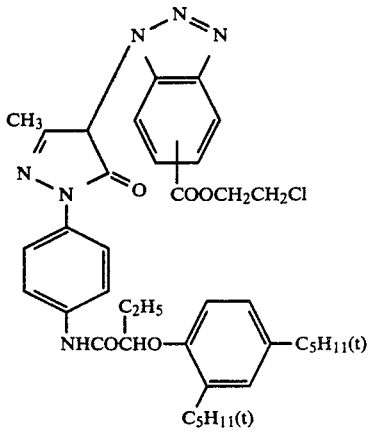

-continued
(11)
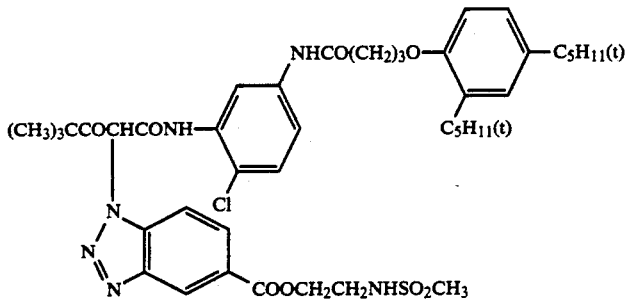
(12)
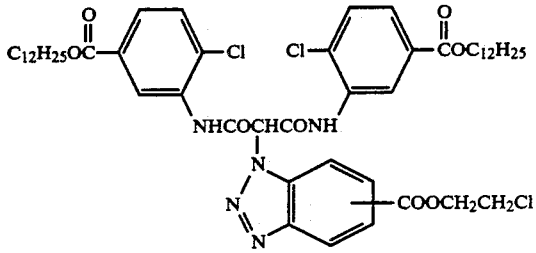
(13)
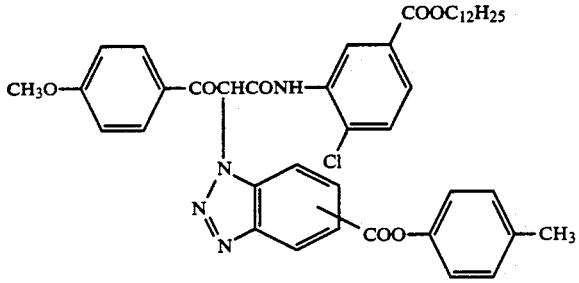
(14)
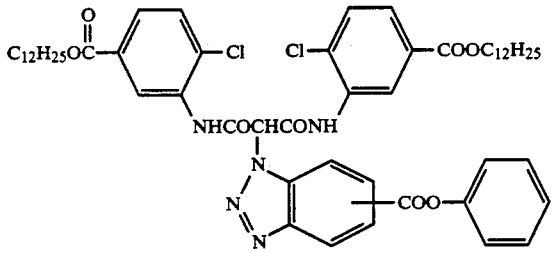
(15)
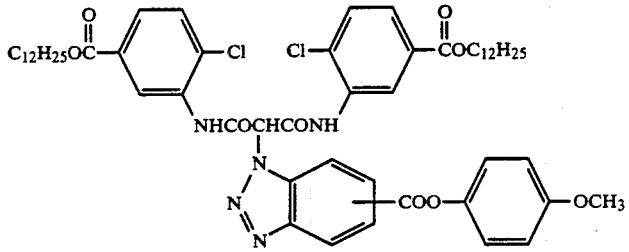
(16)
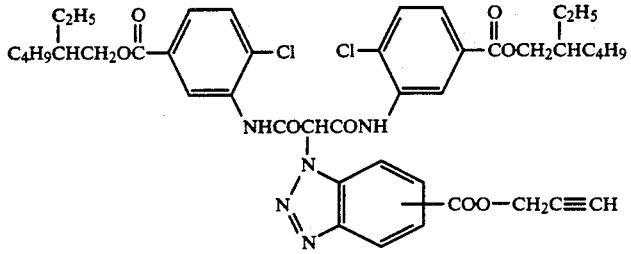

-continued
(17)
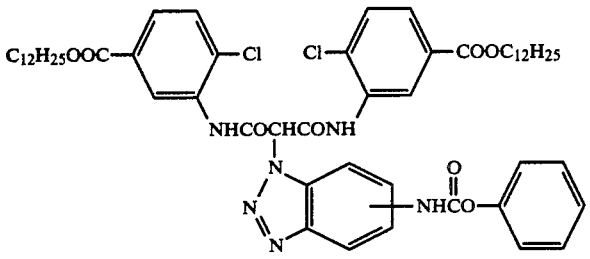
(18)
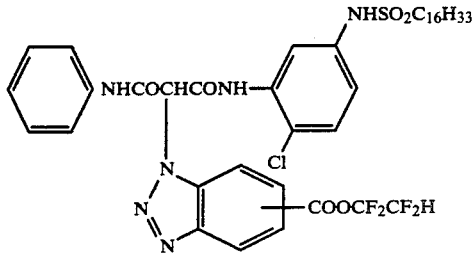
(19)
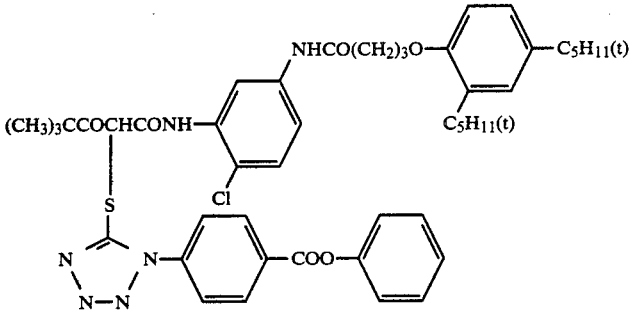
(20)
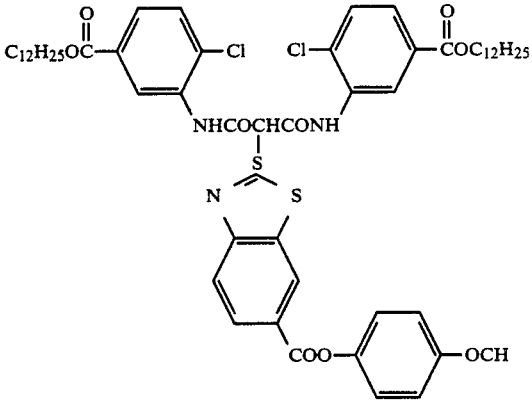
(21)
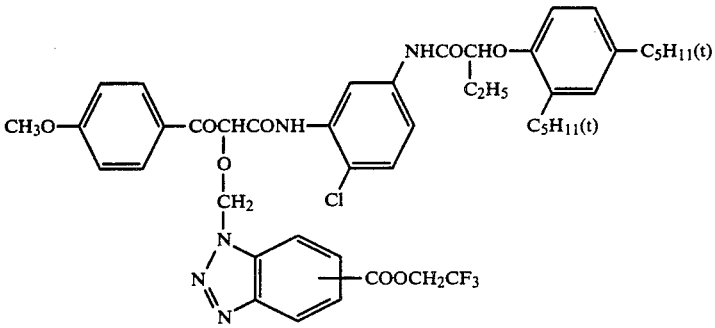

-continued
(22)
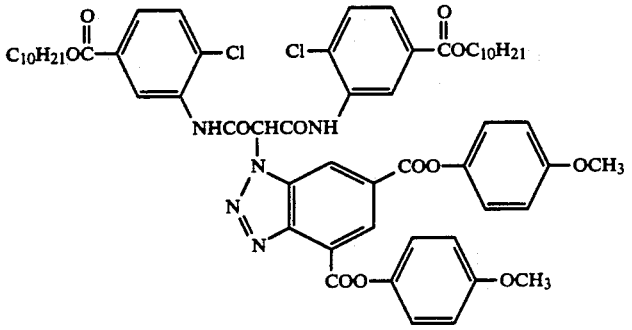
(23)
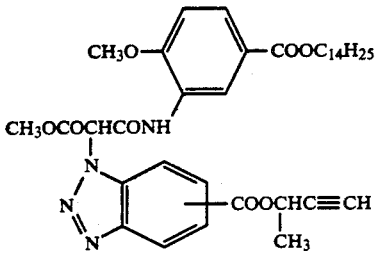
(24)
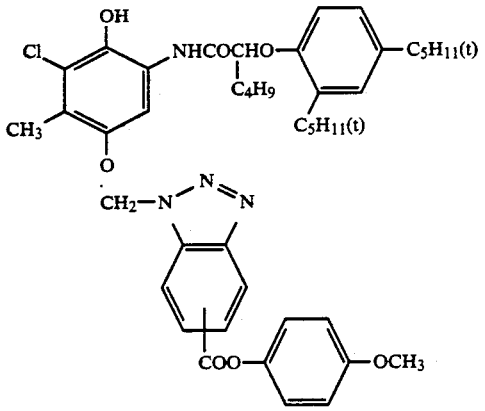
(25)
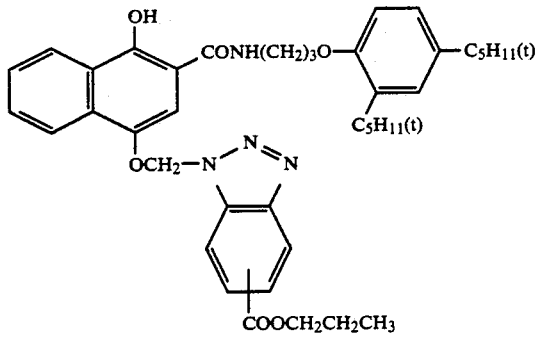
(26)
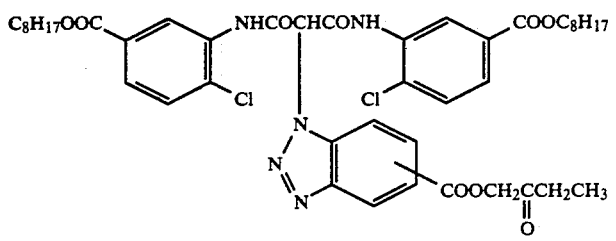

-continued
(27)
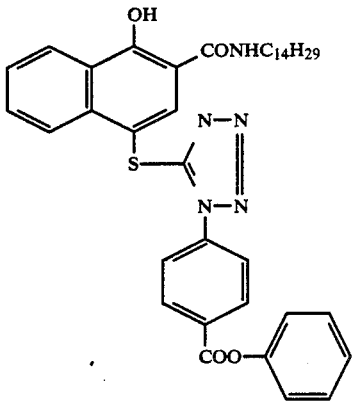
(28)
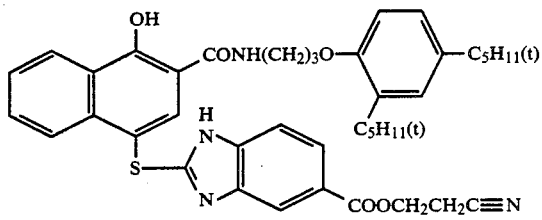
(29)
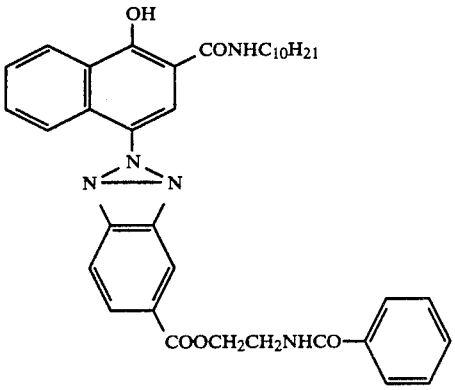
(30)
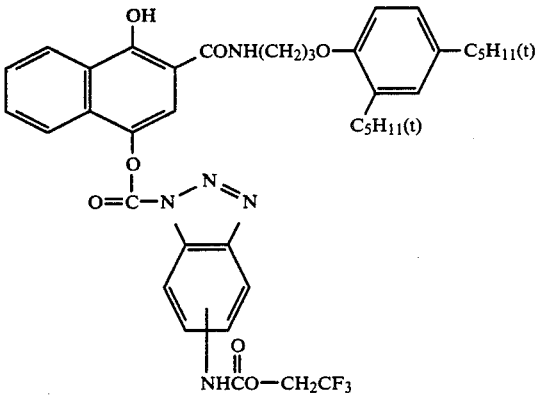

-continued
(31)
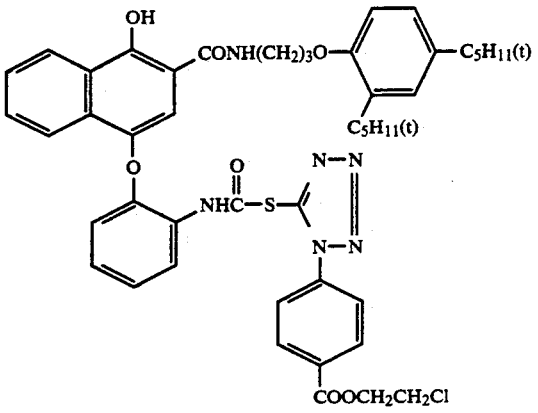
(32)
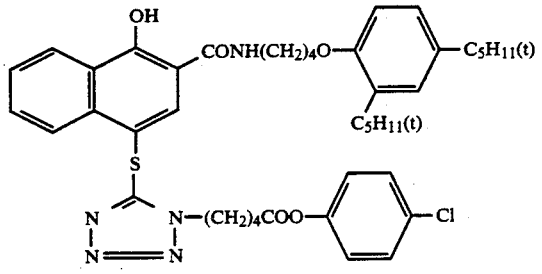
(33)
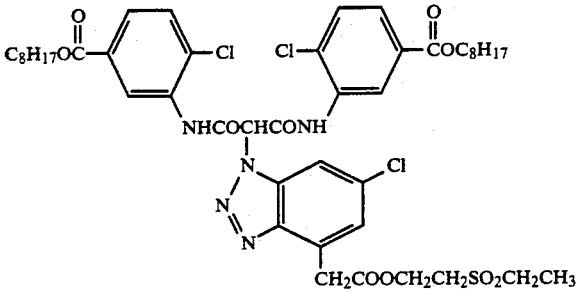
(34)
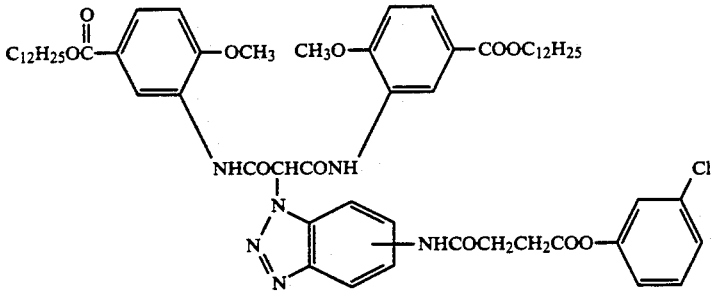
(35)
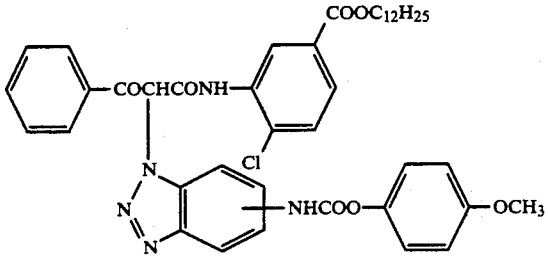

-continued
(36)
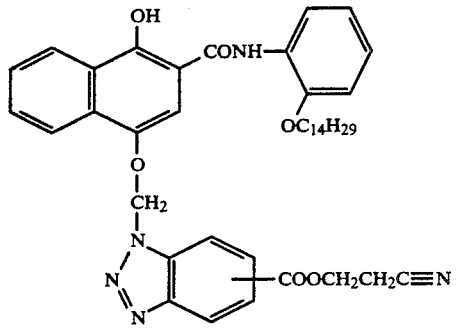
(37)
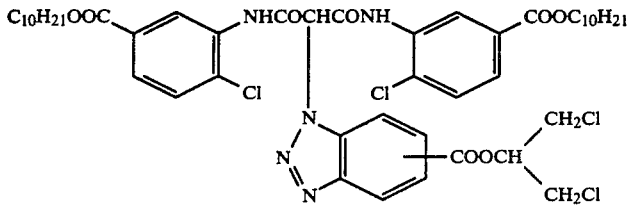
(38)
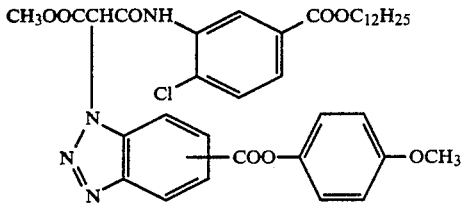
(39)
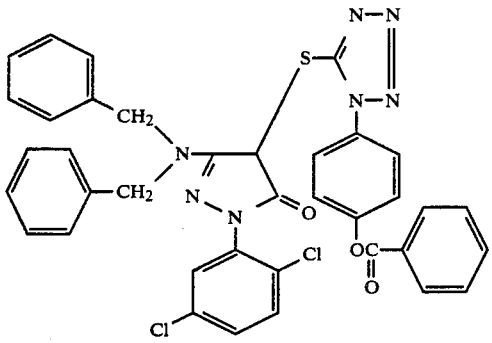
(40)
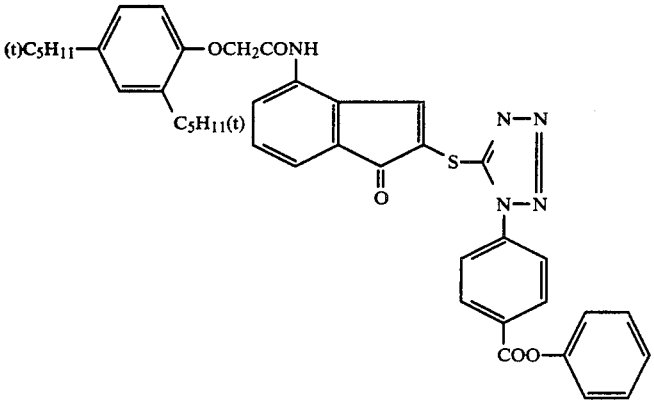

-continued
(41)
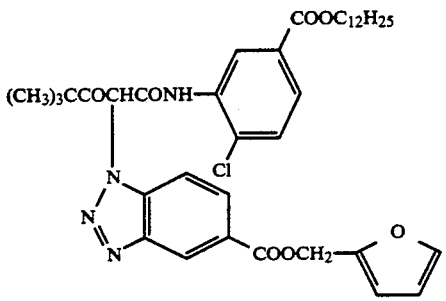
(42)
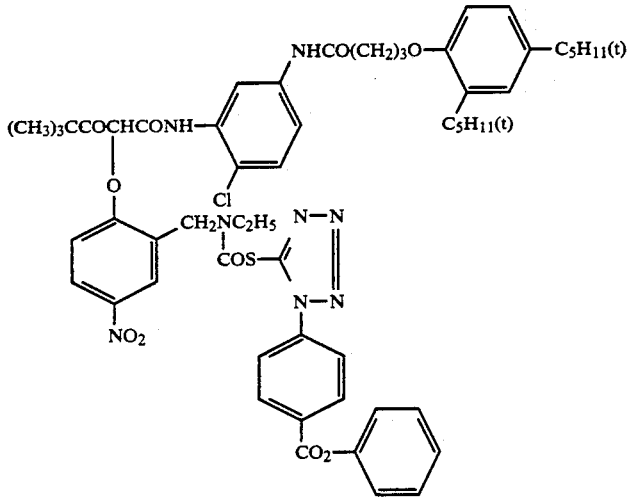
(43)
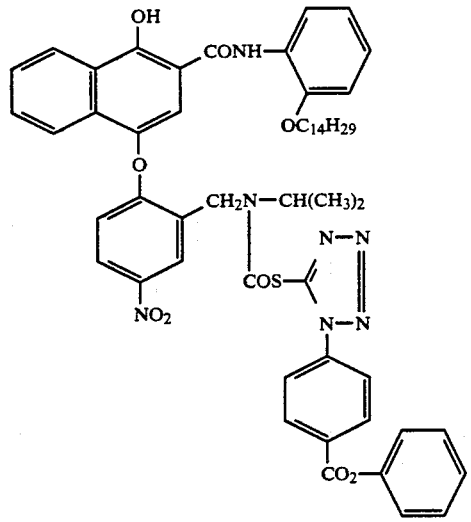

-continued
(44)
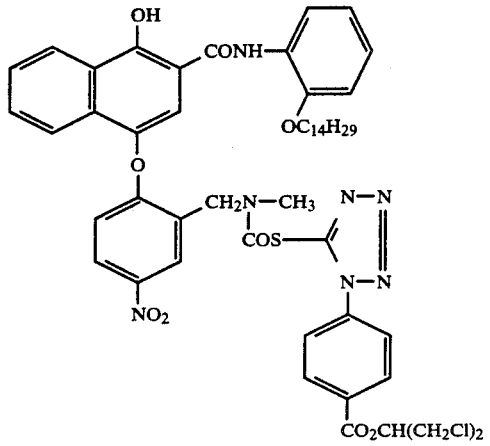
(45)
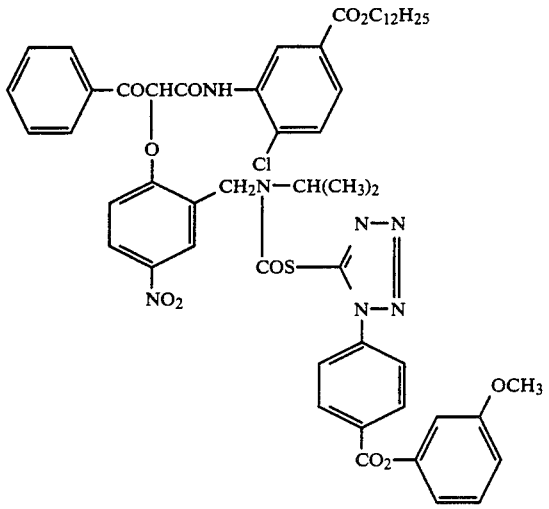
(46)
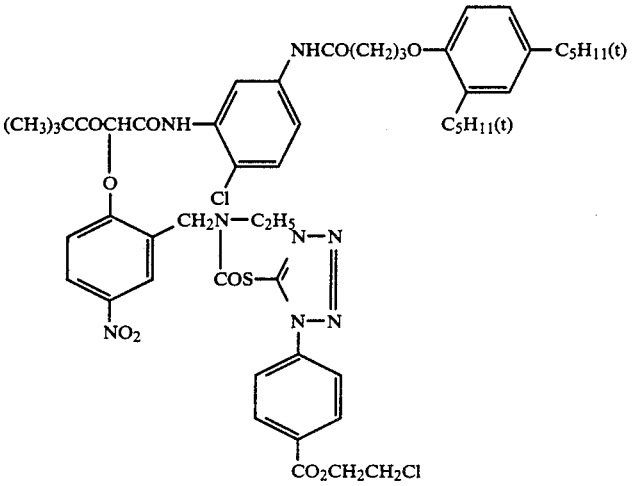

-continued
(47)
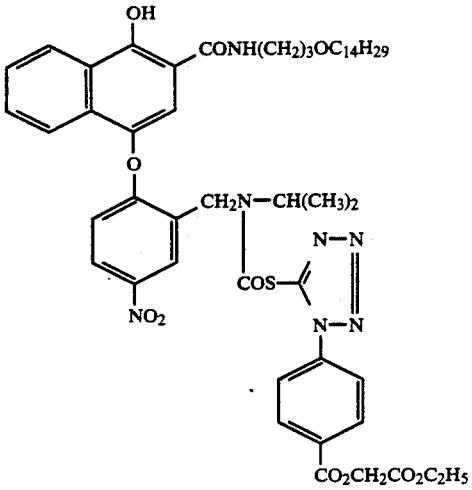
(48)
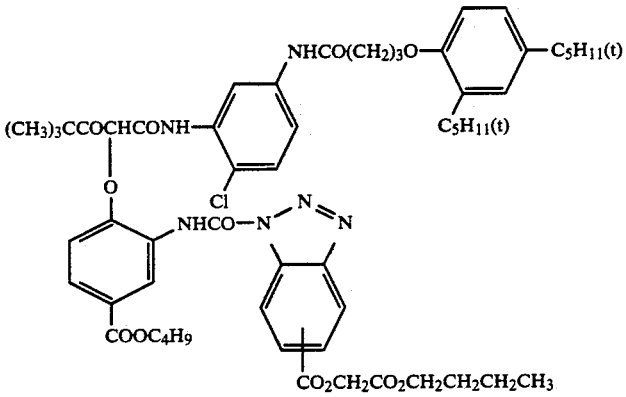
(49)
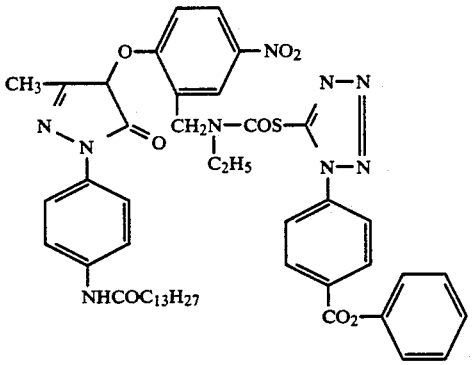
(50)
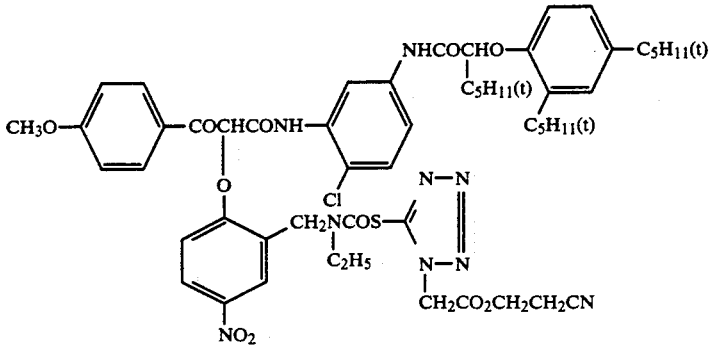

-continued
(51)
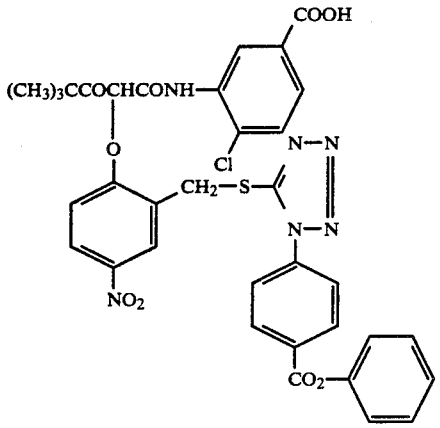
(52)
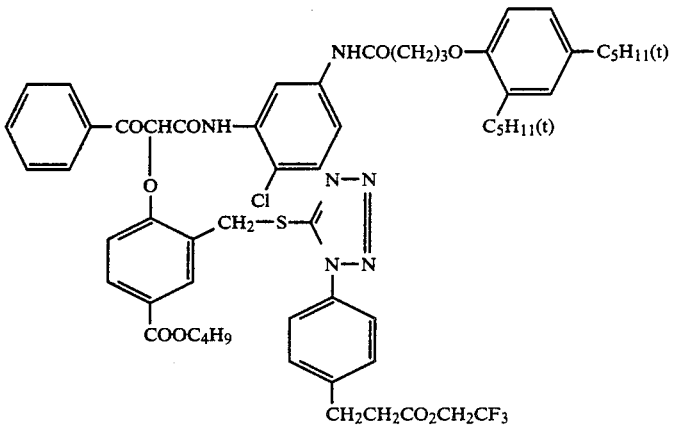
(53)
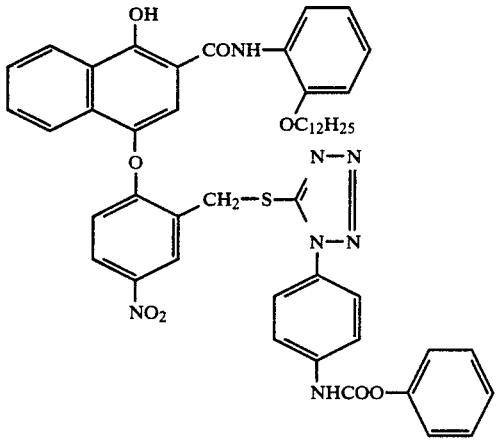

-continued
(54)
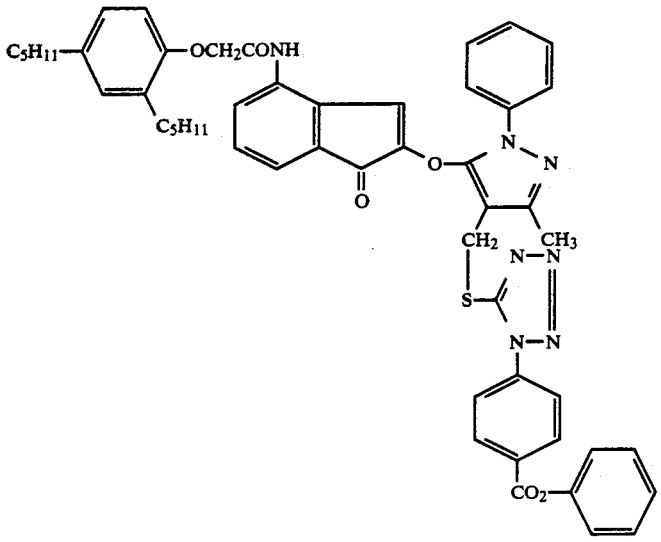
(55)
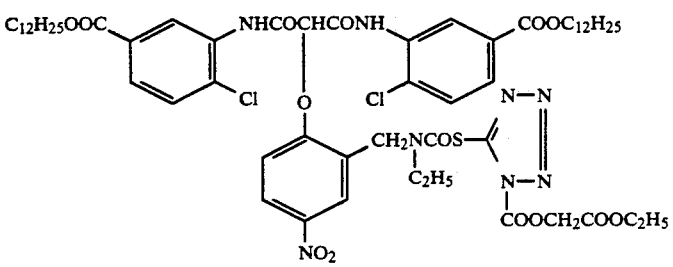
(56)
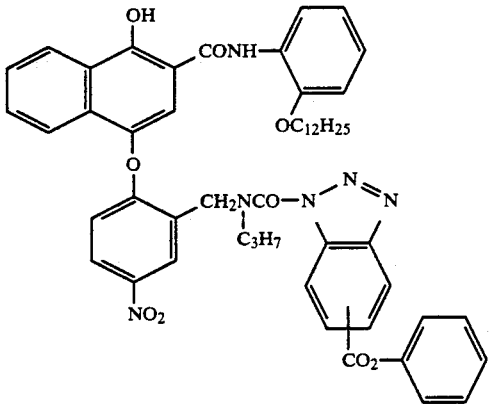
(57)
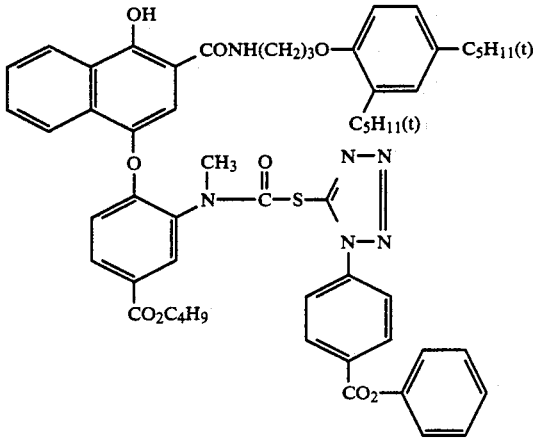

-continued (58)

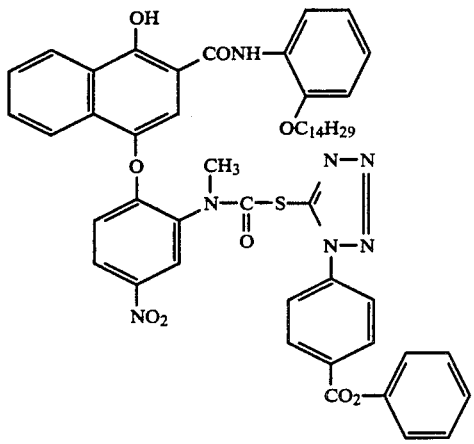

(59)

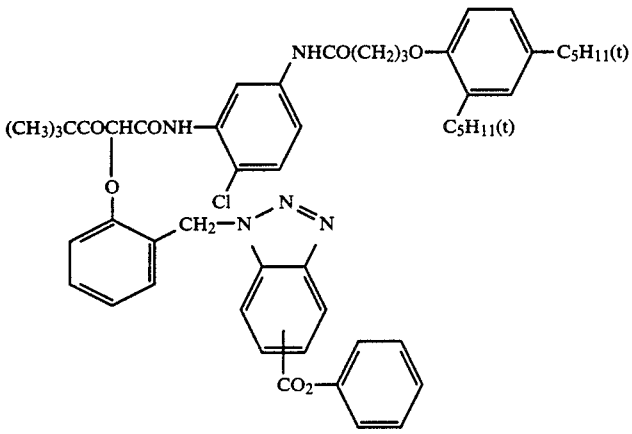

The hydrolyzable type DIR couplers for use in the present invention are easily synthesized according to the methods as described, e.g., in JP-A-57-151944 and JP-A-58-205150.

Specific examples of the couplers described above each has a half-life period of 4 hours or less. The half-life period of these couplers is easily determined by the method as described hereinabove. The half-life periods determined are shown with respect to some couplers in the following table.

| Coupler No. | Half-Life Period (min) |
|---|---|
| (1) | 10 |
| (2) | 4.5 |
| (3) | 120 |
| (4) | 4.5 |
| (6) | 120 |
| (7) | 11 |
| (8) | 4.5 |
| (9) | 3 |
| (15) | 11 |
| (16) | 20 |
| (18) | 4.3 |
| (37) | 30 |
| (43) | 4.5 |

The hydrolyzable type DIR coupler can be added either a light-sensitive emulsion layer or a light-insensitive layer in the light-sensitive material. An amount of the DIR coupler added is preferably in a range from $1\times10^{-4}$ mol% to $1\times10^{-1}$ mol% of the total amount of coated silver in the color light-sensitive material.

When the compound represented by the general formula (I) according to the present invention is added to the light-sensitive material, it can be added to any of an antihalation layer, an intermediate layer (including a layer provided between layers having different spectral sensitivities, a layer provided between layers having the same spectral sensitivity, and a layer provided between a light-sensitive layer and a light-insensitive layer), a light-sensitive silver halide emulsion layer, a light-insensitive silver halide emulsion layer, a yellow filter layer and a protective layer. Furthermore, the compound may be added to two or more layers.

Two or more kinds of these compounds may be incorporated into the light-sensitive material. The total amount of the compound to be added is from $1\times10^{-5}$ to $1\times10^{-2}$ mol/m$^2$, preferably $2\times10^{-5}$ mol/m$^2$ to $5\times10^{-3}$ mol/m$^2$, and more preferably from $5\times10^{-5}$ to $2\times10^{-3}$ mol/m$^2$.

The processing bath having a bleaching ability according to the present invention is described in detail below.

In accordance with the present invention, after color development, the light-sensitive material is next processed with the processing bath having a bleaching ability.

The processing bath having a bleaching ability generally includes a bleaching solution and a bleach-fixing solution. In the present invention, a bleaching solution is preferred since it has a stronger bleaching power.

Specific examples of the desilvering step according to the present invention are set forth below, but the present invention should not be construed as being limited thereto.

(1) Bleaching→Fixing
(2) Bleaching→Bleach-fixing
(3) Bleach-fixing
(4) Bleach-fixing→Bleach-fixing
(5) Bleaching→Washing with water→Fixing Of the above-described steps, Steps (1) and (2) are particularly preferred in view of achieving the effect of the present invention.

The bleaching agents according to the present invention contains at least one ferric complex salt of 1,3-diaminopropanetetraacetic acid, which may preferably be used in combination with at least one ferric complex salt of a compound selected from the group consisting of Compounds (A) described below in a molar ratio of the latter to the former being not more than 3. The preferred molar ratio is from 2.0 to 0.2. When the molar ratio exceeds 3, the bleaching power decreases, resulting in inferior desilveration. On the other hand, when the ratio of ferric complex salt of 1,3-diaminopropanetetraacetic acid is too high, the slight occurrence of bleach fog may be observed in some cases.

Compounds (A)

A-1: Ethylenediaminetetraacetic acid
A-2: Dithylenetriaminepentaacetic acid
A-3: Cyclohexanediaminetetraacetic acid
A 4: 1,2-Propylenediaminetetraacetic acid The total amount of the bleaching agents to be added is from 0.05 mol to 1 mol, preferably from 0.1 mol to 0.5 mol, per liter of the bath having a bleaching ability.

To the processing solution having a bleaching ability according to the present invention, an aminopolycarboxylic acid (salt) can be added, in addition to the above-described ferric complex salts of aminopolycarboxylic acids. It is particularly preferred to add the compound selected from the group of Compounds (A) in an amount preferably from 0.0001 mol to 0.1 mol, more preferably from 0.003 mol to 0.05 mol, per liter of the solution having a bleaching ability.

It is ordinarily preferred that the aminopolycarboxylic acid and ferric complex salt thereof is employed in the form of an alkali metal salt or an ammonium salt. Particularly, an ammonium salt thereof is preferred in view of its excellent solubility and bleaching power.

The bleaching solution or bleach-fixing solution containing the above described ferric ion complex according to the present invention may further contain metal ion complex salts other than iron ion complex salt, such as cobalt ion complex salt and copper ion complex salt.

The processing bath having a bleaching ability according to the present invention may contain various bleach accelerating agents. Suitable examples of such bleach accelerating agents include, compounds having a mercapto group or a disulfide bond as described, e.g., in U.S. Pat. No. 3,893,858, German Patent 1,290,812, British Patent 1,138,842, JP-A-53-95630 and *Research Disclosure,* No. 17129 (July, 1978), thiazolidine derivatives as described in JP-A-50-140129, thiourea derivatives as described in U.S. Pat. No. 3,706,561, iodides as described in JP-A-58-16235, polyethylene oxides as described in German Patent 2,748,430, and polyamine compounds as described in JP-B-45-8836 (the term "JP-B" as used herein means an "examined Japanese patent publication"). The mercapto compounds as described in British Patent 1,138,842 are particularly preferred.

In particular, the bleach accelerating agents represented by the general formula (IA), (IIA), (IIIA), (IVA), (VA), or (VIA) described below are preferably employed in the present invention since they are excellent in bleaching ability and cause less bleach fog.

$$R^{1A}—S—M^{1A} \qquad \text{(IA)}$$

wherein $M^{1A}$ represents a hydrogen atom, an alkali metal atom or ammonium: and $R^{1A}$ represents an alkyl group, an alkylene group, an aryl group or a heterocyclic group.

The alkyl group represented by $R^{1A}$ is preferably an alkyl group having from 1 to 5 carbon atoms, particularly from 1 to 3 carbon atoms. The alkylene group represented by $R^{1A}$ is preferably an alkylene group having from 2 to 5 carbon atoms. The aryl group represented by $R^{1A}$ includes a phenyl group or a naphthyl group, and a phenyl group is particularly preferred. The heterocyclic group represented by $R^{1A}$ include preferably a 6-membered nitrogen-containing ring, e.g., pyridine, triazine, etc. and a 5-membered nitrogen containing ring, e.g., azole, pyrazole, triazole, thiadiazole, etc. Among them, rings wherein at least two atoms in the ring forming atomic group are nitrogen atoms are particularly preferred.

In the general formula (IA), $R^{1A}$ may be substituted with one or more substituents. Suitable examples of the substituents include an alkyl group, an alkylene group, an alkoxy group, an aryl group, a carboxy group, a sulfo group, an amino group, an alkylamino group, a dialkylamino group, a hydroxy group, a carbamoyl group, a sulfamoyl group, and a sulfonamido group, etc.

Of the compounds represented by the general formula (IA), those represented by the following general formula (IA-1), (IA-2), (IA-3) or (IA-4) are preferred.

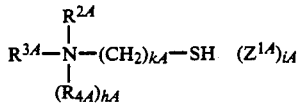

(IA-1)

wherein $R^{2A}$, $R^{3A}$ and $R^{4A}$, which may be the same or different, each represents a hydrogen atom, a substituted or unsubstituted lower alkyl group (preferably having from 1 to 5 carbon atoms, particularly, methyl, ethyl or propyl) or an acyl group (preferably having from 1 to 3 carbon atoms such as acetyl, propionyl), or $R^{2A}$, and $R^{3A}$ may be bonded to each other to form a ring; kA represents an inleger from 1 to 3; $Z^{1A}$ represents an anion (e.g., chlorine ion, bromine ion, nitric acid ion, sulfuric acid ion, p-toluene sulfonate, or oxalate); hA represents the integer 0 or 1; and iA represents the integer 0 or 1.

The substituted or unsubstituted lower alkyl group is preferred for $R^{2A}$, $R^{3A}$ or $R^{4A}$. Examples of substituents for the substituted group represented by $R^{2A}$, $R^{3A}$ or $R^{4A}$ include a hydroxy group, a carboxy group, a sulfo group, and an amino group, etc.

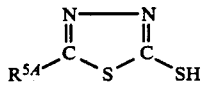

(IA-2)

-continued

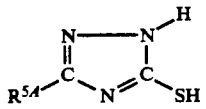

(IA-3)

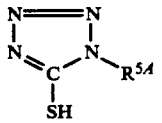

(IA-4)

wherein $R^{5A}$ represents a hydrogen atom, a halogen atom (e.g., chlorine, bromine), an amino group, a substituted or unsubstituted lower alkyl group (preferably having from 1 to 5 carbon atoms, and particularly, methyl, ethyl, propyl), an amino group substituted with an alkyl group (e.g., methylamino, ethylamino, dimethylamino, or diethylamino) or a substituted or unsubstituted alkylthio group.

Examples of substituents for the substituted group represented by $R^{5A}$ include a hydroxy group, a carboxy group, a sulfo group, an amino group, and an alkyl-substited amino group, etc.

$$R^{1A}—S—S—R^{6A} \quad \text{(IIA)}$$

Wherein $R^{1a}$ is same as $R^{1A}$ defined in the general formula (IA); $R^{6A}$ has the same meaning as $R^{1A}$ defined in the general formula (IA); and $R^{1A}$ and $R^{6A}$ may be the same or different.

Of the compounds represented by the general formula (IIA), those represented by the following general formula (IIA 1) are preferred.

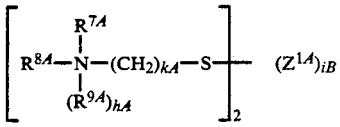

(IIA-1)

wherein $R^{7A}$, $R^{8A}$ and $R^{9A}$ each has the same meaning as $R^{2A}$, $R^{3A}$ and $R^{4A}$ defined in the general formula (IA-1); hA, kA and $Z^{1A}$ are same as hA, kA and $Z^{1A}$ defined in the general formula (IA-1) respectively; and iB represents the integer 0, 1 or 2.

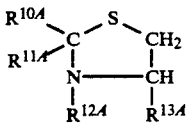

(IIIA)

wherein $R^{10A}$ and $R^{11A}$, which may be the same or different, each represents a hydrogen atom, a substituted or unsubstituted alkyl group (preferably a lower alkyl group, e.g., methyl, ethyl, propyl), a substituted or unsubstituted phenyl group or a substituted or unsubstituted heterocyclic group (more specifically, a heterocyclic group having one or more hetero atoms such as a nitrogen atom, an oxygen atom or a sulfur atom, etc., e.g., a pyridine ring, a thiophene ring, a thiazolidine ring, a benzoxazole ring, a benzotriazole ring, a thiazole ring, an imidazole ring, etc.); $R^{12A}$ represents a hydrogen atom or a substituted or unsubstituted lower alkyl group (preferably having from 1 to 3 carbon atoms, e.g., methyl, ethyl); and $R^{13A}$ represents a hydrogen atom, an alkyl group, or a carboxy group.

Examples of substituents for the substituted group represented by $R^{10A}$, $R^{11A}$ or $R^{12A}$ include a hydroxy group, a carboxy group, a sulfo group, an amino group or a lower alkyl group, etc.

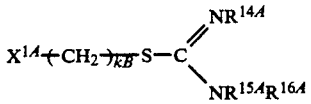

(IVA)

wherein and $R^{14A}$, $R^{15A}$ and $R^{16A}$, which may be the same or different, each represents a hydrogen atom or a lower alkyl group (preferably having from 1 to 3 carbon atoms, e.g., methyl, ethyl), or $R^{14A}$ and $R^{15A}$ or $R^{16A}$ may be bonded to each other to form a ring; $X^{1A}$ represents a substituted or unsubstituted amino group, a sulfo group, a hydroxy group, a carboxy group or a hydrogen atom; and kB represents an integer from 1 to 5.

Examples of substituents for the substituted amino group include a substituted or unsubstituted alkyl group (e.g., a methyl group, an ethyl group, a hydroxyalkyl group, an alkoxyalkyl group, or a carboxyalkyl group, etc.) wherein two alkyl groups, if present, may be bonded to each other to form a ring.

A hydrogen atom, a methyl group or an ethyl group is particularly preferred for $R^{14A}$, $R^{15A}$ or $R^{16A}$, and an amino group or a dialkylamino group is preferred for $X^{1A}$.

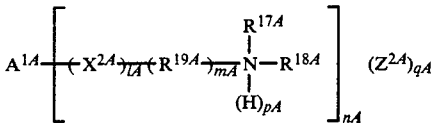

(VA)

wherein $A^{1A}$ represents an n-valent aliphatic linking group, an n-valent aromatic linking group or an n-valent heterocyclic linking group (when n is 1, $A^{1A}$ represents an aliphatic group, an aromatic group or a heterocyclic group).

Suitable examples of the aliphatic linking group represented by $A^{1A}$ include an alkylene group having from 3 to 12 carbon atoms (e.g., trimethylene, hexamethylene, cyclohexylene).

Suitable examples of the aromatic linking group represented by $A^{1A}$ include an arylene group having from 6 to 18 carbon atoms (e.g., phenylene, naphthalene).

Suitable examples of the heterocyclic linking group represented by $A^{1A}$ include a heterocyclic group having one or more hetero atoms such as an oxygen atom, a sulfur atom, a nitrogen atom (e.g., thiophene, furan, triazine, pyridine, piperidine).

While the aliphatic linking group, aromatic linking group or heterocyclic linking group is usually only one, two or more thereof may be connected directly or through a divalent connecting group (e.g., —O—, —S—,

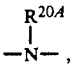

$—SO_2—$, —CO— or a combination thereof, wherein $R^{20A}$ represents a lower alkyl group).

Further, the aliphatic linking group, aromatic linking group or heterocyclic linking group may have a substituent. Suitable examples of the substituents include an alkoxy group, a halogen atom, an alkyl group, a hydroxy group, a carboxy group, a sulfo group, a sulfonamido group, and a sulfamoyl group, etc.

$X^{2A}$ represents —O—, —S—, or

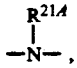

wherein $R^{21A}$ represents a lower alkyl group (e.g., methyl, ethyl).

$R^{17A}$ and $R^{18A}$, which may be the same or different, each represents a substituted or unsubstituted lower alkyl group (e.g., methyl, ethyl, propyl, isopropyl, pentyl). Preferred examples of the substituents include a hydroxy group, a lower alkoxy group (e.g., methoxy, methoxyethoxy, or hydroxyethoxy), and an amino group (e.g., unsubstituted amino, dimethylamino N-hydroxyethyl-N-methylamino). When two or more substituents are present, they may be the same or different.

$R^{19A}$ represents a lower alkylene group having from 1 to 5 carbon atoms (e.g., methylene, ethylene, trimethylene, methylmethylene).

$Z^{2A}$ represents an anion (e.g., a halide ion, such as chlorine ion or bromine ion, nitric acid ion, sulfuric acid ion, p-toluenesulfonate, oxalate).

Further, $R^{17A}$ and $R^{18A}$ may be connected with each other through a carbon atom or a hetero atom (e.g., an oxygen atom, a nitrogen atom, a sulfur atom) to form a 5-membered or 6-membered heterocyclic ring (e.g., pyrrolidine, piperidine, morpholine, triazine, imidazolidine).

Moreover, $R^{17A}$ or $R^{18A}$ and A may be connected with each other through a carbon atom or a hetero atom (e.g., an oxygen atom, a nitrogen atom, a sulfur atom) to form a 5-membered or 6-membered heterocyclic ring (e.g., hydroxyquinoline, hydroxyindole, isoindoline).

Furthermore, $R^{17A}$ or $R^{18A}$ and $R^{19A}$ may be connected with each other through a carbon atom or a hetero atom (e.g., an oxygen atom, a nitrogen atom, a sulfur atom) to form a 5-membered or 6-membered heterocyclic ring (e.g., piperidine, pyrrolidine, morpholine).

$l_A$ represents the integer 0 or 1, $m_A$ represents the integer 0 or 1, $n_A$ represents the integer 1, 2 or 3, $p_A$ represents the integer 0 or 1 and $q_A$ represents the integer 0, 1, 2 or 3.

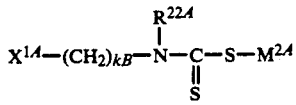

(VIA)

wherein $X^{1A}$ and kB are same as $X^{1A}$ and kB defined in the general formula (IVA) respectively; $M^{2A}$ represents a hydrogen atom, an alkali metal atom, ammonium or

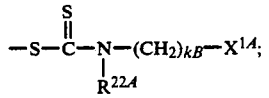

$R^{22A}$ represents a hydrogen atom or a substituted or unsubstituted lower alkyl group (preferably having from 1 to 5 carbon atoms).

Specific examples of the compounds represented by the general formula (IA), (IIA), (IIIA), (IVA), (VA) or (VIA) are set forth below, but the present invention should not be construed as being limited thereto.

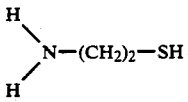

(IA)-(1)

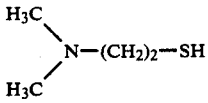

(IA)-(2)

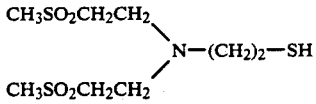

(IA)-(3)

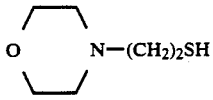

(IA)-(4)

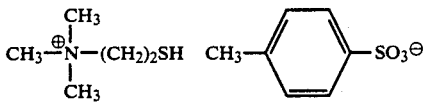

(IA)-(5)

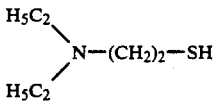

(IA)-(6)

-continued
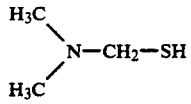
(IA)-(7)
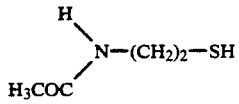
(IA)-(8)
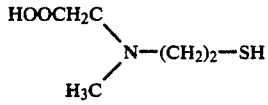
(IA)-(9)
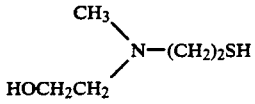
(IA)-(10)
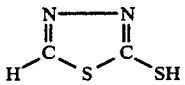
(IA)-(11)
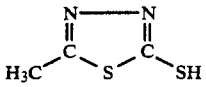
(IA)-(12)
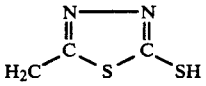
(IA)-(13)
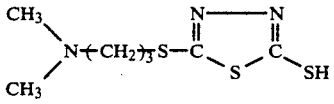
(IA)-(14)
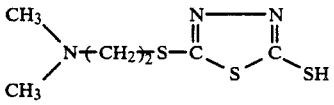
(IA)-(15)
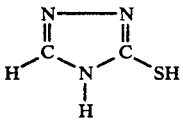
(IA)-(16)
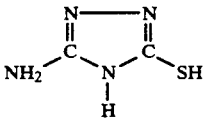
(IA)-(17)
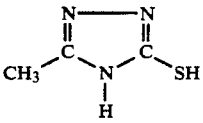
(IA)-(18)
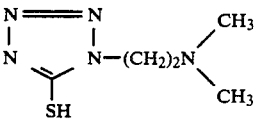
(IA)-(19)

-continued
(IA)-(20)
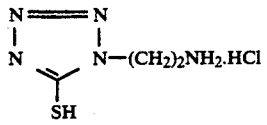
(IIA)-(1)
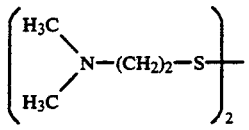
(IIA)-(2)
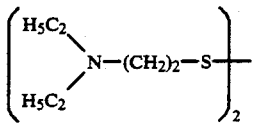
(IIA)-(3)
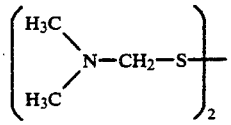
(IIA)-4
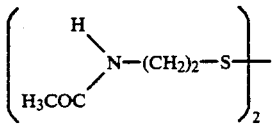
(IIA)-(5)
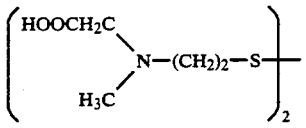
(IIA)-(6)
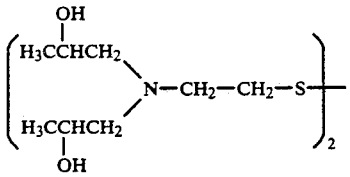
(IIA)-(7)
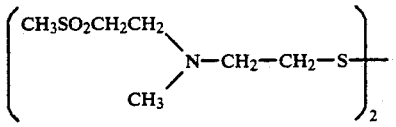
(IIA)-(8)
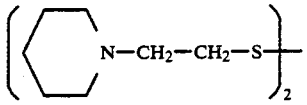
(IIA)-(9)
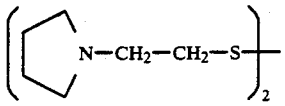
(IIA)-(10)
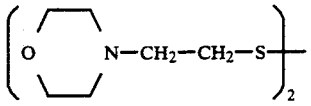

-continued
(IIA)-(11)
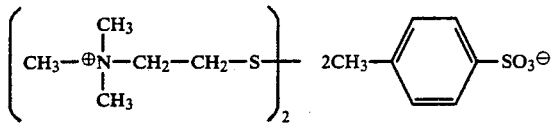
(IIA)-(12)
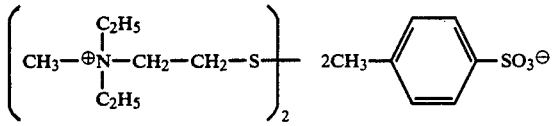
(IIIA)-(1)
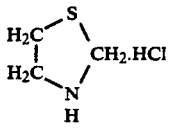
(IIIA)-(2)
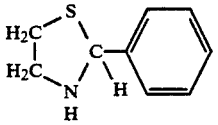
(IIIA)-(3)
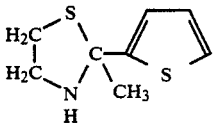
(IIIA)-(4)
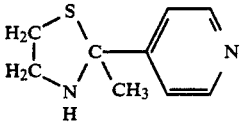
(IIIA)-(5)
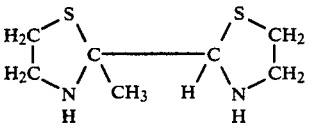
(IIIA)-(6)
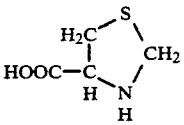
(IVA)-(1)
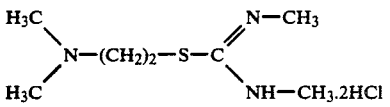
(IVA)-(2)
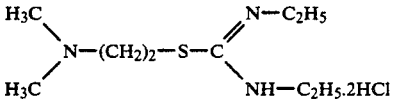
(IVA)-(3)
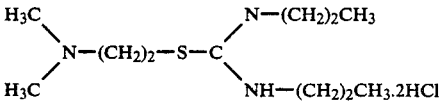
(IVA)-(4)
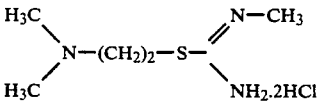

-continued
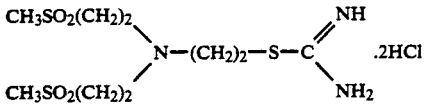
(IVA)-(5)
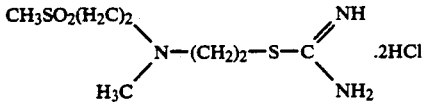
(IVA)-(6)
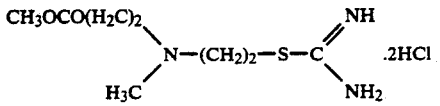
(IVA)-(7)
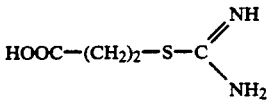
(IVA)-(8)
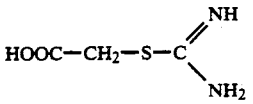
(IVA)-(9)
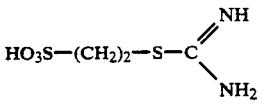
(IVA)-(10)
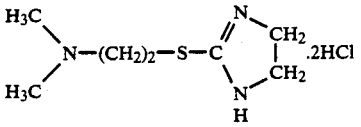
(IVA)-(11)
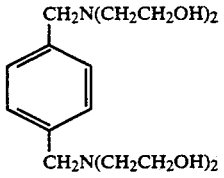
(VA)-(1)
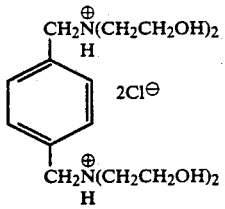
(VA)-(2)
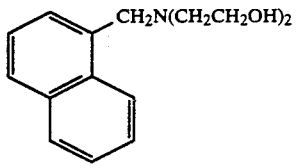
(VA)-(3)
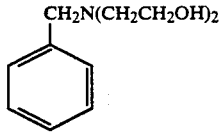
(VA)-(4)

-continued
(VA)-(5)
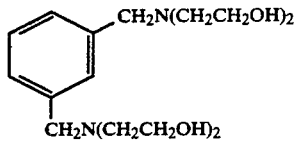
(VA)-(6)
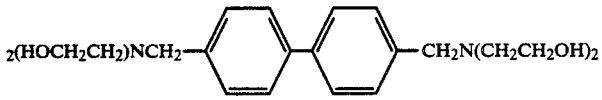
(VA)-(7)
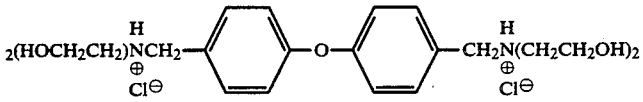
(VA)-(8)
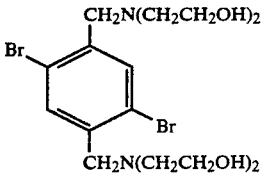
(VA)-(9)
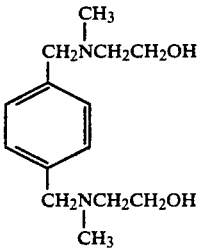
(VA)-(10)
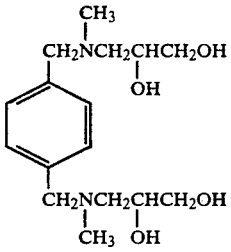
(VA)-(11)
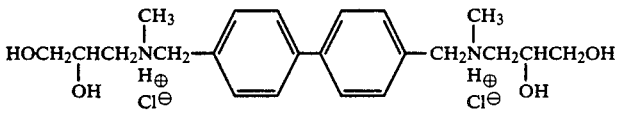
(VA)-(12)
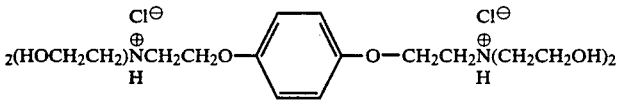
(VA)-(13)
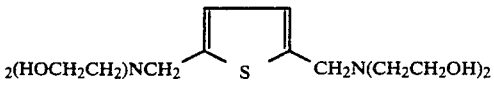
(VA)-(14)
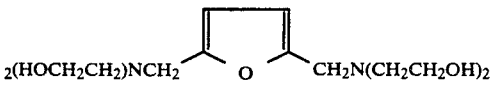

-continued
(VA)-(15)
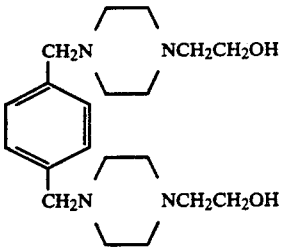
(VA)-(16)
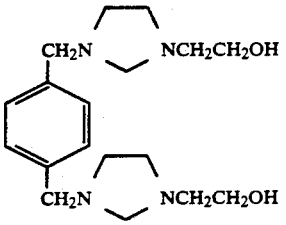
(VA)-(17)
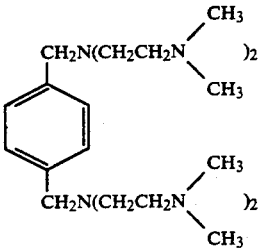
(VA)-(18)
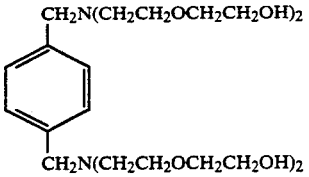
(VA)-(19)
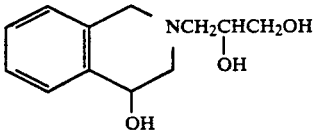
(VA)-(20)
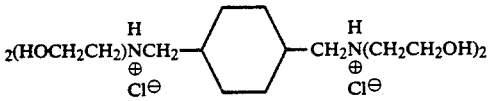
(VA)-(21)
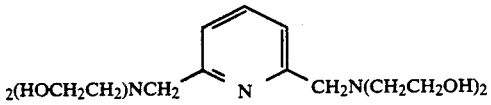
(VA)-(22)
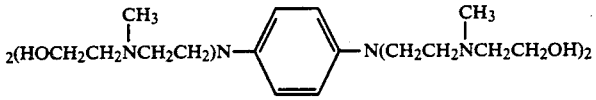
(VA)-(23)
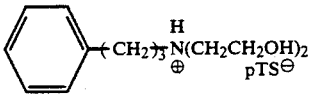
(VA)-(24)
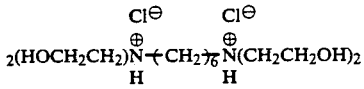

-continued

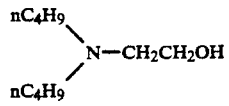

(VA)-(25)

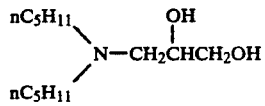

(VA)-(26)

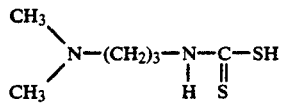

(VIA)-(1)

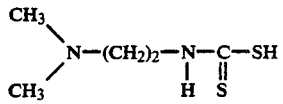

(VIA)-(2)

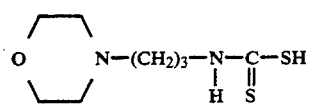

(VIA)-(3)

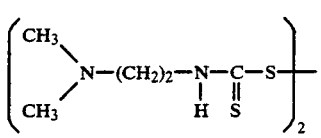

(VIA)-(4)

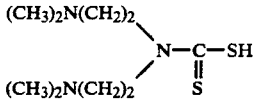

(VIA)-(5)

Of the above-described bleach accelerating agents, Compounds IA-2, IA-5, IA-13, IA-14, IA-15, IA-16, IA-19, IIA-1, IIA-11, VA-1, VIA-1 and VIA-2 are particularly preferred.

The amount of the bleach accelerating agent to be added to the processing solution having a bleaching ability is from 0.01 g to 20 g, and preferably from 0.1 g to 10 g, per liter of the solution.

In addition to the bleaching agent and the compounds described above, the bleaching solution according to the present invention can contain rehalogenating agents, e.g., bromides such as potassium bromide, sodium bromide and ammonium bromide, and chlorides such as potassium chloride, sodium chloride and ammonium chloride. The amount of the rehalogenating agent is from 0.1 mol to 5 mol, and preferably from 0.5 mol to 3 mol per liter of the bleaching solution.

Further, other additives that have a pH buffering ability and are ordinarily used in bleaching solution can be used, and, e.g., one or more inorganic acids, organic acids and their salts such as nitrates (e.g., sodium nitrate and ammonium nitrate), boric acid, borax, sodium metaborate, acetic acid, sodium acetate, sodium carbonate, potassium carbonate, phosphorous acid, phosphoric acid, sodium phosphate, citric acid, sodium citrate and tartaric acid can be added to the solution.

The pH of the bath having a bleaching ability according to the present invention is from 5.8 to 1.5, and preferably from 5.3 to 2. In the above range of pH, the occurrence of bleached fog is minimal and the desilvering property is superior.

The replenishment amount for the bath having a bleaching ability according to the present invention is from 50 ml to 2,000 ml, preferably from 100 ml to 1,000 ml per $m^2$ of the color light-sensitive material.

After the processing with the bath having a bleaching ability, the light-sensitive material of the present invention is generally processed with a bath having a fixing ability, except where the bath having a bleaching ability is also a bleach-fixing solution.

The bath having a fixing ability according to the present invention includes a bleach-fixing bath and a fixing bath.

In the bath having a fixing ability, thiosulfates such as sodium thiosulfate, ammonium thiosulfate, sodium ammonium thiosulfate and potassium thiosulfate, thiocyanates such as sodium thiocyanate, ammonium thiocyanate and potassium thiocyanate, thiourea and thioethers are employed as fixing agents.

The amount of the fixing agent to be added is from 0.3 mol to 3 mol, preferably from 0.5 mol to 2 mol, per liter of the solution.

The bath having a fixing ability can contain preservatives such as sulfites (e.g., sodium sulfite, potassium sulfite and ammonium sulfite), hydroxylamines, hydrazines and aldehyde compound-bisulfite adducts (e.g., acetaldehyde-sodium bisulfite adduct). Further, various fluorescent brightening agents, defoaming agents, surface active agents, polyvinyl pyrrolidone, and organic solvents (e.g., methanol) may be added to the bath having a fixing ability. As the preservative, a sulfinic acid compound as described in Japanese Patent Application No. 60-283831 is preferably employed.

The replenishment amount for the bath having a fixing ability is preferably from 300 ml to 3,000 ml, and more preferably from 300 ml to 1,000 ml, per $m^2$ of the color light-sensitive material.

Furthermore, it is preferred to add various aminopolycarboxylic acids and organic phosphonic acids to the bath having a fixing ability according to the present invention for the purpose of stabilization of the solution.

As the total time of the desilvering step according to the present invention is reduced, the effect of the present invention becomes more remarkable. Thus, the processing time for the desilvering step is preferably from 1 minute to 4 minutes, and more preferably from 1 minute and 30 seconds to 3 minutes. The processing temperature is from 25° C. to 50° C., and preferably 35° C. to 45° C. In the above temperature range, the desilvering rate increases and the occurrence of stain following processing is effectively prevented.

In the desilvering step according to the present invention, vigorous stirring is preferred in view of achieving the effect of the present invention.

Specific examples of methods of vigorous stirring include jetting the processing solution against the emulsion surface of the light-sensitive material as described in JP-A-62-183460 and JP-A-62-183461, use of a revolving means as described in JP-A-62-183461, transferring the light-sensitive material while bringing the emulsion surface into contact with a wiper blade as provided in the solution to form a turbulent flow pattern on the emulsion surface, and a method of increasing the circulation flux of the total processing solution. These means of vigorous stirring are effective in any of the bleaching solutions, bleach-fixing solutions and fixing solutions of the present invention. It is believed that vigorous stirring brings fresh bleaching agent and fixing agent to the emulsion layer, resulting in the increase of the desilvering rate.

Further, the above-described means for vigorous stirring are more effective when using a bleach accelerating agent to remarkably increase the agent's accelerating effect and to eliminate the bleach accelerating agent fixing hindrance function.

The automatic developing machine for use in the present invention preferably employs a transportation means for the light-sensitive material as described in JP-A-60-191257, JP-A-60-191258 and JP-A-60-191259. As described in JP-A-60-191257, such a transportation means can greatly reduce an amount of processing solution carried over from the preceding bath to the after bath and degradation of the processing solution is thus effectively prevented. These effects are particularly useful for shortening the processing time and decreasing an replenishment amount of the processing solution in each step.

The color developing solution used in the present invention contains an aromatic primary amine color developing agent. Preferred examples thereof are p-phenylenediamine derivatives. Typical examples of the p-phenylenediamine derivative used are set forth below, but the present invention should not be construed as being limited thereto.

D-1: N,N-Diethyl-p-phenylenediamine
D-2: 2-Amino-5-diethylaminotoluene
D-3: 2-Amino-5-(N-ethyl-N-laurylamino)toluene
D-4: 4-[N-Ethyl-N-(β-hydroxyethyl)amino]aniline
D-5: 2-Methyl-4-[N-ethyl-N-(β-hydroxyethyl-)amino]aniline
D-6: 4-Amino-3-methyl-N-ethyl-N-[β-methanesulfonamide)ethyl]aniline
D-7: N-(2-Amino-5-diethylaminophenylethyl)methanesulfonamide
D-8: N,N-Dimethyl-p-phenylenediamine
D-9: 4-Amino-3-methyl-N-ethyl-N-methoxyethylaniline
D-10: 4-Amino-3-methyl-N-ethyl-N-β-ethoxyethylaniline
D-11: 4-Amino-3-methyl-N-ethyl-N-β-butoxyethylaniline Of these p-phenylenediamine derivatives described above, D-5 is particularly preferred.

These p-phenylenediamine derivatives may be in the form of salts such as sulfates, hydrochlorides, sulfites, or p-toluenesulfonates.

The aromatic primary amine developing agent is used preferably in an amount of from about 0.1 g about 20 g, and more preferably from about 0.5 g about 10 g per liter of the developing solution.

Also, the color developing solution used in the present invention may contain, if desired, sulfites such as sodium sulfite, potassium sulfite, sodium bisulfite, potassium bisulfite, sodium metasulfite, and potassium metasulfite, or carbonyl-sulfite adducts, as preservatives.

The amount of sulfite added is preferably from 0.5 g to 10 g, and more preferably from 1 g to 5 g per liter of the color developing solution.

Further, it is preferred to add, as compounmds capable of directly preservating the color developing agent, various hydroxylamines, hydroxamic acids as described in Japanese Patent Application No. 186559/86, hydrazines and hydrazides as described in Japanese Patent Application No. 170756/86, phenols as described in Japanese Patent Application Nos. 188742/86 and 203253/86, α-hydroxyketones and α-aminoketones as described in Japanese Patent Application No. 188741/86 and/or various saccharides as described in Japanese Patent Application No. 180616/86 to the color developing solution. Moreover, together with the above described compounds, monoamines as described in Japanese Patent Application Nos. 148823/86, 166674/86, 165621/86, 164515/86, 170789/86 and 168159/86, diamines as described in Japanese Patent Application Nos. 173595/86, 164515/86 and 186560/86, polyamines as described in Japanese Patent Application Nos. 165621/86 and 169789/86, polyamines as described in Japanese Patent Application No. 188619/86, nitroxy radicals as described in Japanese Patent Application No. 197760/86, alcohols as described in Japanese Patent Application Nos. 186561/86 and 197419/86, oximes as described in Japanese Patent Application No. 198987/86, and tertiary amines as described in Japanese Patent Application No. 265149/86 are preferably employed.

Other preservatives such as various metals as described in JP-A-57-44148 and JP-A-57-53749, salicylic acids as described in JP-A-59-180588, alkanolamines as described in JP-A-54-3532, polyethyleneimines as described in JP-A-56-94349, and aromatic polyhydroxy compounds as described in U.S. Pat. No. 3,746,5544 may be incorporated into the color developing solution, if desired. The addition of aromatic polyhydroxy compounds is particularly preferred.

The color developing solution used in the present invention has a pH which ranges preferably from 9 to 12 and more preferably from 9 to 11.0. The color developing solution may also contain any of the compounds that are known to be usable as components of developing solutions.

In order to maintain the pH in the above-described range, various kinds of buffers are preferably employed. Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). The present invention should not be construed as being limited to these compounds. The amount of the buffer to be added to the color developing solution is preferably 0.1 mol or more and from 0.1 mol to 0.4 mol per liter thereof is particularly preferred.

In addition, various chelating agents can be used in the color developing solution according to the present invention for the purpose of preventing calcium or magnesium precipitation or increasing the stability of the color developing solution.

Organic acid compounds are preferred chelating agents. Others include aminopolycarboxylic acids, organic phosphoric acids and phosphonocarboxylic acids.

Specific examples of the chelating agents used are set forth below, but the present invention should not be construed as being limited thereto.

Nitrilotriacetic acid
Diethyleneaminopentaacetic acid
Ethylenediaminetetraacetic acid
N,N,N-Trimethylenephosphonic acid
Ethylenediamine-N,N,N',N'-tetramethylenephosphonoic acid
Trans-cyclohexanediaminetetraacetic acid
1,2-Diaminopropanetetraacetic acid
Hydroxyethyliminodiacetic acid
Glycol ether diaminetetraacetic acid
Ethylenediamine-o-hydroxyphenylacetic acid
2-Phosphonobutane-1,2,4-tricarboxylic acid
1-Hydroxyethylidene-1,1-diphosphonic acid
N,N'-Bis(2-hydroxybenzyl)ethylenediamine-N,N'-diacetic acid Two or more kinds of such chelating agents may be employed together, if desired.

The chelating agent is added to the color developing solution in an amount sufficient to block metal ions present therein. For example, a range of from about 0.1 g to about 10 g per liter of the color developing solution is preferably employed.

The color developing solution of the present invention may contain appropriate development accelerators, if desired. However, it is preferred that the color developing solution used in the present invention does not substantially contain benzyl alcohol in view of environmental factors, ease of preparation of the solution and the prevention form color stain. The term "substantially not contain benzyl alcohol" means that the color developing solution contains benzyl alcohol in an amount of not more than 2 ml per liter of the solution, and preferably does not contain benzyl alcohol at all.

Examples of suitable development accelerators for use in the present invention include thioether type compounds as described in JP-B-37-16088, JP-B-37-5987, JP-B-38-7826, JP-B-44-12380, JP-B-45-9019 and U.S. Pat. No. 3,813,247; p-phenylenediamine type compounds as described in JP-A-52-49829 and JP-A-50-15554; quaternary ammonium salts as described in JP-A-50-137726, JP-B-44-30074, JP-A-56-156826 and JP-A-52-43429; amine type compounds as described in U.S. Pat. Nos. 2,494,903, 3,128,182, 4,230,796, 3,253,919, 2,482,546, 2,596,926, and 3,582,346 and JP-B-41-11431; polyalkylene oxides as described in JP-B-37-16088, JP-B-42-25201, JP-B-41-11431, JP-B-42-23883 and U.S. Pat. Nos. 3,128,183 and 3,532,501; 1-phenyl-3-pyrazolidones; and imidazoles.

The color developing solution used in the present invention may contain appropriate antifoggants, if desired. Alkali metal halides such as sodium chloride, potassium bromide, and potassium iodide as well as organic antifoggants may be employed as anti-foggants. Representative examples of organic anti-foggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine and adenine, etc.

It is preferred that the color developing solution used in the present invention contain fluorescent brightening agents. As fluorescent brightening agents, 4,4'-diamino-2,2'-disulfostilbene type compounds are preferred. The amount of the fluorescent brightening agent added is from 0 to 5 g and preferably from 0.1 g to 4 g per liter of the color developing solution.

Furthermore, the color developing solution according to the present invention may contain various surface active agents such as alkylsulfonic acids, arylphosphonic acids, aliphatic carboxylic acids, and aromatic carboxylic acids, etc., if desired.

The processing temperature of the color developing solution used in the present invention is usually from 20° C. to 50° C. and preferably from 30° C. to 45° C. The processing time is usually from 20 sec. to 5 min. and preferably from 30 sec. to 3 min. Further, the amount of replenishment for the color developing solution is preferably as small as possible and is usually from 100 ml to 1,500 ml, preferably from 100 ml to 800 ml, and more preferably from 100 ml to 400 ml per square meter of the color light-sensitive material thus processed.

If required, the color developing bath may be divided into two or more baths, so that a color developing replenisher may be supplied from the first bath or the last bath to shorten the developing time or to reduce the amount of the replenisher, respectively.

The processing method according to the present invention can be used in a color reversal process. A suitable black-and-white developing solution used in this method includes a black-and-white first developing solution used in reversal processing of color photographic light-sensitive materials, or one that can be used in processing black-and-white photographic light-sensitive materials. Further, various additives that are generally added to a black-and-white developing solution can be contained in the solution.

Representative additives include developing agents such as 1-phenyl-3-pyrazolidone, Metol and hydroquinone; preservatives such as sulfites; accelerators comprising an alkali such as sodium hydroxide, sodium carbonate and potassium carbonate; inorganic or organic restrainers such as potassium bromide, 2-methylbenzimidazole and methylbenzothiazole; water softeners such as polyphosphates; and development restrainers comprising trace amounts of iodides or mercapto compounds.

The processing method according to the present invention comprises processing steps including color development, bleaching, bleach-fixing, and fixing, etc., as mentioned above. After the bleach-fixing step or fixing step, although processing steps that include water washing and stabilizing are generally carried out, a simple processing method is also possible wherein after the processing with a bath having a fixing ability, a stabilizing process is carried out without performing substantial water washing.

The washing water used in the water washing step can contain, if desired, various additives. For example, water softeners such as inorganic phosphoric acid, aminopolycarboxylic acids and organic phosphoric acids; fungicides and mildewcides for preventing various bacteria and algae from proliferating (e.g., isothiazolone, organic chlorine type fungicides and benzotriazole) and surface active agents for lowering drying load or for preventing uneven drying can be used. Compounds as described, e.g., in L.E. West, "Water Quality Criteria", *Phot. Sci. and Eng.*, Vol. 9, No. 6, pages 344 to 359 (1965) can also be used.

A suitable stabilizing solution used in the stabilizing step includes a processing solution for stabilizing dye images. For example, a solution having a pH of from 3 to 6 and a buffering ability and a solution containing an aldehyde (e.g., formalin) can be used. The stabilizing solution can contain, if desired, ammonium compounds, compounds of metals such as Bi and Al, fluorescent brightening agents, chelating agents (e.g., 1-hydroxyethylidene-1,1-diphosphonic acid), fungicides, mildewcides, hardening agents, and surface active agents, etc.

A multistage countercurrent system is preferably employed in the water washing step or stabilizing step. Two to four stages are preferably used. The amount of replenishment is from 1 to 50 times, preferably from 2 to 30 times and more preferably from 2 to 15 times the amount of processing solution carried over from the preceding both per unit area of the color light-sensitive material.

Water suitable for use in the water washing step or the stabilizing step includes city water, water that has been deionized, e.g., by ion exchange resins to reduce Ca/Mg concentrations to 5 mg/liter or below, or water that has been sterilized, e.g., by a halogen lamp or a bactericidal ultraviolet lamp.

When continuous processing is performed using an automatic developing machine, concentration of the processing solution tends to occur by evaporation in each step of the processing of color light-sensitive materials. This phenomenone is particularly prevalent where a small amount of color light-sensitive materials is processed or where the surface area exposure of the processing solution to air is large. In order to compensate concentration of the processing solution, it is preferred to replenish an appropriate amount of water or an appropriate correcting solution.

Moreover, an over-flow solution from the water washing step or stabilizing step may be introduced into the bath having a fixing ability which is a preceding bath thereto. The amount of waste solution is thereby reduced.

In the photographic emulsion layers of the photographic light-sensitive material used in the present invention, any of silver chloride, silver bromide, silver chlorobromide, silver iodochloride, silver chloroiodobromide and silver iodobromide may be used as the silver halide.

Silver halide grains in the silver halide photographic emulsion may have a regular crystal structure, e.g., a cubic, octahedral or tetradecahedral structure, etc., and irregular crystal structure, e.g., a spherical or tabular structure, etc., a crystal defect, e.g., a twin plane, etc., or a composite structure thereof.

The grain size of the silver halide for use in the present invention may be varied and includes fine grains having about 0.2 micron or less to large size grains having about 10 microns of a diameter of projected area. Further, a polydispersed emulsion and a monodispersed emulsion may be used.

The silver halide photographic emulsion used in the present invention can be prepared using known methods, e.g., those as described in *Research Disclosure,* No. 17643 (December, 1978), pages 22 to 3, "I. Emulsion Preparation and Types" and ibid., No. 18716 (November, 1979), page 648, P. Glafkides, *Chimie et Physique Photographique,* Paul Montel (1967), G.F. Duffin, *Photographic Emulsion Chemistry,* The Focal Press (1966), and V.L. Zelikman, et al., *Making and Coating Photographic Emulsion,* The Focal Press (1964).

Monodispersed emulsions as described in U.S. Pat. Nos. 3,574,628 and 3,655,394, and British Patent 1,413,748 are preferably used in the present invention.

Further, tabular silver halide grains having an aspect ratio of about 5 or more can be employed in the present invention. The tabular grains may be easily prepared by the method as described in Gutoff, *Photographic Science and Engineering,* Vol. 14, pages 248 to 257 (1970), U.S. Pat. Nos. 4,434,226, 4,414,310, 4,433,048 and 4,439,520, and British Patent 2,112,157.

The crystal structure of silver halide grains for use in the present invention may be uniform, composed of different halide compositions between the inner portion and the outer portion thereof, or may have a stratified structure.

Further, silver halide emulsions in which silver halide grains having different compositions are connected upon epitaxial junctions or silver halide emulsions in which silver halide grains are connected with compounds other than silver halide such as silver thiocyanate, or lead oxide may also be employed.

Moreover, a mixture of grains having a different crystal structure may be used.

The silver halide emulsions used in the present invention are usually subjected to physical ripening, chemical ripening and spectral sensitization. Various additives which can be employed in these steps are described in *Research Disclosure,* No. 17643 (December, 1978) and ibid., No. 18716 (November, 1979) and concerned items thereof are summarized in the table shown below.

Further, known photographic additives which can be used in the present invention are also described in the above mentioned literature and concerned items thereof are summarized in the table below.

| Kind of Additives | RD 17643 | RD 18716 |
|---|---|---|
| 1. Chemical Sensitizers | Page 23 | Page 648, right column |
| 2. Sensitivity Increasing Agents | — | Page 648, right column |
| 3. Spectral Sensitizers and Supersensitizers | Pages 23 to 24 | Page 648, right column to page 649, right column |
| 4. Whitening Agents | Page 24 | — |

-continued

| Kind of Additives | RD 17643 | RD 18716 |
|---|---|---|
| 5. Antifoggants and Stabilizers | Pages 24 to 25 | Page 649, right column |
| 6. Light-Absorbers, Filter Dyes and Ultraviolet Ray Absorbers | Pages 25 to 26 | Page 649, right column to page 650, left column |
| 7. Antistaining Agents | Page 25, right column | Page 650, left column to right column |
| 8. Dye Image Stabilizers | Page 25 | — |
| 9. Hardeners | Page 26 | Page 651, left column |
| 10. Binders | Page 26 | Page 651, left column |
| 11. Plasticizers and Lubricants | Page 27 | Page 650, right column |
| 12. Coating Aids and Surfactants | Pages 26 to 27 | Page 650, right column |
| 13. Antistatic Agents | Page 27 | Page 650, right column |

In the present invention, various color couplers can be employed and specific examples thereof are described in the patents cited in *Research Disclosure,* No. 17643, "VII-C" to "VII-G".

Yellow couplers for use in the present invention include, e.g., those as described in U.S. Pat. Nos. 3,933,501, 4,022,620, 4,326,024 and 4,401,752, JP-B-58-10739, and British Patents 1,425,020 and 1,476,760 are preferred.

Preferred magenta couplers for use in the present invention include 5-pyrazolone type and pyrazoloazole type compounds. Magenta couplers as described, e.g., in U.S. Pat. Nos. 4,310,619 and 4,351,897, European Patent 73,636, U.S. Pat. Nos. 3,061,432 and 3,725,067, *Research Disclosure,* No. 24220 (June, 1984), JP-A-60-33552, *Research Disclosure,* No. 24230 (June, 1984), JP-A-60-43659, and U.S. Pat. Nos. 4,500,630 and 4,540,654 are particularly preferred.

Cyan couplers for use in the present invention include phenol type and naphthol type couplers. Cyan couplers as described, e.g., in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Application (OLS) No. 3,329,729, European Patent 121,365A, U.S. Pat. Nos. 3,446,622, 4,333,999, 4,451,559 and 4,427,767, and European Patent 161,616A are preferred.

Colored couplers for correcting undesirable absorptions of dyes formed as described, e.g., in *Research Disclosure,* No. 17643, "VII-G", U.S. Pat. No. 4,163,670, JP-B-57-39413, U.S. Pat. Nos. 4,004,929 and 4,138,258, and British Patent 1,146,368 are preferably employed.

Couplers capable of forming appropriately diffusible dyes as described, e.g., in U.S. Pat. No. 4,366,237, British Patent 2,125,570, European Patent 96,570, and West German Patent Application (OLS) No. 3,234,533 are preferably employed.

Typical examples of polymerized dye forming couplers for use in the present invention are described, e.g., in U.S. Pat. Nos. 3,451,820, 4,080,211 and 4,367,282, and British Patent 2,102,173.

Couplers capable of releasing a photographically useful residue during the course of coupling are also preferably employed in the present invention. DIR couplers capable of releasing a development inhibitor as described, e.g., in the patents cited in *Research Disclosure,* No. 17643, "VII-F" described above, JP-A-57-151944, JP-A-57-154234 and JP-A-60-184248, and U.S. Pat. No. 4,248,962 are preferred.

Couplers which release imagewise a nucleating agent or a development accelerator at the time of development as described, e.g., in British Patents 2,097,140 and 2,131,188 and JP-A-59-157638 and JP-A-59-170840 are preferred.

Furthermore, competing couplers such as those described in U.S. Pat. No. 4,130,427, poly-equivalent couplers such as those described in U.S. Pat. Nos. 4,283,472, 4,338,393 and 4,310,618, DIR redox compound releasing couplers such as those described in JP-A-60-185950, couplers capable of releasing a dye which turns to a colored form after being released such as those described in European Patent 173,302A, and the like may be employed in the photographic light-sensitive material of the present invention.

The couplers which can be used in the present invention can be introduced into the photographic light-sensitive material according to various dispersing methods.

Suitable examples of organic solvent having a high boiling point which can be employed in an oil droplet-in-water type dispersing method are described, e.g., in U.S. Pat. No. 2,322,027.

Further, methods employing polymers as coupler dispersants as described, e.g., in JP-B-48-30494, U.S. Pat. No. 3,619,195, West German Patent 1,957,467 and JP-B-51-39835 are employed.

The processes and effects of latex dispersing methods and the specific examples of latexes for loading are described, e.g., in U.S. Pat. No. 4,199,363, West German Patent Application (OLS) Nos. 2,541,274 and 2,541,230.

Suitable supports which can be used in the present invention are described, e.g., in *Research Disclosure,* No. 17643, page 28 and ibid., No. 18716, page 647, right column to page 648, left column, as mentioned above.

The present invention is explained in greater detail with reference to the following examples, but the present invention should not be construed as being limited thereto.

EXAMPLE 1

On a cellulose triacetate film support provided with a subbing layer was coated each layer having the composition set forth below to prepare a multilayer color light-sensitive material designated Sample 101.

With respect to the compositions of the layers, coated amounts are shown in units of g/m$^2$, coated amounts of silver halide and colloidal silver are shown by a silver coated amount in units of g/m$^2$, and those of sensitizing dyes are shown as a molar amount per mol of silver halide being present in the same layer.

| | |
|---|---|
| First Layer: Antihalation Layer | |
| Black colloidal silver | 0.18 (as silver) |
| Gelatin | 0.40 |
| Second Layer: Intermediate Layer | |
| 2,5-Di-tert-pentadecylhydroquinone | 0.18 |
| EX-1 | 0.07 |
| EX-3 | 0.02 |
| EX-12 | 0.002 |
| U-1 | 0.06 |
| U-2 | 0.08 |
| U-3 | 0.10 |
| HBS-1 | 0.10 |
| HBS-2 | 0.02 |
| Gelatin | 1.04 |

-continued

| | |
|---|---|
| Third Layer: First Red-Sensitive Emulsion Layer | |
| Monodispersed Silver Iodobromide Emulsion (silver iodide: 6 mol %, average particle diameter: 0.6 μm, coefficient of variation on particle diameter: 0.15) | 0.55 (as silver) |
| Sensitizing Dye I | $6.9 \times 10^{-5}$ |
| Sensitizing Dye II | $1.8 \times 10^{-5}$ |
| Sensitizing Dye III | $3.1 \times 10^{-4}$ |
| Sensitizing Dye IV | $4.0 \times 10^{-5}$ |
| EX-2 | 0.350 |
| HBS-1 | 0.005 |
| EX-10 | 0.020 |
| Gelatin | 1.20 |
| Fourth Layer: Second Red-Sensitive Emulsion Layer | |
| Tabular Silver Iodobromide Emulsion (silver iodide: 10 mol %, average particle diameter: 0.7 μm, average aspect ratio: 5.5, average thickness: 0.2 μm) | 1.0 (as silver) |
| Sensitizing Dye I | $5.1 \times 10^{-5}$ |
| Sensitizing Dye II | $1.4 \times 10^{-5}$ |
| Sensitizing Dye III | $2.3 \times 10^{-4}$ |
| Sensitizing Dye IV | $3.0 \times 10^{-5}$ |
| EX-2 | 0.400 |
| EX-3 | 0.050 |
| EX-10 | 0.015 |
| Gelatin | 1.30 |
| Fifth Layer: Third Red-Sensitive Emulsion Layer | |
| Silver Iodobromide Emulsion (silver iodide: 16 mol %, average particle diameter: 1.1 μm) | 1.60 (as silver) |
| Sensitizing Dye IX | $5.4 \times 10^{-5}$ |
| Sensitizing Dye II | $1.4 \times 10^{-5}$ |
| Sensitizing Dye III | $2.4 \times 10^{-4}$ |
| Sensitizing Dye IV | $3.1 \times 10^{-5}$ |
| EX-3 | 0.240 |
| EX-4 | 0.120 |
| HBS-1 | 0.22 |
| HBS-2 | 0.10 |
| Gelatin | 1.63 |
| Sixth Layer: Intermediate Layer | |
| EX-5 | 0.040 |
| HBS-1 | 0.020 |
| EX-12 | 0.004 |
| Gelatin | 0.80 |
| Seventh Layer: First Green-Sensitive Emulsion Layer | |
| Tabular Silver Iodobromide Emulsion (silver iodide: 6 mol %, average particle diameter: 0.6 μm, average aspect ratio: 6.0, average thickness: 0.15 μm) | 0.40 (as silver) |
| Sensitizing Dye V | $3.0 \times 10^{-5}$ |
| Sensitizing Dye VI | $1.0 \times 10^{-4}$ |
| Sensitizing Dye VII | $3.8 \times 10^{-4}$ |
| EX-6 | 0.260 |
| EX-1 | 0.021 |
| EX-7 | 0.030 |
| EX-8 | 0.025 |
| HBS-1 | 0.100 |
| HBS-4 | 0.010 |
| Gelatin | 0.75 |
| Eighth Layer: Second Green-Sensitive Emulsion Layer | |
| Monodispersed Silver Iodobromide Emulsion (silver iodide: 9 mol %, average particle diameter: 0.7 μm, coefficient of variation on particle diameter: 0.18) | 0.80 (as silver) |
| Sensitizing Dye V | $2.1 \times 10^{-5}$ |
| Sensitizing Dye VI | $7.0 \times 10^{-5}$ |
| Sensitizing Dye VII | $2.6 \times 10^{-4}$ |
| EX-6 | 0.180 |
| EX-8 | 0.010 |
| EX-1 | 0.008 |
| EX-7 | 0.012 |

-continued

| | |
|---|---|
| HBS-1 | 0.160 |
| HBS-4 | 0.008 |
| Gelatin | 1.10 |
| Ninth Layer: Third Green-Sensitive Emulsion Layer | |
| Silver Iodobromide Emulsion (silver iodide: 12 mol %, average particle diameter: 1.0 μm) | 1.2 (as silver) |
| Sensitizing Dye V | $3.5 \times 10^{-5}$ |
| Sensitizing Dye VI | $8.0 \times 10^{-5}$ |
| Sensitizing Dye VII | $3.0 \times 10^{-4}$ |
| EX-6 | 0.065 |
| EX-11 | 0.030 |
| EX-1 | 0.025 |
| HBS-1 | 0.25 |
| HBS-2 | 0.10 |
| Gelatin | 1.74 |
| Tenth Layer: Yellow Filter Layer | |
| Yellow Colloidal Silver | 0.05 (as silver) |
| EX-5 | 0.08 |
| HBS-3 | 0.03 |
| Gelatin | 0.95 |
| Eleventh Layer: First Blue-Sensitive Emulsion Layer | |
| Tabular Silver Iodobromide Emulsion (silver iodide: 6 mol %, average particle diameter: 0.6 μm, average aspect ratio: 5.7, average thickness: 0.15 μm) | 0.24 (as silver) |
| Sensitizing Dye VIII | $3.5 \times 10^{-5}$ |
| EX-9 | 0.85 |
| EX-8 | 0.12 |
| HBS-1 | 0.28 |
| Gelatin | 1.28 |
| Twelfth Layer: Second Blue-Sensitive Emulsion Layer | |
| Monodispersed Silver Iodobromide Emulsion (silver iodide: 10 mol %, average particle diameter: 0.8 μm, coefficient of variation on particle diameter: 0.16) | 0.45 (as silver) |
| Sensitizing Dye VIII | $2.1 \times 10^{-4}$ |
| EX-9 | 0.20 |
| EX-10 | 0.015 |
| HBS-1 | 0.03 |
| Gelatin | 0.46 |
| Thirteenth Layer: Third Blue-Sensitive Emulsion Layer | |
| Silver Iodobromide Emulsion (silver iodide: 14 mol %, average particle diameter: 1.3 μm) | 0.77 (as silver) |
| Sensitizing Dye VIII | $2.2 \times 10^{-4}$ |
| EX-9 | 0.20 |
| HBS-1 | 0.07 |
| Gelatin | 0.69 |
| Fourteenth Layer: First Protective Layer | |
| Silver Iodobromide Emulsion (silver iodide: 1 mol %, average particle diameter: 0.07 μm) | 0.5 (as silver) |
| U-4 | 0.11 |
| U-5 | 0.17 |
| HBS-1 | 0.90 |
| Gelatin | 1.00 |
| Fifteenth Layer: Second Protective Layer | |
| Polymethyl Methacrylate Particle (diameter: about 1.5 μm) | 0.54 |
| S-1 | 0.15 |
| S-2 | 0.05 |
| Gelatin | 0.72 |

Gelatin Hardener H-1 and a surface active agent were added to each of the layers in addition to the above described components.

The compounds employed for the preparation of Sample 1 are shown below.

U-1
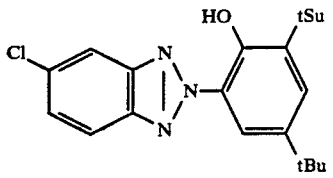
U-2
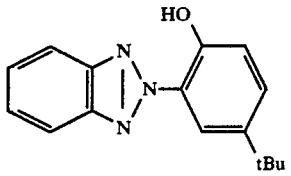
U-3
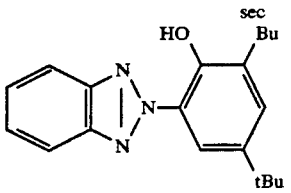
U-4
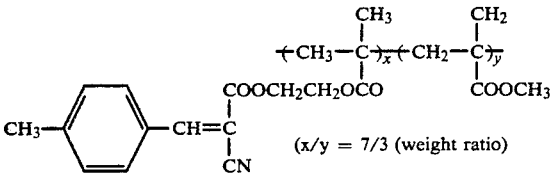
(x/y = 7/3 (weight ratio)
U-5
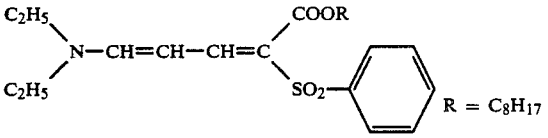
R = $C_8H_{17}$
EX-1
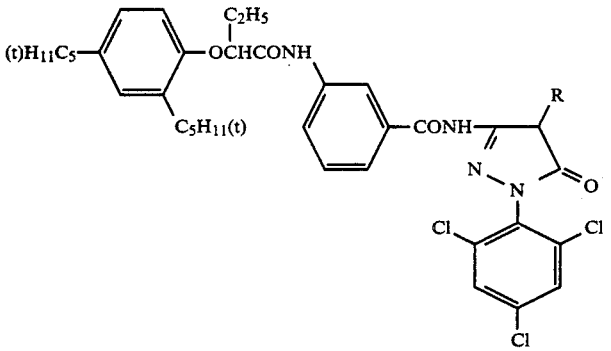
(R: 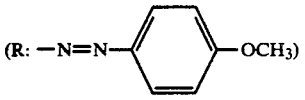 )
EX-2
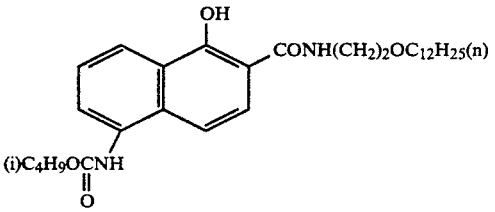

-continued
EX-3
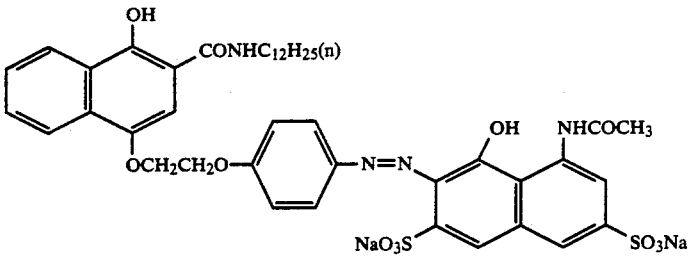
EX-4
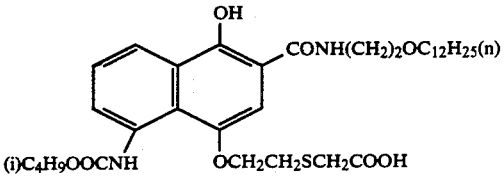
EX-5
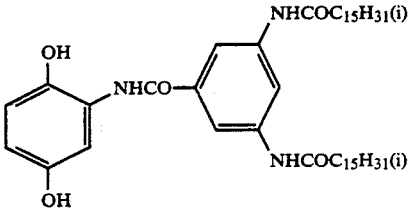
EX-6
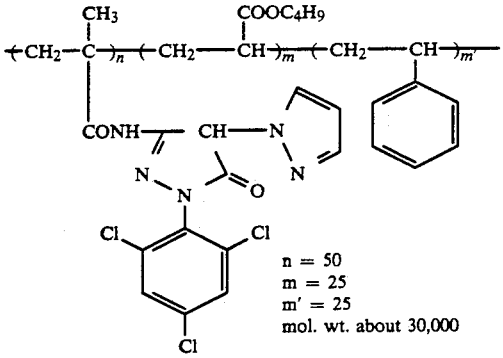
EX-7
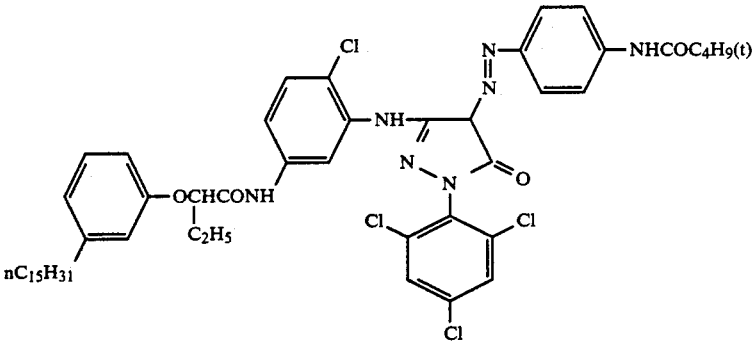
EX-8
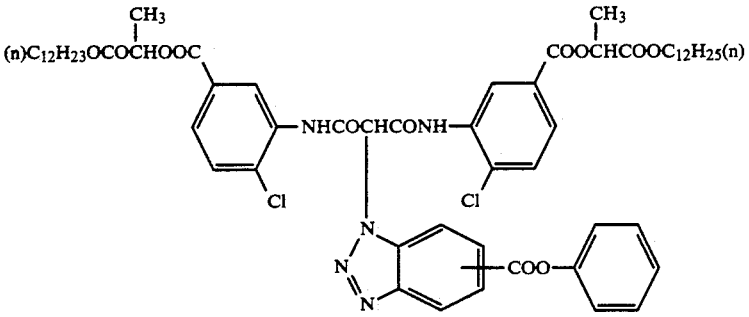

-continued
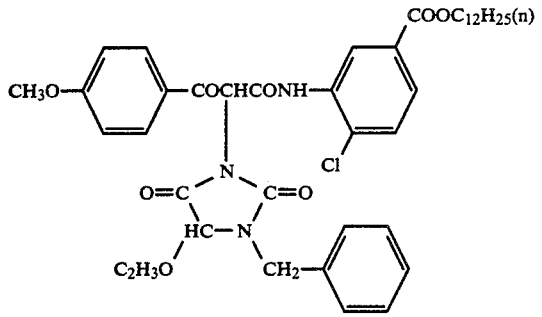
EX-9
(Comparative coupler A)
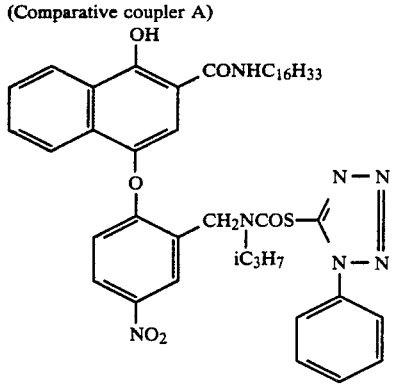
EX-10
Same as EX-1 (R:H)
EX-11
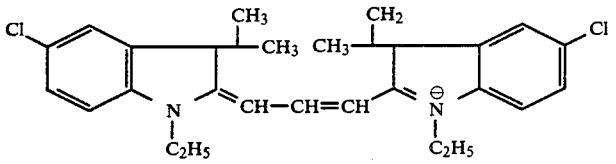
EX-12
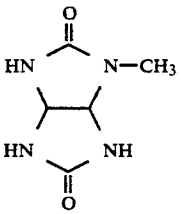
S-1
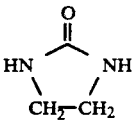
S-2
Tricresyl phosphate HBS-1
Dibutyl phthalate HBS-2
Bis(2-ethylhexyl) phthalate HBS:3
HBS-4
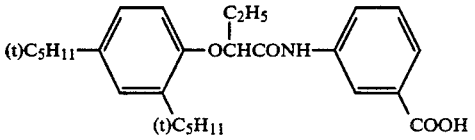
H-1
$CH_2{=}CH{-}SO_2{-}CH_2{-}CONH{-}CH_2$
$CH_2{=}CH{-}SO_2{-}CH_2{-}CONH{-}CH_2$ Sensitizing Dye
I
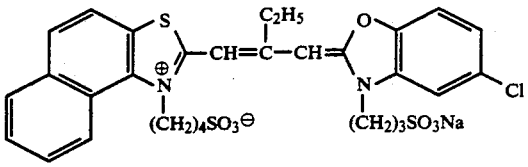
II
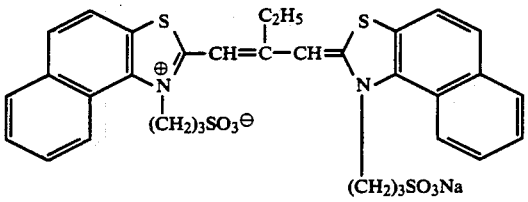
III
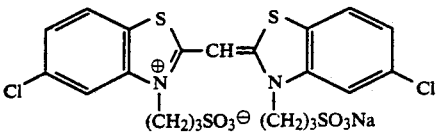
IV
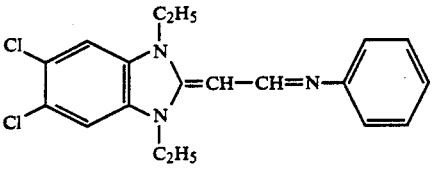
V
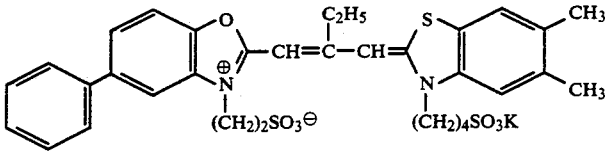
VI
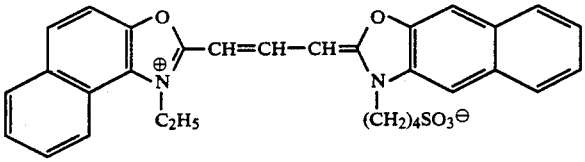
VII
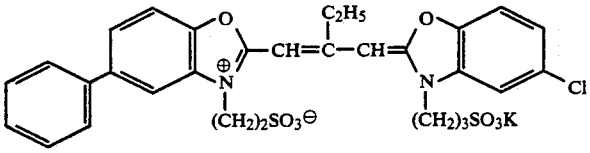
VIII
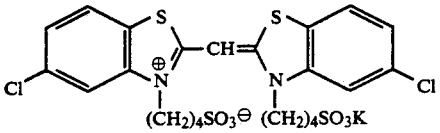
IX
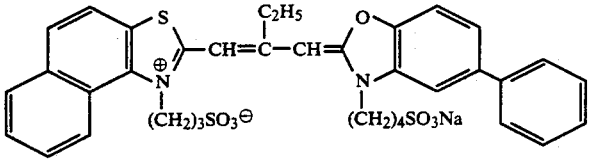
Sample 102 was prepared in the same manner as Sample 101 except for use of an equimolar amount of Coupler (43) according to the present invention in place of Sample 103 was prepared in the same manner as Sample 101 except that Coupler B shown below was used in place of Coupler A for comparison and that the coupler (EX-8) used in the seventh, eighth and eleventh layers was changed to the equimolar amount of Coupler (2) according to the present invention respectively.

Further, Sample 104 was prepared in the same manner as Sample 103 except using Coupler (37) according to the present invention in place of Coupler (2).

Couplers A and B are not hydrolyzed and the coupler (EX-8) has the half-life period of more than 8 hours.

Coupler B:

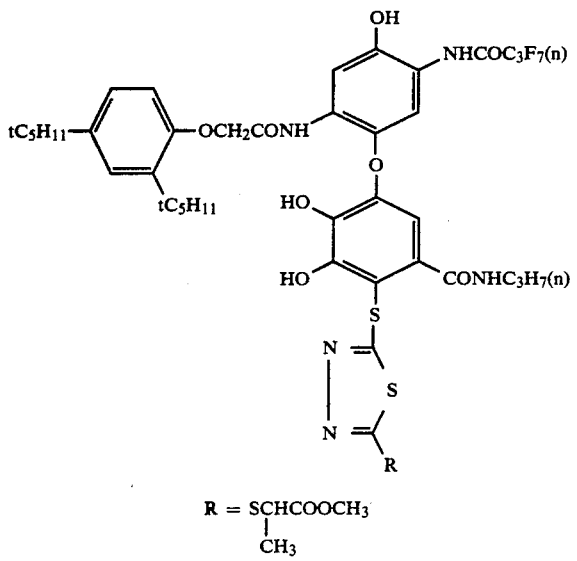

Samples 101 to 104 thus prepared were exposed to light in an exposure amount of 10 CMS using a light source having color temperature of 4800° K. and then subjected to development processing according to the processing steps shown below.

| Processing Step | Processing Time | Processing Temperature |
|---|---|---|
| Color Development | 3 min. 15 sec. | 38° C. |
| Bleaching | 1 min. | 38° C. |
| Fixing | 1 min. 15 sec. | 38° C. |
| Stabilizing | 1 min. | 38° C. |
| Drying | 1 min. | 60° C. |

The composition of each processing solution used is illustrated below.

| Color Developing Solution: | |
|---|---|
| Diethylenetriaminepentaacetic acid | 1.0 g |
| 1-Hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N-Ethyl-N-β-hydroxyethyl amino)-2-methylaniline sulfate | 5.0 g |
| Water to make | 1 l |
| pH | 10.20 |
| Bleaching Solution: | |
| First bleaching agent | shown in Table 1 below |
| Second bleaching agent | " |
| Ammonium nitrate | 10.0 g |
| Ammonium bromide | 100.0 g |
| Compound (IIA)-(1) | $5 \times 10^{-3}$ mol |
| Water to make | 1 l |
| pH | shown in Table 1 below |
| The pH was adjusted with aqueous ammonia or acetic acid. | |
| Fixing Solution: | |
| Disodium ethylenediaminetetraacetate | 2.0 g |
| Sodium sulfite | 1.0 g |
| Aqueous solution of ammonium thiosulfate (70% w/v) | 175.0 ml |
| Sodium bisulfite | 4.6 g |
| Ethylenediamine-N,N,N',N'-tetramethylenephosphonic acid | 5.0 g |
| Sodium p-toluenesulfonate | 3.0 g |
| Water to make | 1 l |
| pH | 6.6 |
| Stabilizing Solution: | |
| Formalin (37% w/v) | 1.0 ml |
| Polyoxyethylene-p-mononylphenylether (average degree of polymerization: 10) | 0.3 g |
| 5-Chloro-2-methyl-4-isothiazolin-3-one | 0.03 g |
| Water to make | 1 l |

As shown in Table 1, the bleaching solution contained the first bleaching agent and the second bleaching agent. With respect to the samples thus processed, the amount of remaining silver was determined by X-ray fluorometric analysis at the point in which optical densities of yellow, magenta and cyan were each 2.0. Further, the processed samples containing images having the same density were treated with a test solution for inferior coloring described below for 30 minutes to oxidize dye intermediates remained in the processed samples due to insufficient oxidation during the bleaching step, washed with water and dried. The optical density of the cyan image in each sample was again measured, and thus the increase in density obtained by re-bleaching treatment, that is, the density lost due to the inferior coloring was determined. The results obtained are shown in Table 1.

| Test Solution for Inferior Coloring: | |
|---|---|
| EDTA.Fe(III).$NH_4$.$H_2O$ | 0.3 mol/l |
| EDTA.2Na.$H_2O$ | 0.005 mol/l |
| pH | 6.0 |

TABLE 1

| No. | Sample | First Bleaching Agent: Compound | First Bleaching Agent: Amount (mol/l) | Second Bleaching Agent: Compound | Second Bleaching Agent: Amount (mol/l) | Molar Ratio of Bleaching Agents | pH of Bleaching Solution | Amount of Remaining Silver (μg/cm²) | Inferior Coloring | Remarks |
|---|---|---|---|---|---|---|---|---|---|---|
| 1 | 101 | A-1 | 0.2 | — | — | — | 4.5 | 20.5 | 0.98 | Comparison |
| 2 | " | Comparative Compound a | " | — | — | — | " | 19.6 | 1.21 | " |
| 3 | " | Comparative Compound a | 0.1 | A-1 | 0.1 | 1.0 | " | 18.7 | 1.25 | " |
| 4 | " | A-1 | " | A-3 | " | " | " | 18.5 | 1.19 | " |

TABLE 1-continued

| No. | Sample | First Bleaching Agent Compound | First Bleaching Agent Amount (mol/l) | Second Bleaching Agent Compound | Second Bleaching Agent Amount (mol/l) | Molar Ratio of Bleaching Agents | pH of Bleaching Solution | Amount of Remaining Silver ($\mu g/cm^2$) | Inferior Coloring | Remarks |
|---|---|---|---|---|---|---|---|---|---|---|
| 5 | 101 | A-1 | 0.1 | Compound of Present Invention | 0.1 | 1.0 | " | 8.9 | 0.52 | " |
| 6 | 102 | " | " | Compound of Present Invention | " | " | " | 1.5 | 0.13 | Present Invention |
| 7 | 103 | " | " | Compound of Present Invention | " | " | " | 0.9 | 0.09 | Present Invention |
| 8 | 104 | " | " | Compound of Present Invention | " | " | " | 0.7 | 0.10 | Present Invention |
| 9 | 101 | A-2 | " | Compound of Present Invention | " | " | " | 6.4 | 0.43 | Comparison |
| 10 | 102 | " | " | Compound of Present Invention | " | " | " | 0.8 | 0.11 | Present Invention |
| 11 | 103 | " | " | Compound of Present Invention | " | " | " | 0.3 | 0.01 | Present Invention |
| 12 | 104 | " | " | Compound of Present Invention | " | " | " | 0.5 | 0.03 | Present Invention |
| 13 | 101 | A-3 | 0.1 | Compound of Present Invention | 0.1 | 1.0 | 4.5 | 10.3 | 0.60 | Comparison |
| 14 | 102 | " | " | Compound of Present Invention | " | " | " | 2.1 | 0.15 | Present Invention |
| 15 | 103 | " | " | Compound of Present Invention | " | " | " | 1.2 | 0.10 | Present Invention |
| 16 | 104 | " | " | Compound of Present Invention | " | " | " | 1.3 | 0.67 | Present Invention |
| 17 | 101 | A-4 | " | Compound of Present Invention | " | " | " | 9.6 | 0.56 | Comparison |
| 18 | 102 | " | " | Compound of Present Invention | " | " | " | 1.7 | 0.09 | Present Invention |
| 19 | 103 | " | " | Compound of Present Invention | " | " | " | 0.9 | 0.06 | Present Invention |
| 20 | 104 | " | " | Compound of Present Invention | " | " | " | 0.9 | 0.07 | Present Invention |
| 21 | 101 | A-1 | 0.15 | Compound of Present Invention | 0.05 | 3.0 | " | 12.8 | 0.81 | Comparison |
| 22 | 102 | " | " | Compound of Present Invention | " | " | " | 6.0 | 0.31 | Present Invention |
| 23 | 103 | " | " | Compound of Present Invention | " | " | " | 5.6 | 0.27 | Present Invention |
| 24 | 104 | " | " | Compound of Present Invention | " | " | " | 5.5 | 0.28 | Present Invention |
| 25 | 104 | A-1 | 0.16 | Compound of present invention | 0.04 | 4.0 | 4.5 | 13.1 | 0.92 | Comparison |
| 26 | " | " | 0.15 | Compound of present invention | 0.05 | 3.0 | " | 5.5 | 0.28 | Present Invention |
| 27 | " | " | 0.13 | Compound of present invention | 0.07 | 1.9 | " | 0.3 | 0.01 | Present Invention |
| 28 | " | " | 0.10 | Compound of present invention | 0.10 | 1.0 | " | 0.8 | 0.07 | Present Invention |
| 29 | " | " | 0.05 | Compound of present invention | 0.15 | 0.3 | " | 0.6 | 0.05 | Present Invention |
| 30 | " | " | 0.01 | Compound of present invention | 0.19 | 0.05 | " | 1.2 | 0.35 | Present Invention |

TABLE 1-continued

| No. | Sample | First Bleaching Agent Compound | First Bleaching Agent Amount (mol/l) | Second Bleaching Agent Compound | Second Bleaching Agent Amount (mol/l) | Molar Ratio of Bleaching Agents | pH of Bleaching Solution | Amount of Remaining Silver ($\mu g/cm^2$) | Inferior Coloring | Remarks |
|---|---|---|---|---|---|---|---|---|---|---|
| 31-1 | 103 | " | 0.10 | Compound of present invention | 0.10 | 1.0 | 6.0 | 5.2 | 0.25 | Comparison |
| 31-2 | " | " | " | Compound of present invention | " | " | 5.6 | 2.5 | 0.15 | Present Invention |
| 32 | " | " | " | Compound of present invention | " | " | 5.0 | 1.5 | 0.10 | Present Invention |
| 33 | 103 | A-1 | 0.10 | Compound of present invention | 0.10 | 1.0 | 4.5 | 0.9 | 0.09 | Present Invention |
| 34 | " | " | " | Compound of present invention | " | " | 4.0 | 0.4 | 0.07 | Present Invention |
| 35 | " | " | " | Compound of present invention | " | " | 3.0 | 0.7 | 0.14 | Present Invention |
| 36 | " | " | " | Compound of present invention | " | " | 2.0 | 1.3 | 0.20 | Present Invention |

Compound of Present Invention: Ammonium ferric 1,3-diaminopropanetetraacetate
Comparative Compound a: Ammonium ferric N-methyliminodiacetate As is apparent from the results shown in Table 1, the preferred results wherein the amounts of remaining silver and inferior coloring are small are obtained according to the method of the present invention. Further, the preferred results are obtained in cases wherein the molar ratio of the first bleaching agent to the second bleaching agent is not more than 3.0 and particularly 2.0 to 0.2, and further preferred results are obtained when the pH of the bleaching solution is in a range from 5.0 to 2.0.

EXAMPLE 2

On a cellulose triacetate film support provided with a subbing layer, each layer having the composition shown below was coated to prepare a multilayer color light sensitive material, which is designated Sample 201.

Regarding the compositions of the layers, coated amounts are shown in units of $g/cm^2$, coated amounts of silver halide and colloidal silver are shown by a silver coated amount in units of $g/m^2$, and those of sensitizing dyes are shown using a molar amount per mol of silver halide being present in the same layer.

| | |
|---|---|
| First Layer: Antihalation Layer | |
| Black colloidal silver | 0.2 |
| Gelatin | 1.0 |
| Ultraviolet ray absorbing agent UV-1 | 0.05 |
| Ultraviolet ray absorbing agent UV-2 | 0.1 |
| Ultraviolet ray absorbing agent UV-3 | 0.1 |
| Dispersion solvent OIL-1 | 0.02 |
| Second Layer: Intermediate Layer | |
| Fine grain silver bromide (average particle diameter: 0.07 $\mu$m) | 0.15 |
| Gelatin | 1.0 |
| Third Layer: First Red-Sensitive Emulsion Layer | |
| Monodispersed emulsion (silver iodide: 6 mol %, average particle diameter: 0.4 $\mu$m, coefficient of variation: 15%) | 1.42 |
| Gelatin | 0.9 |
| Sensitizing Dye A | $2.0 \times 10^{-4}$ |
| Sensitizing Dye B | $1.0 \times 10^{-4}$ |
| Sensitizing Dye C | $0.3 \times 10^{-4}$ |
| Cp-b | 0.35 |
| Cp-c | 0.052 |
| Cp-d | 0.047 |

-continued

| | |
|---|---|
| D-1 | 0.023 |
| D-2 | 0.035 |
| HBS-1 | 0.10 |
| HBS-2 | 0.10 |
| Fourth Layer: Intermediate Layer | |
| Gelatin | 0.8 |
| Cpd-B | 0.10 |
| HBS-1 | 0.05 |
| Fifth Layer: Second Red-Sensitive Emulsion Layer | |
| Monodispersed emulsion (silver iodide: 6 mol %, average particle diameter: 0.5 $\mu$m, coefficient of variation: 15%) | 1.38 |
| Gelatin | 1.0 |
| Sensitizing Dye A | $1.5 \times 10^{-4}$ |
| Sensitizing Dye B | $2.0 \times 10^{-4}$ |
| Sensitizing Dye C | $0.5 \times 10^{-4}$ |
| Cp-b | 0.150 |
| Cp-d | 0.027 |
| D-1 | 0.005 |
| D-2 | 0.010 |
| HBS-1 | 0.050 |
| HBS-2 | 0.060 |
| Sixth Layer: Third Red-Sensitive Emulsion Layer | |
| Monodispersed emulsion (silver iodide: 7 mol %, average particle diameter: 1.1 $\mu$m, coefficient of variation: 16%) | 2.08 |
| Gelatin | 1.5 |
| Cp-a | 0.060 |
| Cp-c | 0.024 |
| Cp-d | 0.038 |
| D-1 | 0.006 |
| HBS-1 | 0.12 |
| Seventh Layer: Intermediate Layer | |
| Gelatin | 1.0 |
| Cpd-A | 0.05 |
| Cpd-B | 0.10 |
| HBS-2 | 0.05 |
| Eighth Layer: First Green-Sensitive Emulsion Layer | |
| Monodispersed silver iodobromide emulsion (silver iodide: 3 mol %, average particle diameter: 0.4 $\mu$m, coefficient of variation: 19%) | 0.64 |
| Monodispersed silver iodobromide emulsion (silver iodide: 6 mol %, average particle diameter: 0.7 $\mu$m, coefficient of variation: 18%) | 1.12 |
| Gelatin | 1.0 |
| Sensitizing Dye D | $1 \times 10^{-4}$ |
| Sensitizing Dye E | $4 \times 10^{-4}$ |

-continued

| | |
|---|---|
| Sensitizing Dye F | $1 \times 10^{-4}$ |
| Cp-h | 0.20 |
| Cp-f | 0.61 |
| Cp-g | 0.084 |
| Cp-k | 0.035 |
| Cp-l | 0.036 |
| D-3 | 0.041 |
| D-4 | 0.018 |
| HBS-1 | 0.25 |
| HBS-2 | 0.45 |
| Ninth Layer: Second Green-Sensitive Emulsion Layer | |
| Monodispersed silver iodobromide emulsion (silver iodide: 7 mol %, average particle diameter: 1.0 μm, coefficient of variation: 18%) | 2.07 |
| Gelatin | 1.5 |
| Sensitizing Dye D | $1.5 \times 10^{-4}$ |
| Sensitizing Dye E | $2.3 \times 10^{-4}$ |
| Sensitizing Dye F | $1.5 \times 10^{-4}$ |
| Cp-f | 0.007 |
| Cp-h | 0.012 |
| Cp-g | 0.009 |
| HBS-2 | 0.088 |
| Tenth Layer: Yellow Filter Layer | |
| Yellow Colloidal Silver | 0.06 |
| Gelatin | 1.2 |
| Cpd-A | 0.3 |
| HBS-1 | 0.3 |
| Eleventh Layer: First Blue-Sensitive Emulsion Layer | |
| Monodispersed silver iodobromide emulsion (silver iodide: 6 mol %, average particle diameter: 0.4 μm, coefficient of variation: 20%) | 0.31 |
| Monodispersed silver iodobromide emulsion (silver iodide: 5 mol %, average particle diameter: 0.9 μm, coefficient of variation: 17%) | 0.38 |
| Gelatin | 2.0 |
| Sensitizing Dye G | $1 \times 10^{-4}$ |
| Sensitizing Dye H | $1 \times 10^{-4}$ |
| Cp-i | 0.63 |

-continued

| | |
|---|---|
| Cp-j | 0.57 |
| D-1 | 0.020 |
| D-4 | 0.015 |
| HBS-1 | 0.05 |
| Twelfth Layer: Second Blue-Sensitive Emulsion Layer | |
| Monodispersed silver iodobromide emulsion (silver iodide: 8 mol %, average particle diameter: 1.3 μm, coefficient of variation: 18%) | 0.77 |
| Gelatin | 0.5 |
| Sensitizing Dye G | $5 \times 10^{-5}$ |
| Sensitizing Dye H | $5 \times 10^{-5}$ |
| Cp-i | 0.10 |
| Cp-j | 0.10 |
| D-4 | 0.005 |
| HBS-2 | 0.10 |
| Thirteenth Layer: Intermediate Layer | |
| Gelatin | 0.5 |
| Cp-m | 0.1 |
| UV-1 | 0.1 |
| UV-2 | 0.1 |
| UV-3 | 0.1 |
| HBS-1 | 0.05 |
| HBS-2 | 0.05 |
| Fourteenth Layer: Protective Layer | |
| Monodispersed silver iodobromide emulsion (silver iodide: 4 mol %, average particle diameter: 0.05 μm, coefficient of variation: 10%) | 0.1 |
| Gelatin | 1.5 |
| Polymethyl methacrylate particle (average diameter: 1.5 μm) | 0.1 |
| S-1 | 0.2 |
| S-2 | 0.2 |

Surface active agent K-1 and Gelatin Hardener H-1 were added to each of the layers in addition to the above described components.

The compounds employed for the preparation of Sample 201 are illustrated below.

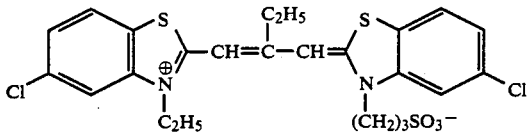

Sensitizing Dye A

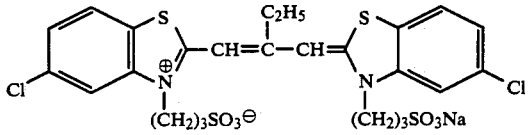

Sensitizing Dye B

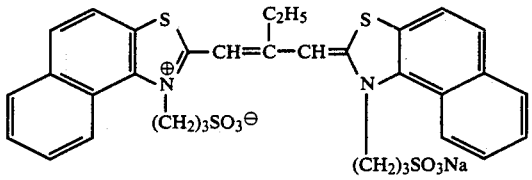

Sensitizing Dye C

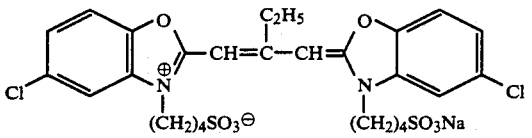

Sensitizing Dye D

-continued
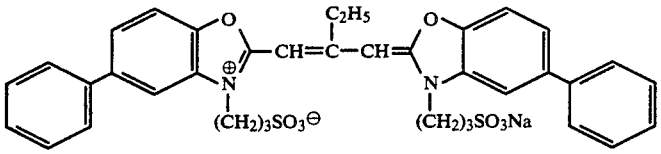
Sensitizing Dye E
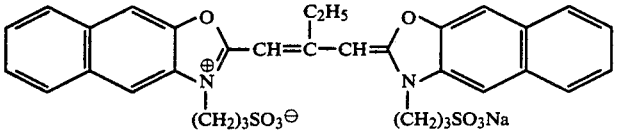
Sensitizing Dye F
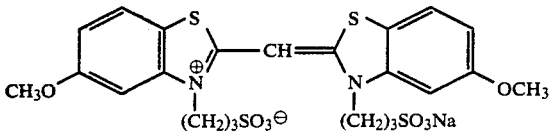
Sensitizing Dye G
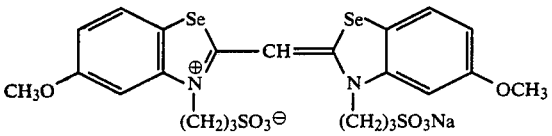
Sensitizing Dye H
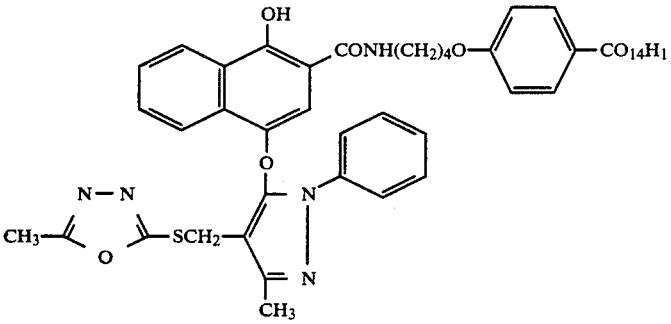
D-1
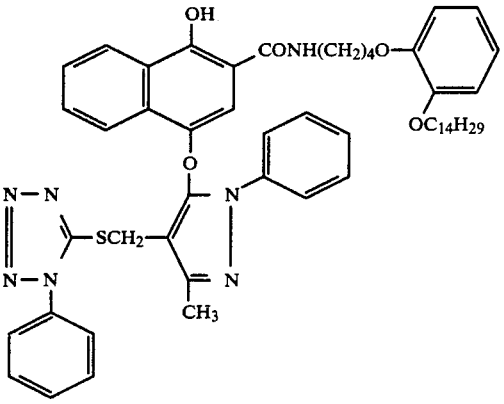
D-2

-continued
D-3
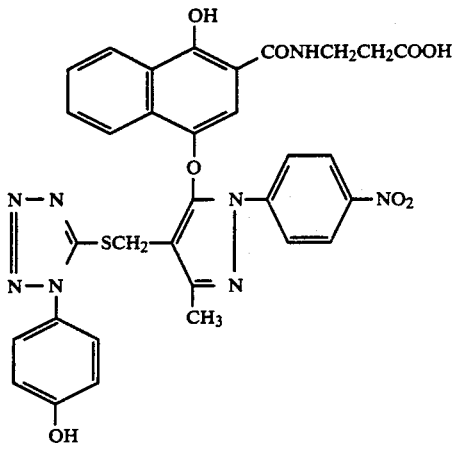
D-4
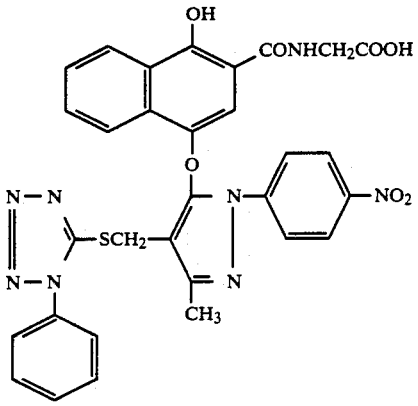
OIL-1
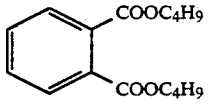
Cp-a
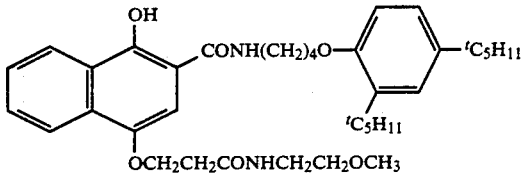
Cp-b
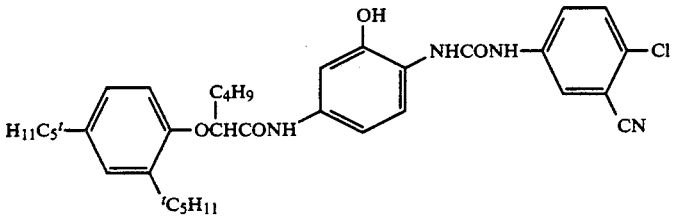

-continued
Cp-c
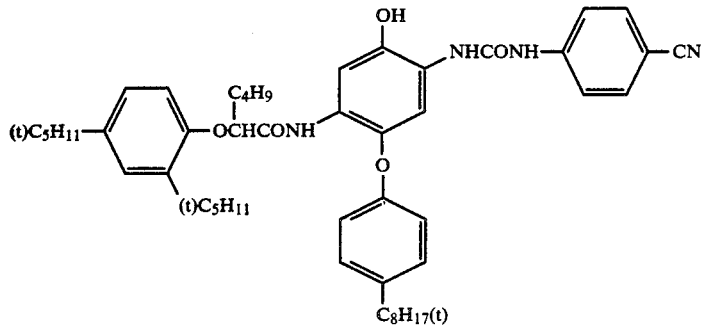
Cp-d
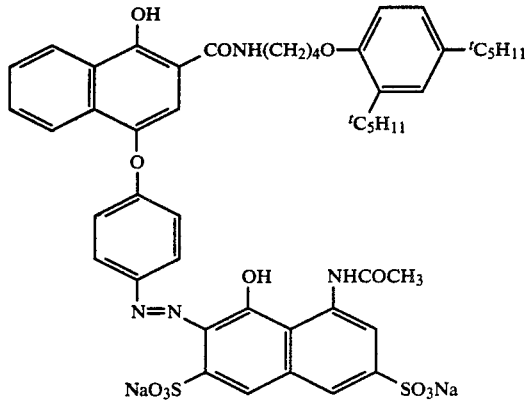
Cp-f
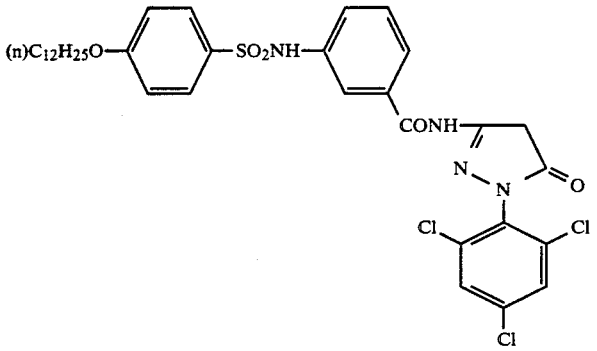
Cp-g
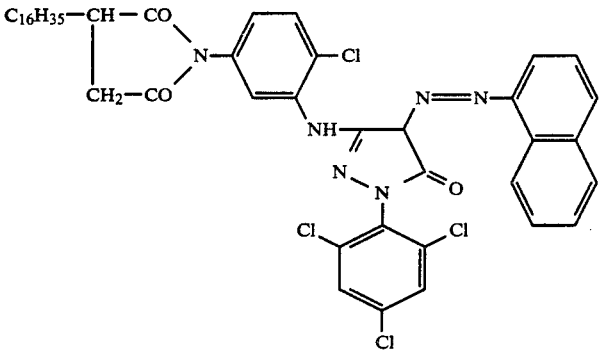
Cp-h
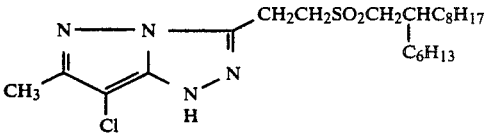

-continued
Cp-i
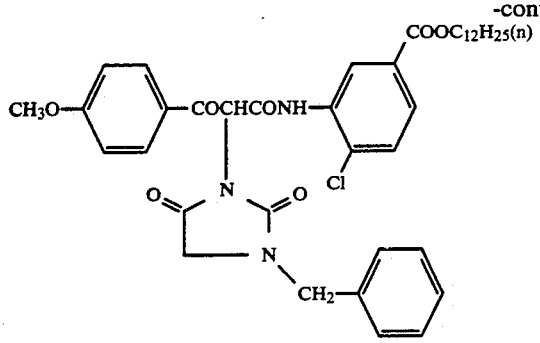
Cp-j
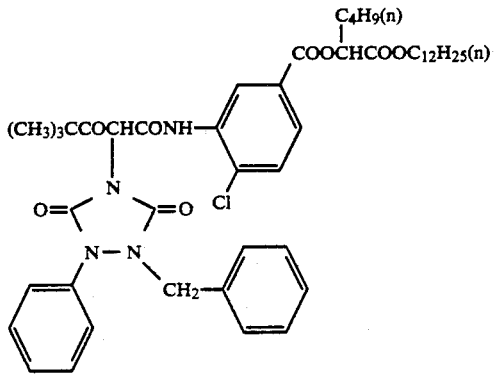
Cp-k
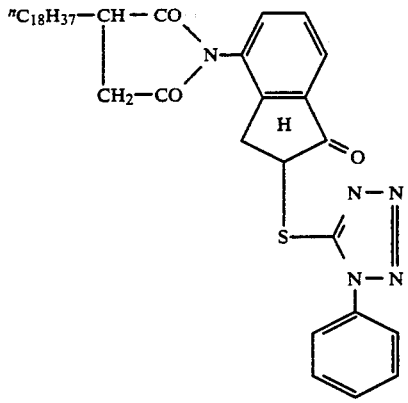
Cp-l
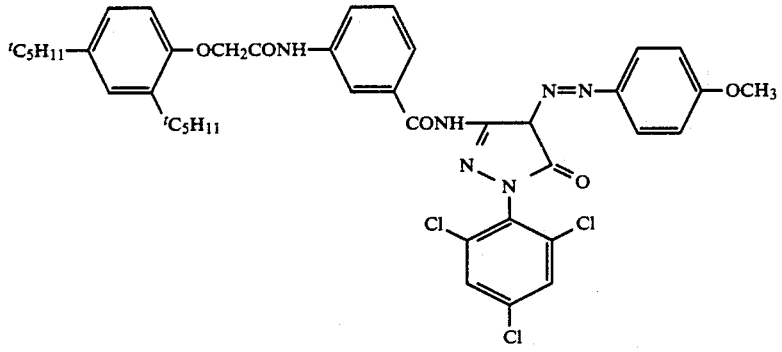
Cp-m
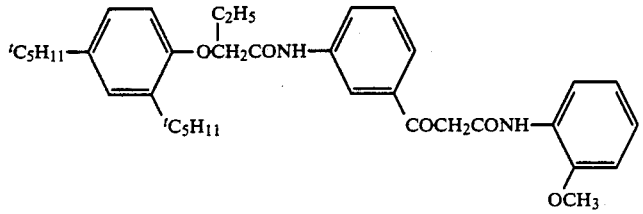

-continued
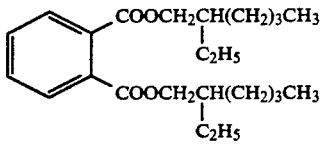
HBS-1
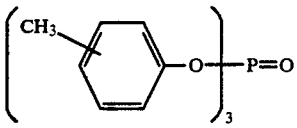
HBS-2
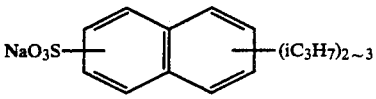
K-1
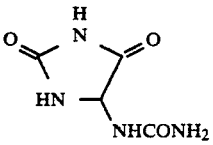
S-1
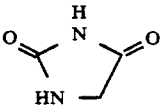
S-2
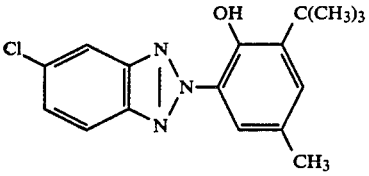
UV-1
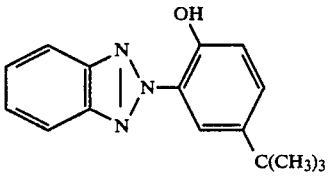
UV-2
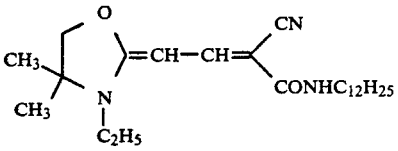
UV-3
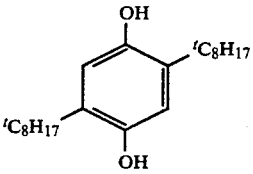
Cpd-A
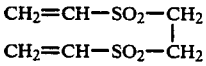
H-1

-continued

Cpd-B

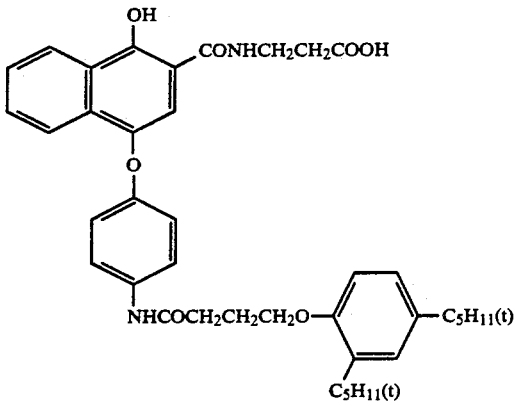

Sample 202 was prepared in the same manner as Sample 201 except using an equimolar amount of Coupler (40) according to the present invention in place of DIR Coupler Cp-k used in Sample 201.

Samples 201 and 202 thus prepared and Samples 101 and 103 prepared in Example 1 were exposed imagewise and then continuously processed according to the processing steps shown below until the total amount of replenishment for the color developing solution equaled twice the tank capacity. With respect tot he samples thus processed, the amount of remaining silver and inferior coloring were evaluated in the same manner as described in Example 1. In the development processing, an automatic developing machine of a belt transportation type as described in JP-A-60-191257 was employed and a jet stirring method as described in JP-A-62-183460 was used in each processing bath.

| Processing Step | Processing Time | Processing Temperature | Amount of* Replenishment | Tank Capacity |
|---|---|---|---|---|
| Color Development | 3 min. 15 sec. | 38° C. | 38 ml | 10 l |
| Bleaching | 1 min. | 38° C. | 4 ml | 4 l |
| Fixing | 1 min. | 38° C. | 30 ml | 4 l |
| Stabilizing (1) | 20 sec. | 38° C. | — | 2 l |
| Stabilizing (2) | 20 sec. | 38° C. | — | 2 l |
| Stabilizing (3) | 20 sec. | 38° C. | 35 ml** | 2 l |
| Drying | 1 min. 15 sec. | 50 to 70° C. | — | |

*Amount of replenishment per 1 meter of 35 m/m width strip.
**The stabilizing steps (1), (2) and (3) were carried out using a countercurrent stabilizing process of (3) → (2) → (1).

The compositions of each processing solution used is illustrated below.

| | Mother Solution | Replenisher |
|---|---|---|
| Color Developing Solution: | | |
| Diethylenetriaminepentaacetic Acid | 5.0 g | 6.0 g |
| Sodium Sulfite | 4.0 g | 4.4 g |
| Potassium Carbonate | 30.0 g | 37.0 g |
| Potassium Bromide | 1.3 g | 0.9 g |
| Potassium Iodide | 1.2 mg | — |
| Hydroxylamine Sulfate | 2.0 g | 2.8 g |
| 4-(N-Ethyl-N-β-hydroxyethylamino)-2-methylaniline sulfate | 4.7 g | 5.3 g |
| Water to make | 1.0 l | 1.0 l |
| pH | 10.00 | 10.05 |
| Bleaching Solution: | | |
| Ammonium Ferric Ethylenediamine-tetraacetate Dihydrate (EDTA.Fe) | 0.08 mol | 1.28 mol |
| Ammonium Ferric 1,3-Diaminopropane-tetraacetate (1,3-DPTA.Fe) | 0.08 mol | 1.28 mol |
| Compound (IIA)-(1) | $5 \times 10^{-3}$ mol | $8 \times 10^{-3}$ mol |
| 1,3-Diaminopropanetetraacetic Acid | 4.0 g | 5.0 g |
| Ammonium Bromide | 100.0 g | 160.0 g |
| Ammonium Nitrate | 30.0 g | 50.0 g |
| Aqueous Ammonia (27%) | 20.0 ml | 23.0 ml |
| Acetic Acid (98%) | 9.0 ml | 15.0 ml |
| Water to make | 1.0 l | 1.0 l |
| pH | 5.0 | 4.0 |
| Fixing Solution: | | |
| 1-Hydroxyethylidene-1,1-diphosphonic Acid | 5.0 g | 6.0 g |
| Sodium Sulfite | 7.0 g | 8.0 g |
| Sodium Bisulfite | 5.0 g | 5.5 g |
| Aqueous Solution of Ammonium Thiosulfate (70% w/v) | 170.0 ml | 200.0 ml |
| Water to make | 1.0 l | 1.0 l |
| pH | 6.7 | 6.6 |
| Stabilizing Solution: (both mother solution and replenisher) | | |
| Formalin (37%) | | 1.2 ml |
| 5-Chloro-2-methyl-4-isothiazolin-3-one | | 6.0 mg |
| 2-Methyl-4-isothiazolin-3-one | | 3.0 mg |
| Surface Active Agent $CH_{10}H_{21}$—O(—$CH_2CH_2O$—)$_{10}$H | | 0.4 g |
| Ethylene Glycol | | 1.0 g |
| Water to make | | 1.0 l |
| pH | | 5.0 to 7.0 |

The results obtained are shown in Table 2.

TABLE 2

| No. | Sample | Amount of Remaining Silver ($\mu g/cm^2$) | Inferior Coloring | Remark |
|---|---|---|---|---|
| 1 | 101 | 13.4 | 0.85 | Comparison |
| 2 | 103 | 3.0 | 0.11 | Present Invention |
| 3 | 201 | 15.4 | 0.98 | Comparison |
| 4 | 202 | 2.7 | 0.21 | Present Invention |

Same results as those in Example 1 were obtained.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photographic material which comprises, after color development of an imagewise exposed silver halide color photographic material, processing the developed silver halide color photographic material by subjecting the developed silver halide color photographic material to a desilvering step, said desilvering step having a processing time of 1 to 4 minutes, said desilvering step including processing the developed silver halide color photographic material with a bleaching solution having a pH of from 5.3 to 2, wherein the silver halide color photographic material contains at least one DIR coupler having at its coupling active position a group which forms a development inhibitor or precursor thereof when released from the coupling active position of the coupler upon a coupling reaction with an oxidation product of an aromatic primary amine color developing agent which is formed upon a color development reaction, and further decomposes into a compound having substantially no effect on photographic properties once discharged into a color developing solution wherein the half-life period of the development inhibitor or precursor thereof at pH 10.0 is not more than 4 hours, and wherein the bleaching solution contains, as a bleaching agent, a ferric complex salt of 1,3-diaminopropanetetraacetic acid.

2. A method for processing a silver halide color photographic material as in claim 1, wherein said bleaching solution contains, as bleaching agents, a ferric complex salt of 1,3-diaminopropanetetraacetic acid and at least one ferric complex salt of a compound selected from the group consisting of Compounds (A) in a molar ratio of the latter to the former being not more than 3:

Compounds (A)

A-1:Ethylenediaminetetraaceetic acid
A-2:Dithylenetriaminepentaacetic acid
A-3:Cyclohexanediaminetetraacetic acid
A-4:1,2-Propylenediaminetetraacetic acid.

3. A method for processing a silver halide color photographic material as in claim 2, wherein said molar ratio is 0.2 to 2.0.

4. A method for processing a silver halide color photographic material as in claim 1, wherein the half-life period of the development inhibitor or precursor thereof at pH of 10.0 is 2 hours or less.

5. A method for processing a silver halide color photographic material as in claim 4, wherein the half-life period of the development inhibitor or precursor thereof at a pH of 10.0 is 1 hour or less.

6. A method for processing a silver halide color photographic material as in claim 1, wherein the DIR coupler is represented by the general formula (I)

$$A\text{-}(L_1)_a\text{—}Z\text{-}(L_2\text{—}Y)_b]_m \qquad (I)$$

wherein A represents a coupler residue; Z represents a fundamental portion of a compound having a development inhibiting function which is connected directly (when a is 0) or through a linking group $L_1$ (when a is 1) to the coupling position of the coupler; Y represents a substituent connected to Z through linking group $L_2$ to allow the development-inhibiting function of Z to emerge; $L_1$ represents a linking group; $L_2$ represents a linking group including a chemical bond which is cleaved in a developing solution; a represents the integer 0 or 1; b represents the integer 1 or 2, and when b represents 2, the two —$L_2$—Y groups may be the same or different; and m represents the integer 1 or 2.

7. A method for processing a silver halide color photographic material as claimed in claim 6, wherein the coupler residue represented by A is a coupler residue derived from a yellow color image forming coupler, a magenta color image forming coupler, a cyan color image forming coupler, or a non-color image forming coupler.

8. A method for processing a silver halide color photographic material as in claim 6, wherein the fundamental portion represented by Z is a divalent nitrogen-containing heterocyclic group or a nitrogen-containing heterocyclic thio group.

9. A method for processing a silver halide color photographic material as in claim 8, wherein the nitrogen-containing heterocyclic thio group is a tetrazolylthio group, a benzothiazolylthio group, a benzimidazolylthio group, a triazolylthio group, or an imidazolylthio group.

10. A method for processing a silver halide color photographic material as claimed in claim 6, wherein the DIR coupler is represented by one of the following general formulae:

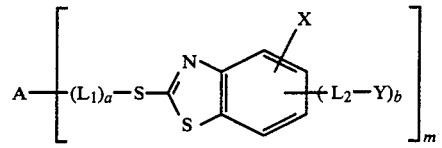

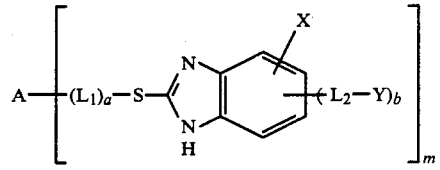

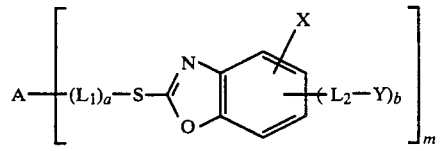

-continued

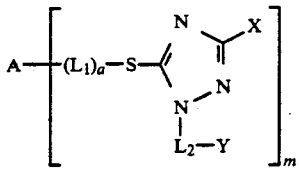

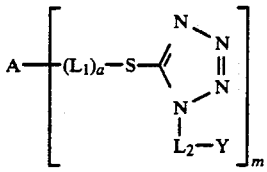

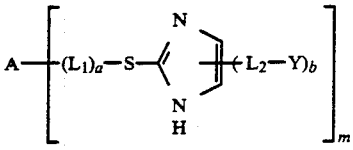

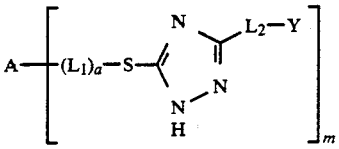

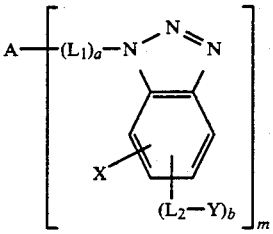

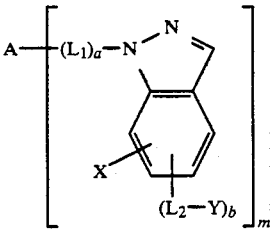

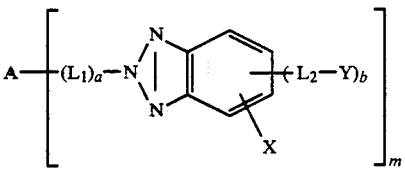

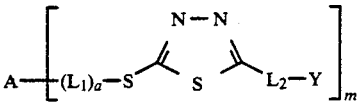

wherein A, $L_1$, a, $L_2$, Y, b and m each has the same meaning as defined for the general formula (I); and X represents a hydrogen atom, a halogen atom, an alkyl group, an alkenyl group, an alkanamido group, an alkenamido group, an alkoxy group, a sulfonamido group, or an aryl group.

11. A method for processing a silver halide color photographic material as in claim 6, wherein the substituent represented by Y is an alkyl group, an alkenyl group, an aryl group, an aralkyl group, or a heterocyclic group.

12. A method for processing a silver halide color photographic material as in claim 6, wherein the DIR coupler is represented by one of the following general formulae:

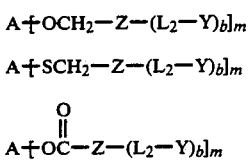

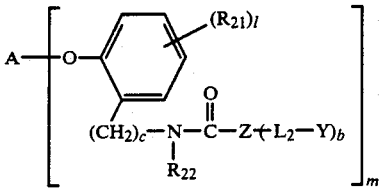

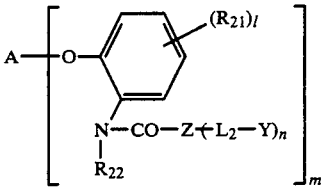

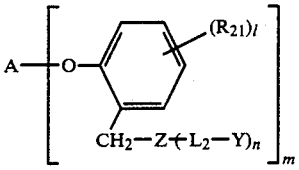

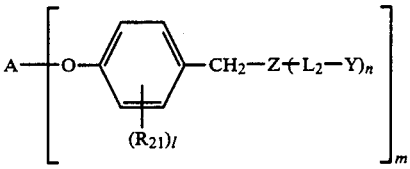

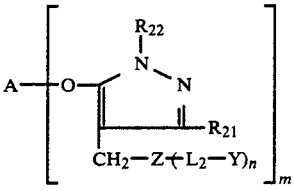

wherein $R_{21}$ represents a hydrogen atom, a halogen atom, an alkyl group, an alkenyl group, an aralkyl group, an alkoxy group, an alkoxycarbonyl group, an anilino group, an acylamino, a ureido group, a cyano group, a nitro group, a sulfonamido group, a sulfamoyl group, a carbamoyl group, an aryl group, a carboxy group, a sulfo group, a cycloalkyl group, an alkanesulfonyl group, an arylsulfonyl group, or an acyl group; $R_{22}$ represents a hydrogen atom, an alkyl group, an alkenyl group, an aralkyl group, a cycloalkyl group or an aryl group; c represents an integer from 0 to 2; b and l each represent the integer 1 or 2, and when l represents the integer 2, two $R_{21}$ groups may be bonded to each other to form a condensed ring.

13. A method for processing a silver halide color photographic material as in claim 6, wherein the moiety forming the linking group represented by $L_2$ is —COO—, —NHCOO—, —$SO_2O$—, —$OCH_2CH_2SO_2$—,

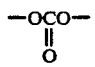

or

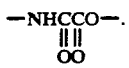

14. A method for processing a silver halide color photographic material as in claim 6, wherein the linking group represented by $L_2$ and the bonding thereof to Z and Y is represented by one of the following general formulae:

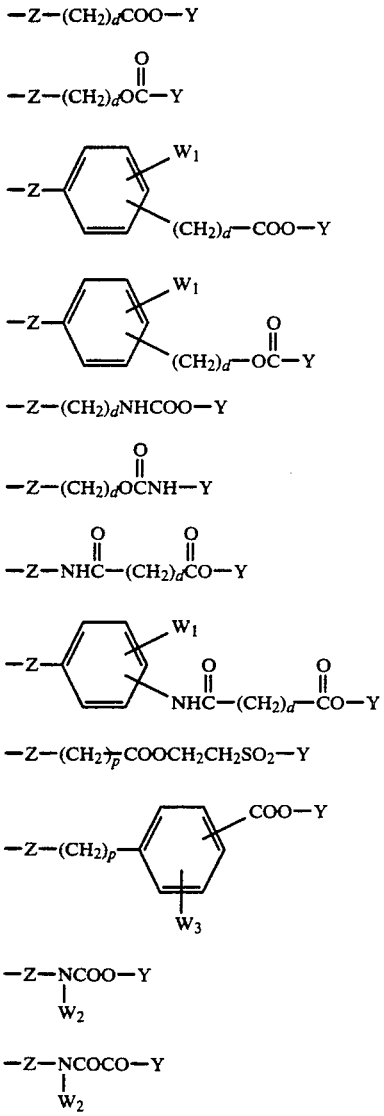

wherein d represents an integer from 0 to 10; $W_1$ represents a hydrogen atom, a halogen atom, an alkyl group having from 1 to 10 carbon atoms, an alkanamido group having from 1 to 10 carbon atoms, an alkoxy group having from 1 to 10 carbon atoms, an alkoxycarbonyl group having from 2 to 10 carbon atoms, an aryloxycarbonyl group having from 6 to 22 carbon atoms, an alkanesulfonamido group having from 1 to 10 carbon atoms, an aryl group having from 6 to 22 carbon atoms, a carbamoyl group, an N-alkylcarbamoyl group having from 1 to 10 carbon atoms, a nitro group, a cyano group, an arylsulfonamido group having from 6 to 10 carbon atoms, a sulfamoyl group or an imido group; $W_2$ represents a hydrogen atom, an alkyl group having from 1 to 6 carbon atoms, an aryl group having from 6 to 22 carbon atoms or an alkenyl group having from 2 to 10 carbon atoms; W3 represents a hydrogen atom, a halogen atom, a nitro group, an alkoxy group having from 1 to 6 carbon atoms or an alkyl group having from 1 to 6 carbon atoms; and p represents an integer of from 0 to 6.

15. A method for processing a silver halide color photographic material as in claim 6, wherein the DIR coupler is represented by the following general formula (II), (III), (IV), (V), (VI), (VII), or (VIII)

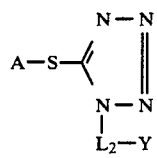

(II)

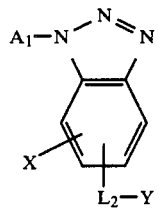

(III)

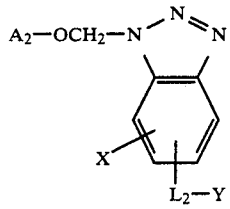

(IV)

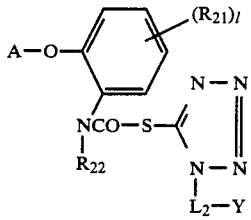

(V)

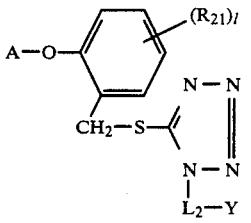

(VI)

-continued (VII)

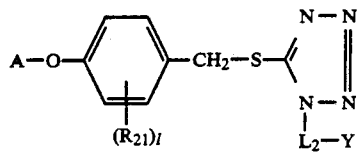

(VIII)

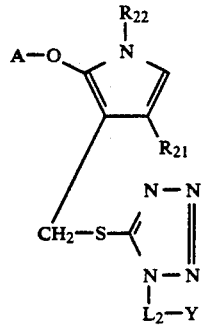

wherein A, $L_2$, and Y each has the same meaning as defined for the general formula (I); $A_1$ represents a coupler residue as defined for A in the general formula (I), excluding cyan color image forming coupler residues; $A_2$ represents a cyan color image forming coupler residue of the coupler residues as defined for A in the general formula (I); X represents a hydrogen atom, a halogen atom, an alkyl group, an alkenyl group, an alkanamido group, an alkenamido group, an alkoxy group, a sulfonamido group, or an aryl group; $R_{21}$ represents a hydrogen atom, a halogen atom, an alkyl group, an alkenyl group, an aralkyl group, an alkoxy group, an alkoxycarbonyl group, an anilino group, an acylamino group, a ureido group, a cyano group, a nitro group, a sulfonamido group, a sulfamoyl group, a carbamoyl group, an aryl group, a carboxy group, a sulfo group, a cycloalkyl group, an alkanesulfonyl group, an arylsulfonyl group or an acyl group; $R_{22}$ represents a hydrogen atom, an alkyl group, an alkenyl group, an aralkyl group, a cycloalkyl group or an aryl group; l represents the integer of 1 to 4 and when l represents the integer Of 2 or more, the $R_{21}$ grOups may be bonded to each other to form a condensed ring.

16. A method for processing silver halide color photographic material as in claim 2, wherein the bleaching solution further contains an aminopolycarboxylic acid.

17. A method for processing a silver halide color photographic material as in claim 2, wherein the bleaching solution further contains a bleach accelerating agent.

18. A method for processing a silver halide color photographic material as in claim 17, wherein the bleach accelerating agent is a compound represented by the following general formula (IA), (IIA), (IIIA), (IVA), (VA) or (VIA):

$$R^{1A}—S—M^{1A} \quad \text{(IA)}$$

wherein $M^{1A}$ represents a hydrogen atom, an alkali metal atom or an ammonium: and $R^{1A}$ represents an alkyl group, an alkylene group, an aryl group or a heterocyclic group, $$R^{1A}—S—S—R^{6A} \quad \text{(IIA)}$$

wherein $R^{1A}$ is same as $R^{1A}$ defined in the general formula (IA); $R^6A$ has the same meaning as $R^{1A}$ defined in the general formula (IA); and $R^{1A}$ and $R^{6A}$ may be the same or different, (IIIA)

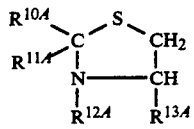

wherein $R^{10A}$ and $R^{11A}$, which may be the same or different, each represents a hydrogen atom, a substituted or unsubstituted alkyl group, a substituted or unsubstituted phenyl group or a substituted or unsubstituted heterocyclic group; $R^{12A}$ represents a hydrogen atom or a substituted or unsubstituted lower alkyl group; and $R^{13A}$ represents a hydrogen atom an alkyl group or a carbonyl group, (IVA)

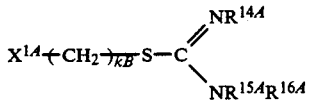

wherein $R^{14A}$, $R^{15A}$ and $R^{16A}$, which may be the same or different, each represents a hydrogen atom or a lower alkyl group or $R^{14A}$ and $R^{15A}$ or $R^{16A}$ may be bonded to each other to form a ring; $X^{1A}$ represents a substituted or unsubstituted amino group, a sulfo group, a hydroxy group, a carboxy group or a hydrogen atom; and kB represents an integer from 1 to 5, (VA)

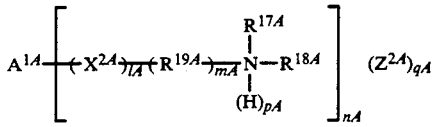

wherein $A^{1A}$ represents an n-valent aliphatic linking group, an n-valent aromatic linking group or an n-valent heterocyclic linking group (when n is 1, $A^{1A}$ represents an aliphatic group, an aromatic group or a heterocyclic group); $X^{2A}$ represents —O—, —S—or

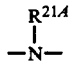

wherein $R^{21A}$ represents a lower alkyl group; $R^{17A}$ and $R^{18A}$, which may be the same or different, each represents a substituted or unsubstituted lower alkyl group, or $R^{17A}$ and $R^{18A}$ may be connected with each other through a carbon atom or a hetero atom to form a 5-membered or 6-membered heterocyclic ring; $R^{19A}$ represents a lower alkylene group having from 1 to 5 carbon atoms; $Z^{2A}$ represents an anion; $R^{17A}$ or $R^{18A}$ and $A^{1A}$ may be connected with each other through a carbon atom or a hetero atom to form a 5-membered or 6-membered heterocyclic ring; $R^{17A}$ or $R^{18A}$ and $R^{19A}$ may be connected with each other through a carbon atom or a hetero atom to form a 5-membered or 6-membered heterocyclic ring; lA represents 0 or 1; mA represents 0 or 1; nA represents 1, 2 or 3; pA represents 0 or 1; and qA represents 0, 1, 2 or 3,

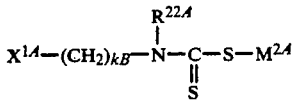

(VIA)

wherein $X^{1A}$ and kB are same as $X^{1A}$ and kB defined in general formula (IVA) respectively; $M^{2A}$ represents a hydrogen atom, an alkali metal atom, ammonium or

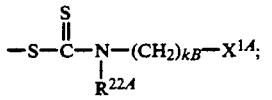

$R^{22A}$ represents a hydrogen atom or a substituted or unsubstituted lower alkyl group.

19. A method for processing a silver halide color photographic material as in claim 18, wherein the bleach accelerating agent is a compound represented by the following general formulae (IA-1), (IA-2), (IA-3) or (IA-4):

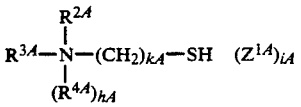

(IA-1)

wherein $R^{2A}$, $R^{3A}$ and $R^{4A}$, which may be the same or different, each represents a hydrogen atom, a substituted or unsubstituted lower alkyl group or an acyl group, or $R^{2A}$ and $R^{3A}$ may be bonded to each other to form a ring; kA represents an integer from 1 to 3; $Z^{1A}$ represents an anion; hA represents the integer 0 or 1; and iA represents the integer 0 or 1,

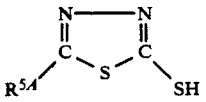

(IA-2)

-continued

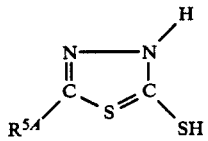

(IA-3)

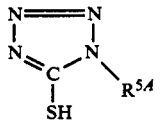

(IA-4)

wherein $R^{5A}$ represents a hydrogen atom, an amino group, a substituted or unsubstituted lower alkyl group, an amino group substituted with an alkyl group or a substituted or unsubstituted alkylthio group.

20. A method for processing a silver halide color photographic material as in claim 18, wherein the bleach accelerating agent is a compound represented by the following general formula (IIA-1):

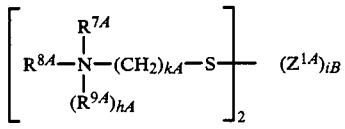

(IIA-1)

wherein $R^{7A}$, $R^{8A}$ and $R^{9A}$ each has the same meaning as $R^{2A}$, $R^{3A}$ and $R^{4A}$ defined in the general formula (IA-1); hA, kA and $Z^{1A}$ are same as hA, kA and $Z^{1A}$ defined in the general formula (IA-1) respectively; and iB represents the integer 0, 1 or 2.

21. A method for processing a silver halide color photographic material as in claim 1, wherein the bleaching solution has a pH of 2.0 to 5.0.

22. A method for processing a silver halide color photographic material as in claim 1, wherein the processing time for the desilvering step is 1.5 to 3 minutes.

23. A method for processing a silver halide color photographic material as in claim 2, wherein compound (A) is A-1.

* * * * *